United States Patent [19]

Daughton et al.

[11] Patent Number: 4,478,509

[45] Date of Patent: Oct. 23, 1984

[54] CONTROL SYSTEM AND INTERFACE FOR ELECTROSTATOGRAPHIC MACHINES

[75] Inventors: John W. Daughton; Gary A. Gray; Stephen A. Wilczek, all of Fairport; Edward Steiner, Macedon, all of N.Y.

[73] Assignee: Xerox Corporation, Stamford, Conn.

[21] Appl. No.: 894,470

[22] Filed: Apr. 10, 1978

Related U.S. Application Data

[63] Continuation of Ser. No. 677,473, Apr. 15, 1978, abandoned.

[51] Int. Cl.[3] ..... G03G 15/00

[52] U.S. Cl. ..... 355/14 C

[58] Field of Search ..... 355/14, 14 C

[56] References Cited

U.S. PATENT DOCUMENTS

| | | | |
|---|---|---|---|
| 3,690,760 | 9/1972 | Banks et al. | 355/14 X |
| 3,909,128 | 9/1975 | Sohm | 355/14 X |
| 4,025,186 | 5/1977 | Hunt et al. | 355/14 |
| 4,035,072 | 7/1977 | Deetz et al. | 355/14 |

OTHER PUBLICATIONS

Intel Data Catalog, 1977, "8259 Programmable Interrupt Controller", pp. 10-212 to 10-216.

Intel 8080 Microcomputer Systems User's Manual, Sep. 1975, pp. 5-101 to 5-108; 5-153 to 5-157.

*Primary Examiner*—A. D. Pellinen

*Attorney, Agent, or Firm*—John E. Beck; Frederick E. McMullen; Ronald F. Chapuran

[57] ABSTRACT

An electrostatographic type copying or reproduction machine incorporating a programmable controller to operate the various machine components in an integrated manner to produce copies. The controller carries a master program bearing machine operating parameters from which an operating program for the specific copy run desired is formed and used to operate the machine components to produce the copies programmed. A multiple prioritized interrupt system is employed to distribute the operating program to the machine.

7 Claims, 50 Drawing Figures

FROM CLOCK 552
Ø1
Ø2
542
507
510
TO: MEMORY 545,546
ADDRESS
A0
A15
(HOLD A)
(HOLD)
(D BIN)
EN
TO: MEMORY
TO: MEMORY 545,546
508
D0
DATA
D7
511
TO: MEMORY READY 548
(MEMR)
(OUT)
(WO)
(INP)
(MI)
(HALTA)
(STACK)
(INTA)
D0
D7
LATCH REGISTER
O1—I
FROM: 522
(SYNC)
(READY)
FROM: MEMORY READY 548
(INT)
(RESET)
(WAIT)
FROM: 550
(INTE)
(WR)
TO: MEMORY 546,545

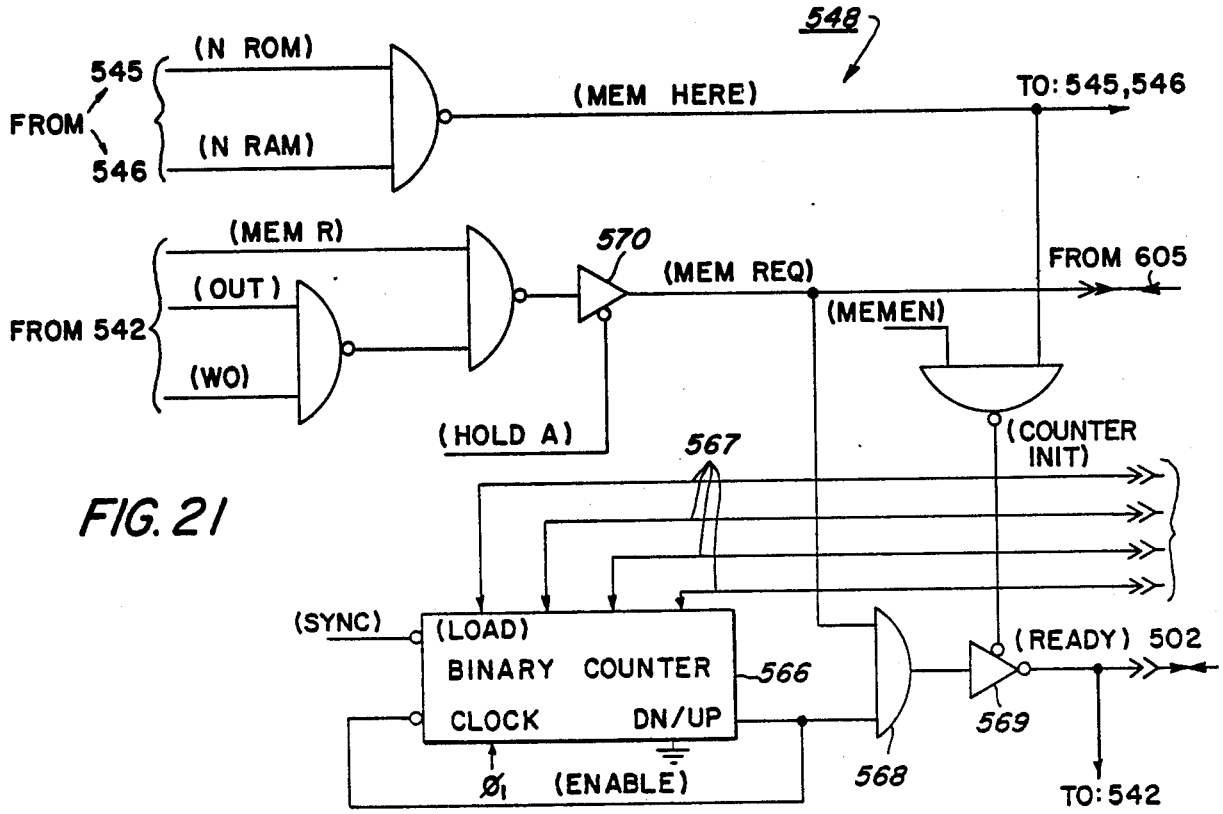
FIG. 21
MEMORY READY
FIG. 24
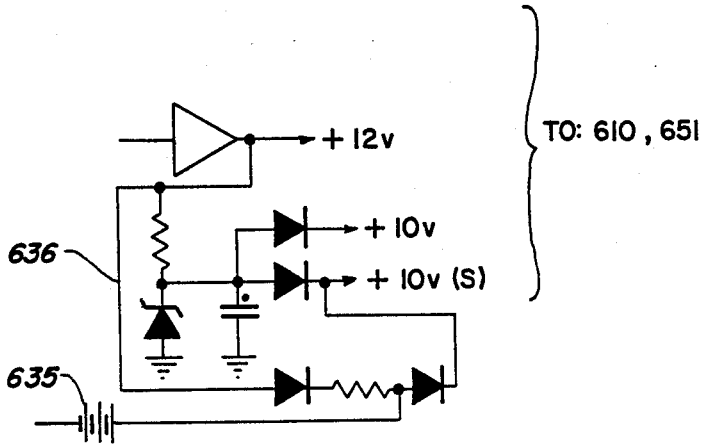

MACHINE INTERRUPT ROUTINE

LEGEND:

PNTR- POINTER
INCRM- INCREMENT
REL- RELATIVE
ADDR- ADDRESS
SR - SHIFT REGISTER
REG - REGISTER
SUBR- SUBROUTINE

DOCUMENT HANDLER INTERRUPT ROUTINE

REAL TIME INTERRUPT

LEGEND:

PNTR - POINTER
RTC - REAL TIME COUNTER
CNTR - COUNTER
REG - REGISTER

CONTROL SYSTEM AND INTERFACE FOR ELECTROSTATOGRAPHIC MACHINES

This is a continuation of application Ser. No. 677,473 filed Apr. 15, 1978, now abandoned.

This invention relates to electrostatographic xerographic type reproduction machines, and more particularly, to an improved control system for such machines.

The advent of higher speed and more complex copiers and reproduction machines has brought with it a corresponding increase in the complexity in the machine control wiring and logic. While this complexity manifests itself in many ways, perhaps the most onerous involves the inflexibility of the typical control logic/-writing systems. For as can be appreciated, simple unsophisticated machines with relatively simple control logic and wiring can be altered and modified easily to incorporate changes, retrofits, and the like. Servicing and repair of the control logic is also fairly simple. On the other hand, some modern high speed machines, which often include sorters, a document handler, choice of copy size, multiple paper trays, jam protection and the like have extremely complex logic systems making even the most minor changes and improvements in the control logic difficult, expensive and time consuming. And servicing or repairing the machine control logic may similarly entail substantial difficulty, time and expense.

To mitigate problems of the type alluded to, a programmable controller may be used, enabling changes and improvements in the machine operation to be made through the expediency of reprogramming the controller. However, the control data which operates the machine and which is stored in the controller memory pending use, must be transferred to the various machine components at the proper time and in the correct sequence without unduly interfering with or intruding unnecessarily upon the other essential functions and operations of the controller.

It is therefore an object of the present invention to provide a new and improved control system for electrostatographic type reproduction machines.

It is a further object of the present invention to provide a system for interrupting operation of the programmable controller for a reproduction machine to permit operating data to be transferred from the controller memory section to the processing section or processor for the reproduction machine.

It is an object of the present invention to provide a multiple, prioritized interrupt system for transferring program operating data to a computer controlled reproduction machine.

It is an object of the present invention to provide an interrupt system driven in synchronization with the reproduction machine being controlled to transfer operating data to the machine.

It is a further object of the present invention to provide a control for an electrostatographic reproduction machine comprised of background and foreground machine operating routines, the latter containing operating data associated with the copy run or runs programmed.

It is an object of the present invention to provide a reproduction machine control comprised of background and foreground operating routines with an arrangement for temporarily interrupting the background routine in progress to transfer operating data from the foreground operating routine to said machine.

It is an object of the present invention to provide a reproduction machine control including machine background and foreground operating control routines, the latter being associated with the copy run or runs programmed, together with means for transferring operating data from the foreground operating control routines to the machine in synchronism with the machine.

It is an object of the present invention to provide a control for an electrostatographic type reproduction machine comprised of background and foreground machine operating routines with a multiple prioritized system for interrupting the background control routine in progress to transfer and/or update operating data from the foreground routine.

It is an object of the present invention to provide a multiple prioritized interrupt system for synchronizing operation of the component parts of a xerographic machine in a real time environment.

The invention relates to a reproduction machine for producing copies of an original having a photosensitive member, plural discrete components cooperable with one another and the photosensitive member to electrostatically produce copies on a support material and timing means for synchronizing operation of the machine components with one another, the combination comprising control means for operating the machine components in accordance with a control program whereby to provide an operative reproduction machine, the control program including background operating routines and foreground operating routines, the foreground operating routines being associated with the timing means; the control means normally operating the machine components in accordance with the control program background routines; and interrupt means to temporarily suspend the background routine in progress and transfer operating control of the machine to the control program foreground routines whereby operating instructions for the machine components from the foreground operating routines are relayed in synchronous fashion.

Other objects and advantages will be apparent from the ensuing description and drawings in which.

Figure 18A:
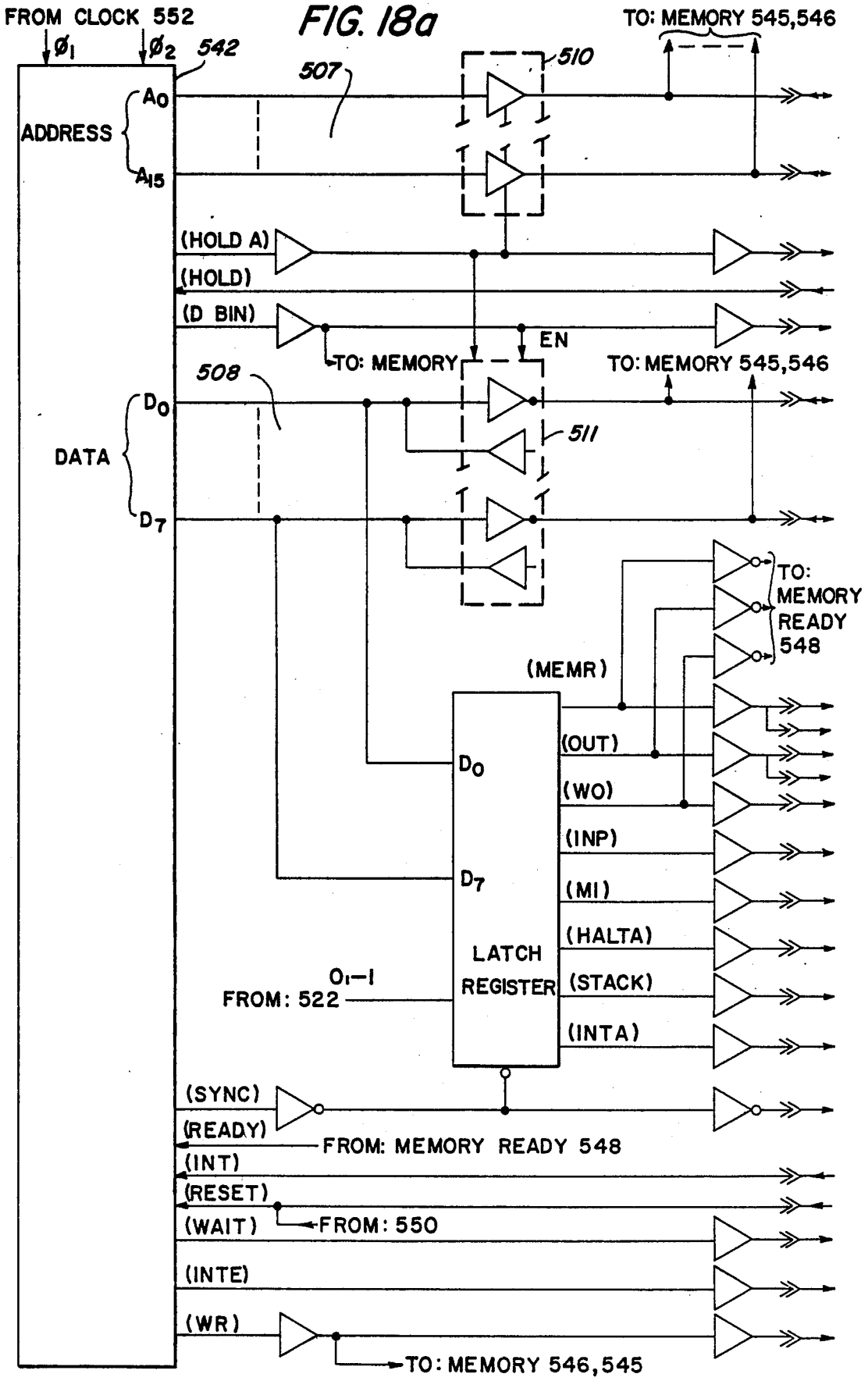
Figure 18B:
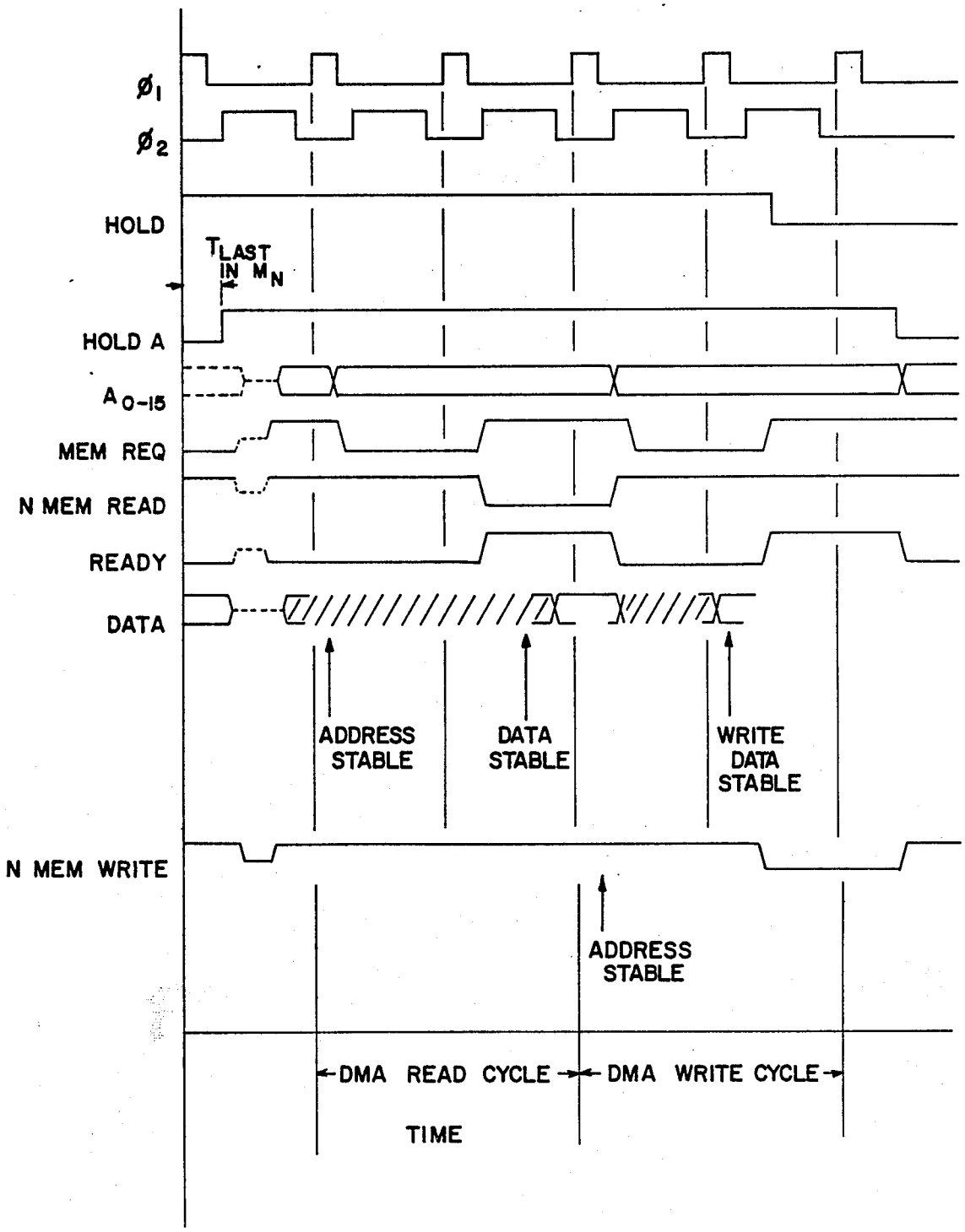
Figure 19A:
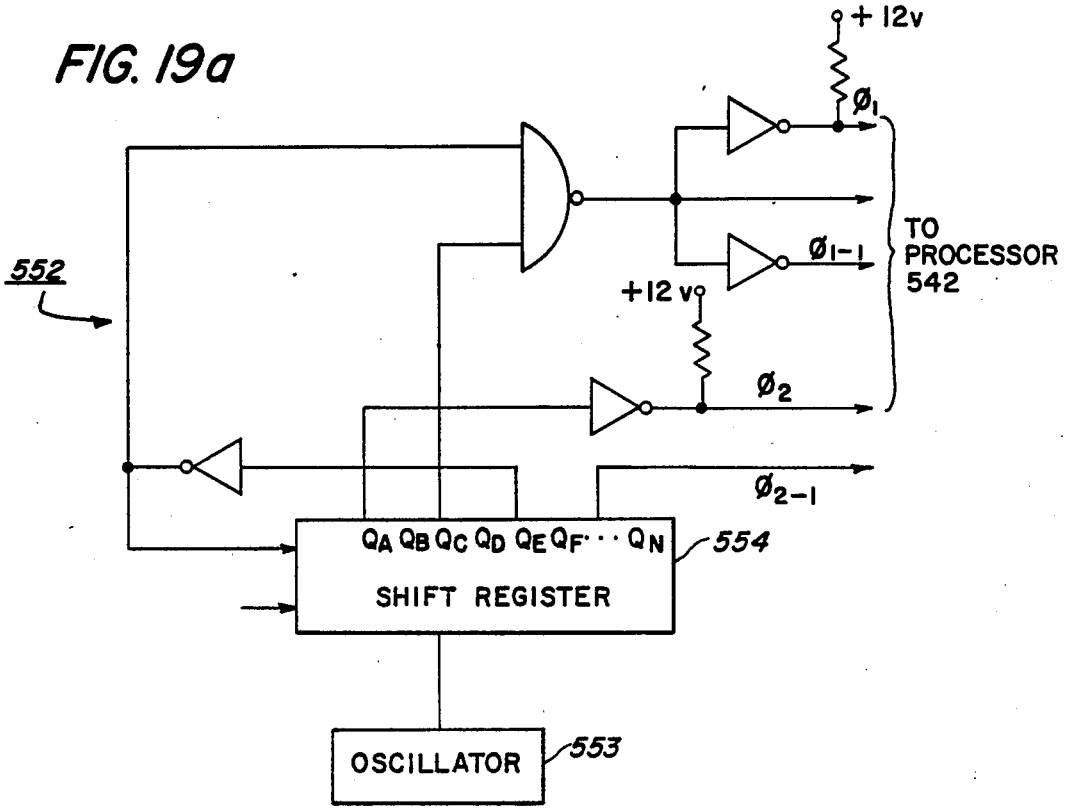
Figure 19B:
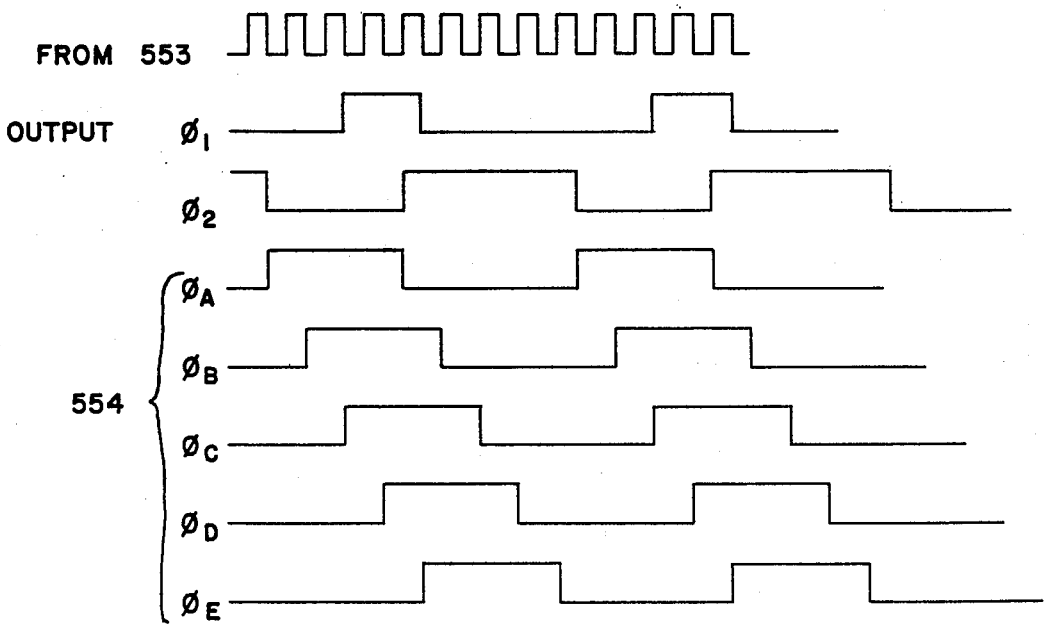

FIG. 18*a* is a block diagram showing the CPU microprocessor input/output connections;

FIG. 18*b* is a timing chart of Direct Memory Access (DMA) Read and Write cycles;

FIG. 19*a* is a logic schematic of the CPU clock;

FIG. 19*b* is a chart illustrating the output wave form of the clock shown in FIG. 19*a;*

Figure 1:
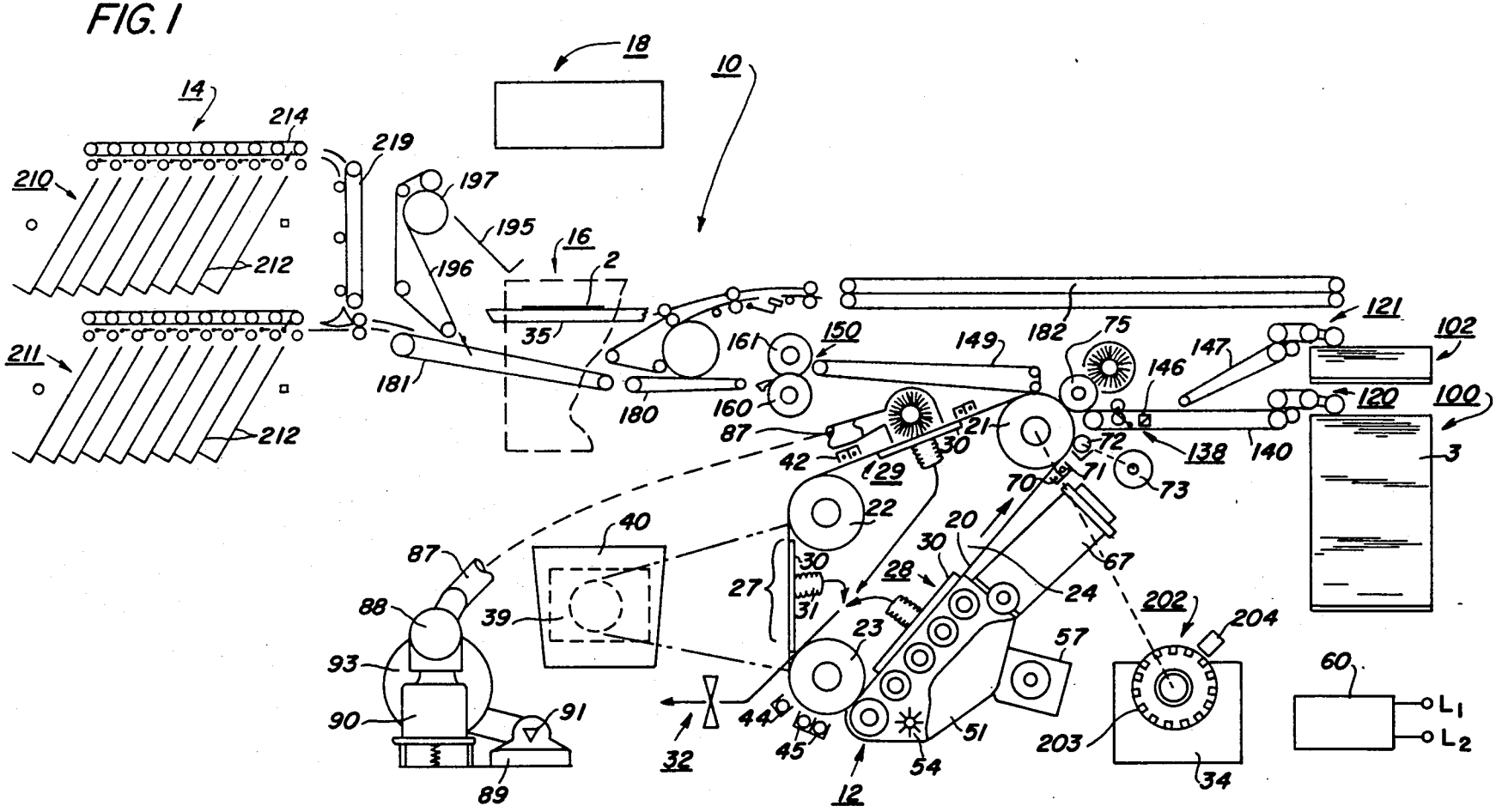
FIG. 1 is a schematic representation of an exemplary reproduction apparatus incorporating the control system of the present invention.
Figure 20:
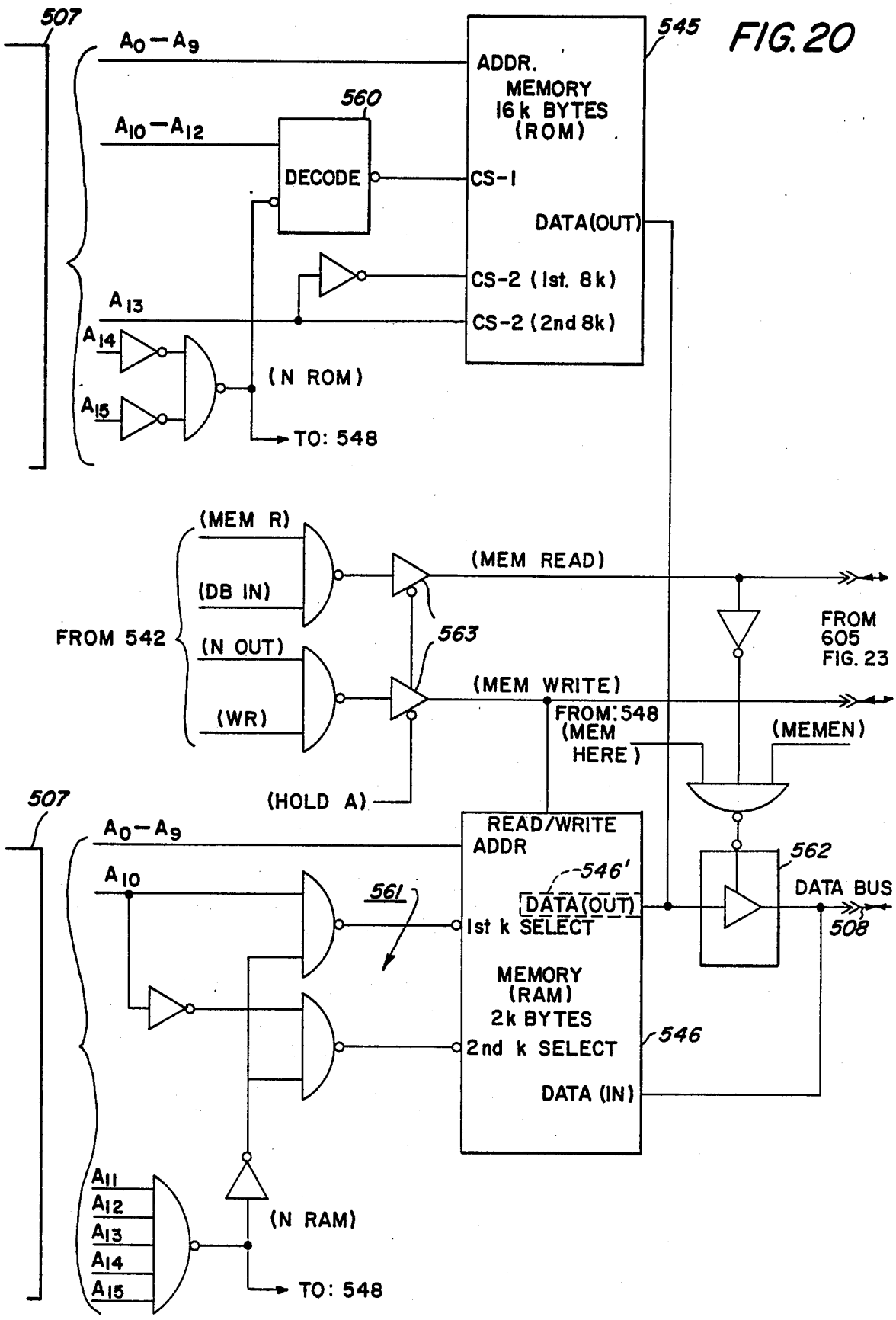
Figure 22A:
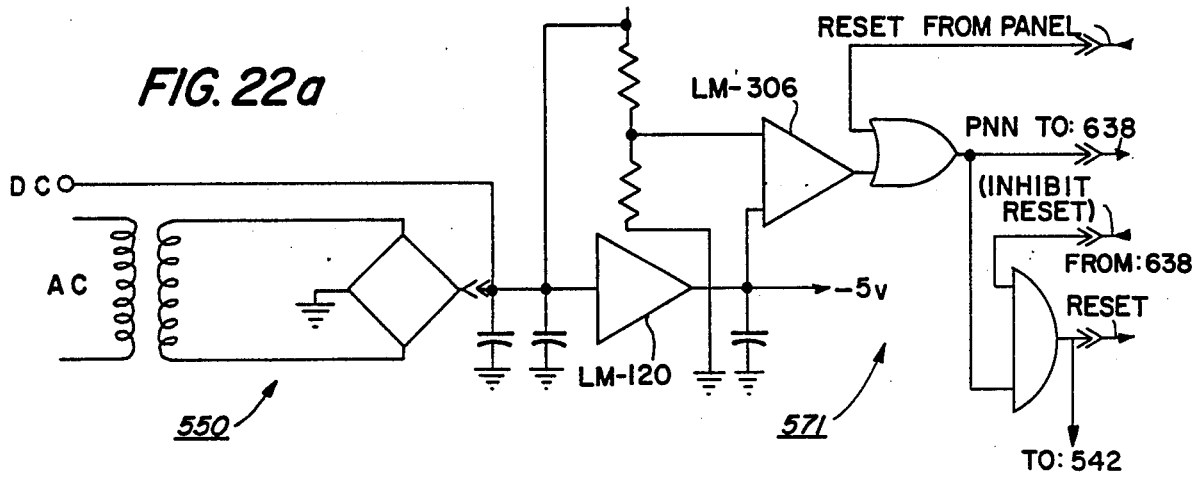
Figure 22B:
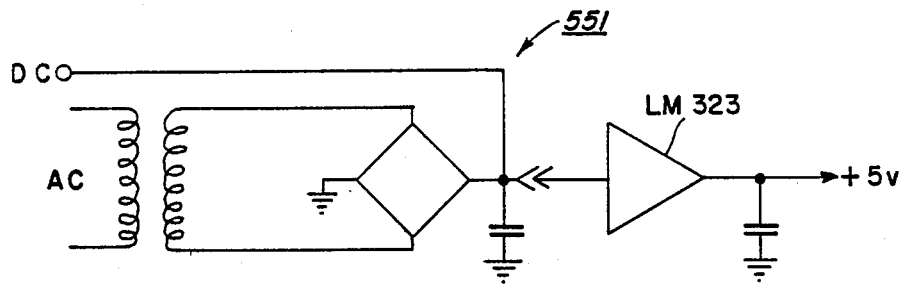
Figure 22C:
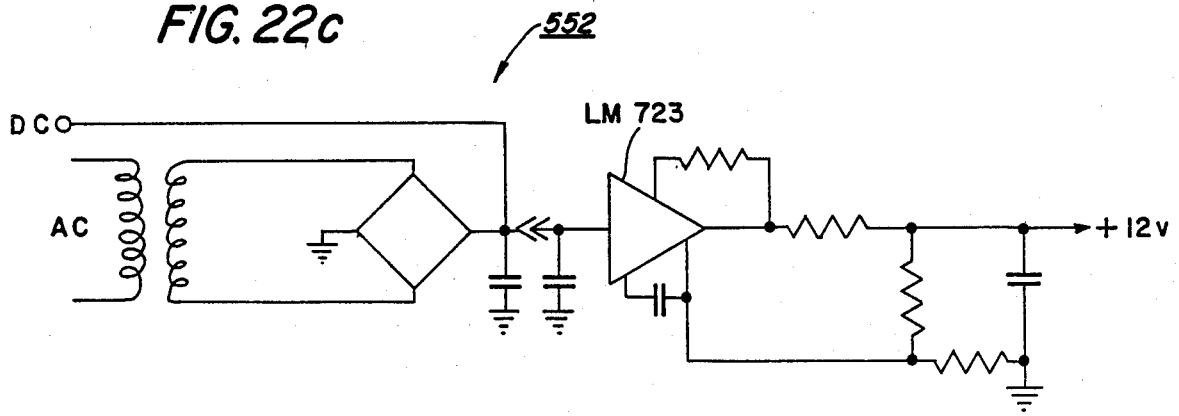
Figure 23A:
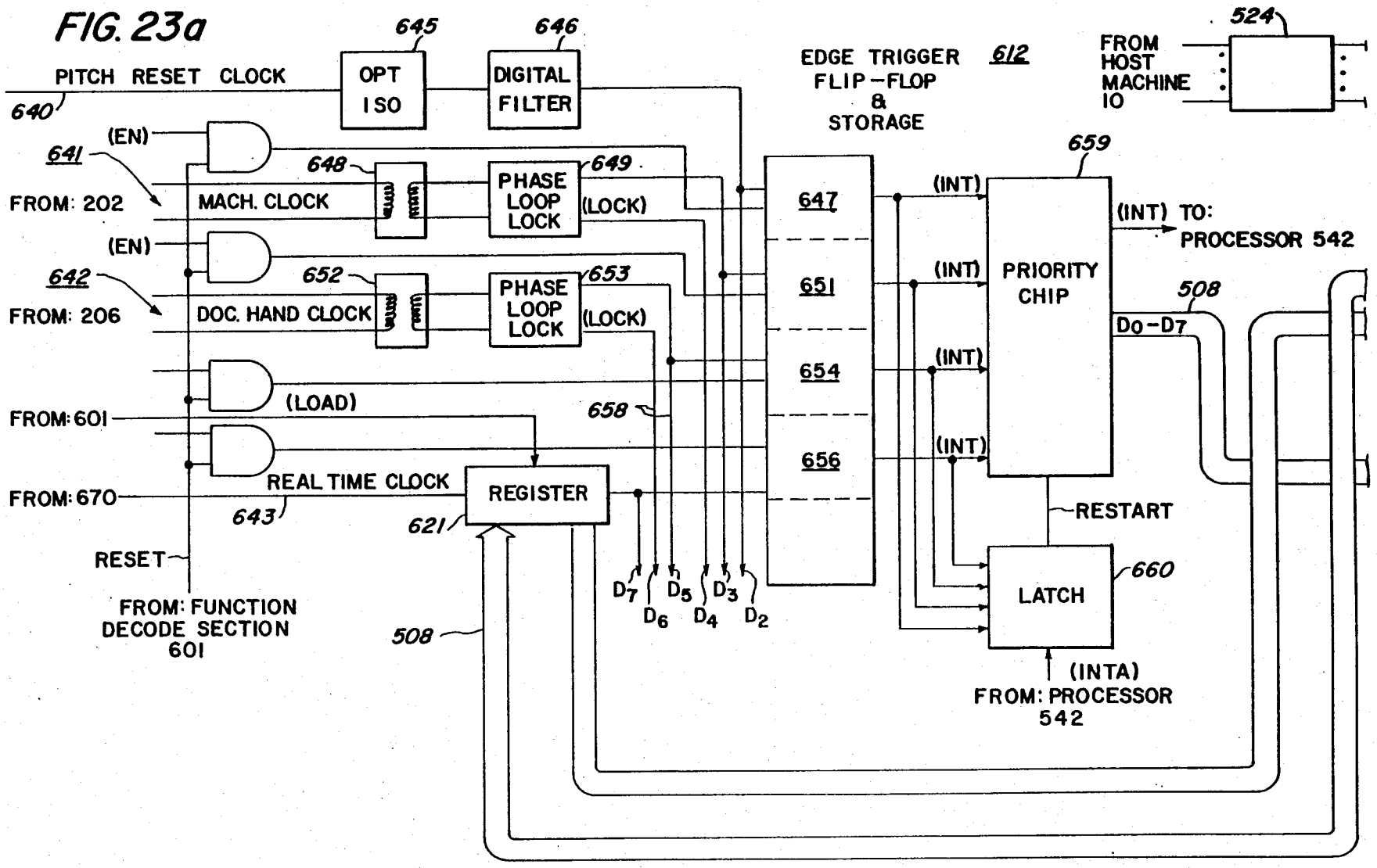
Figure 23B:
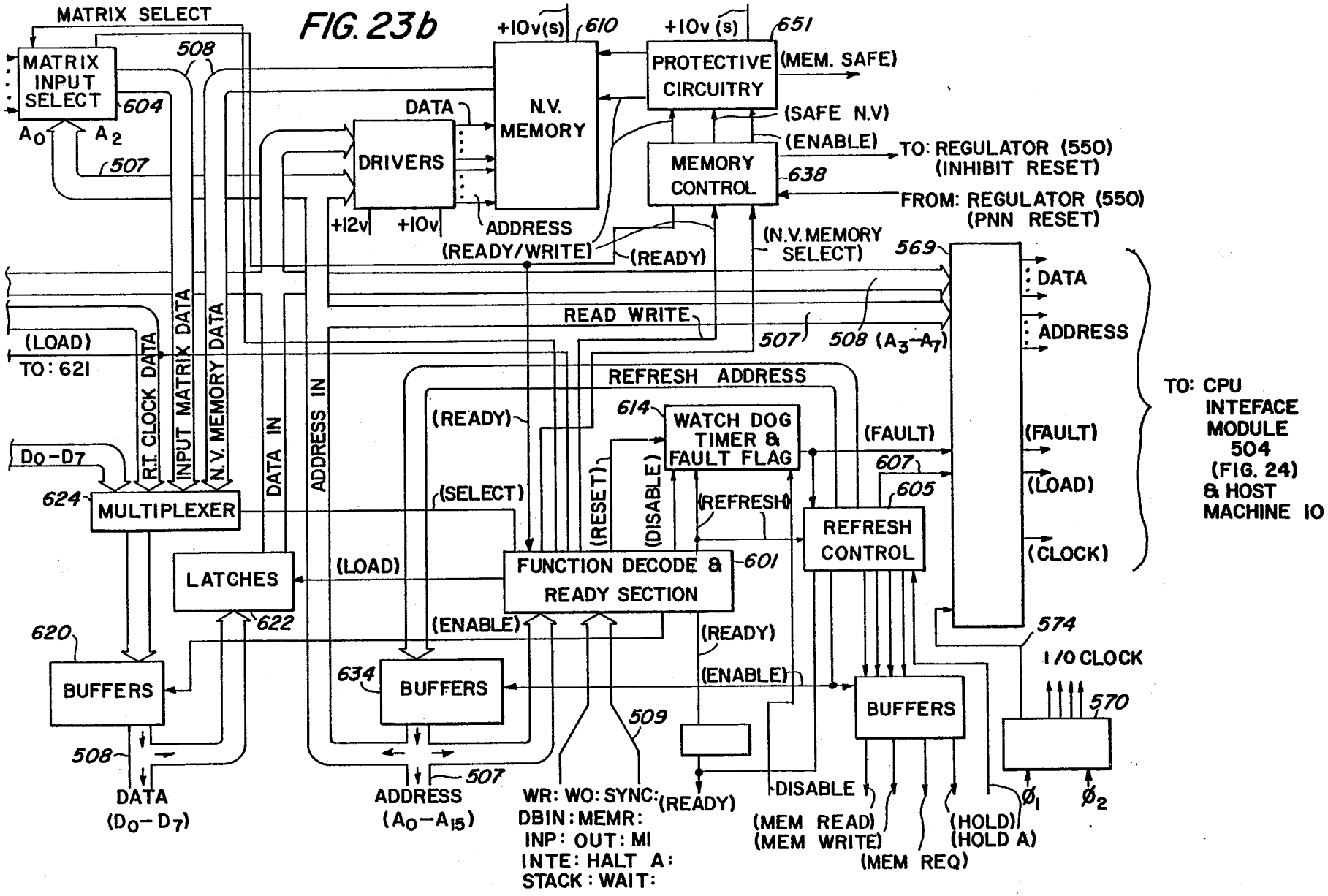
Figure 25:
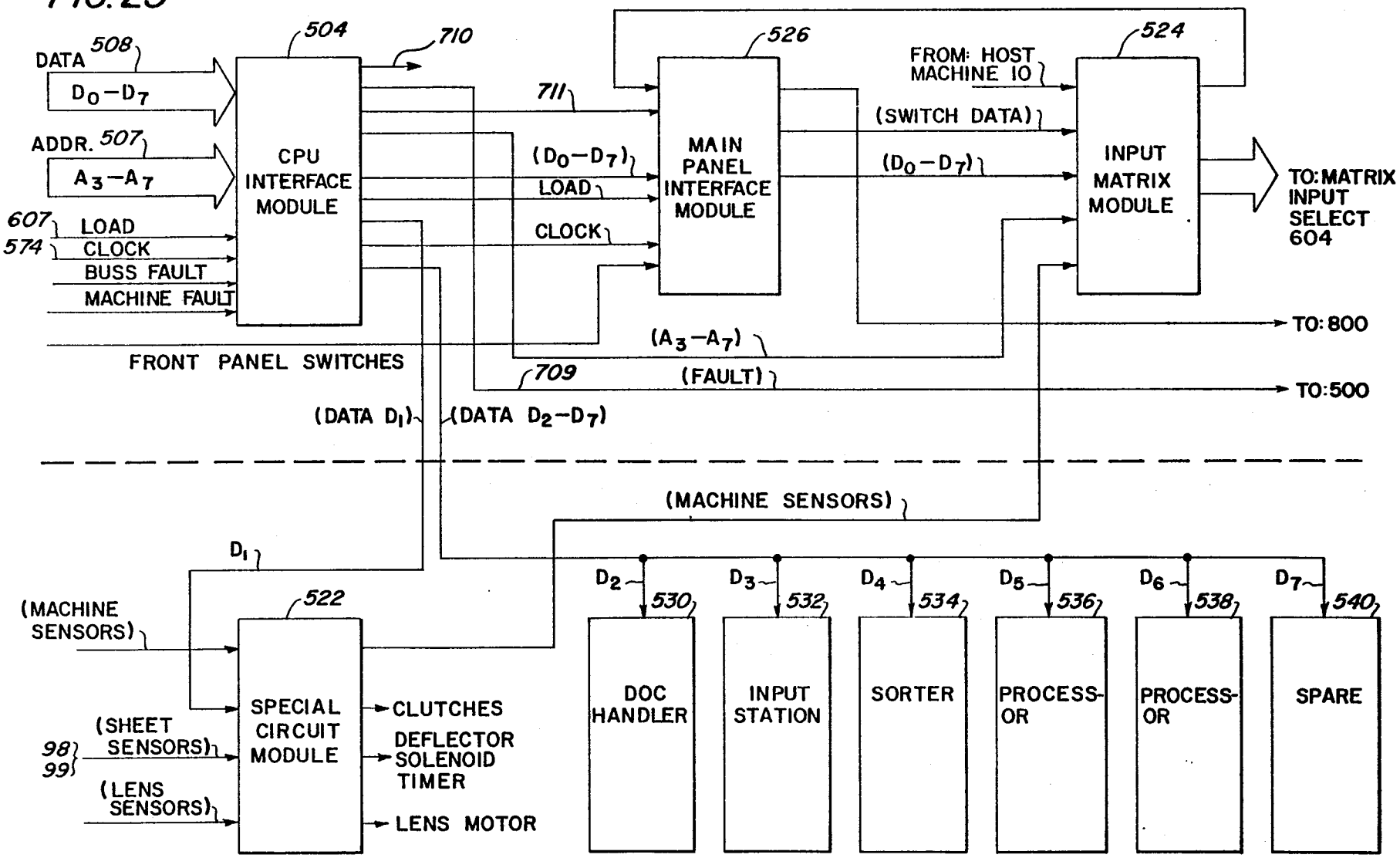
Figure 26:
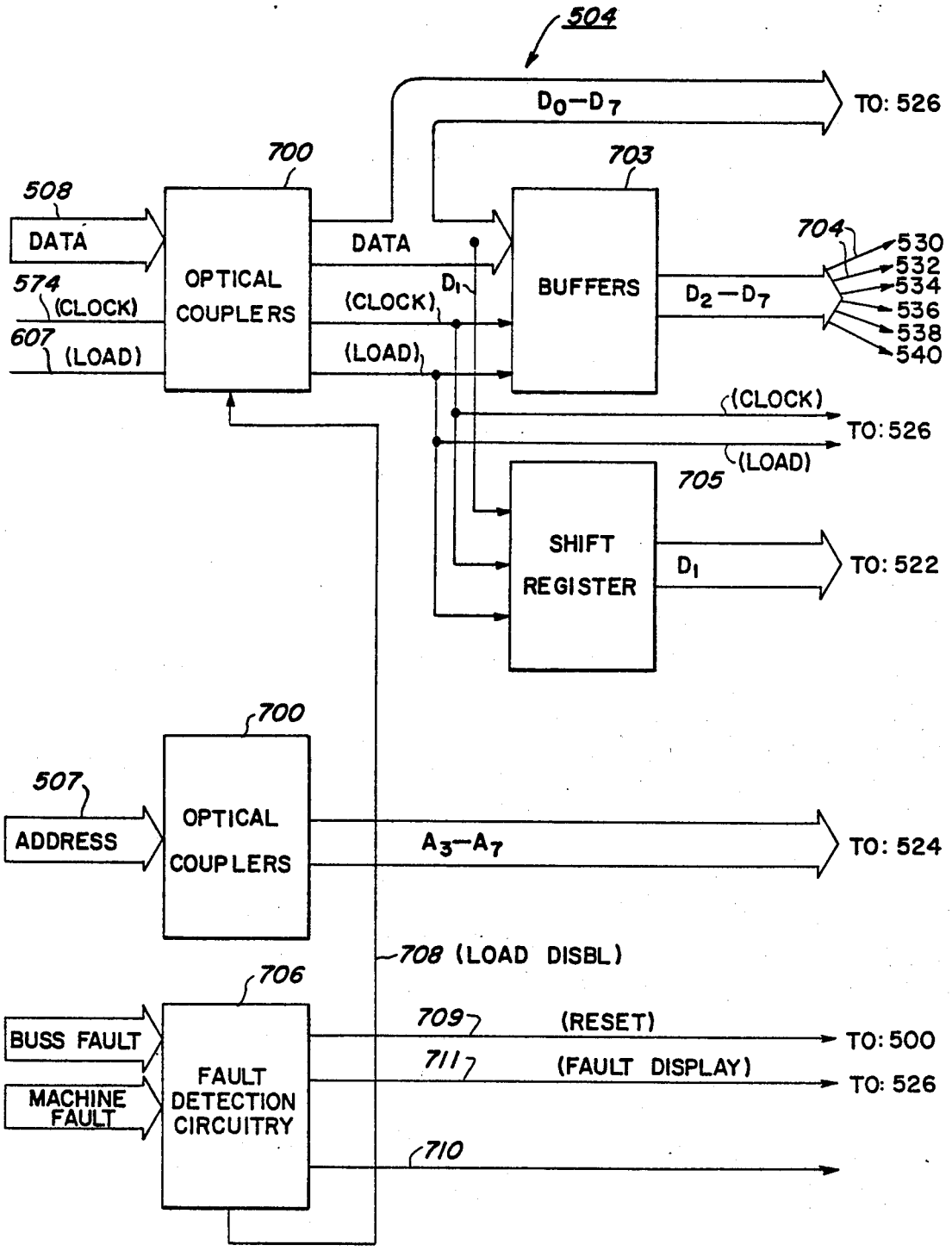
Figure 27:
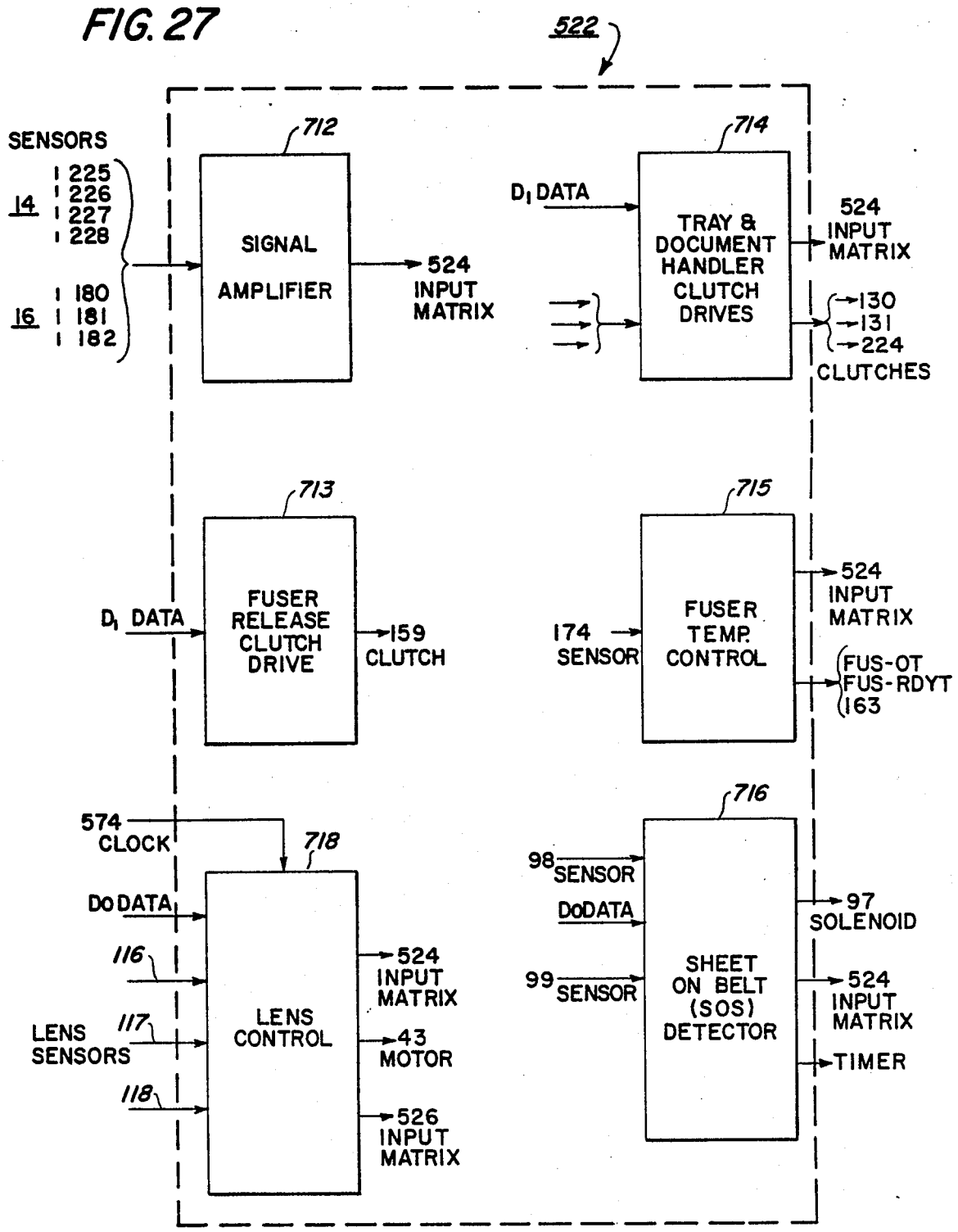
Figure 28:
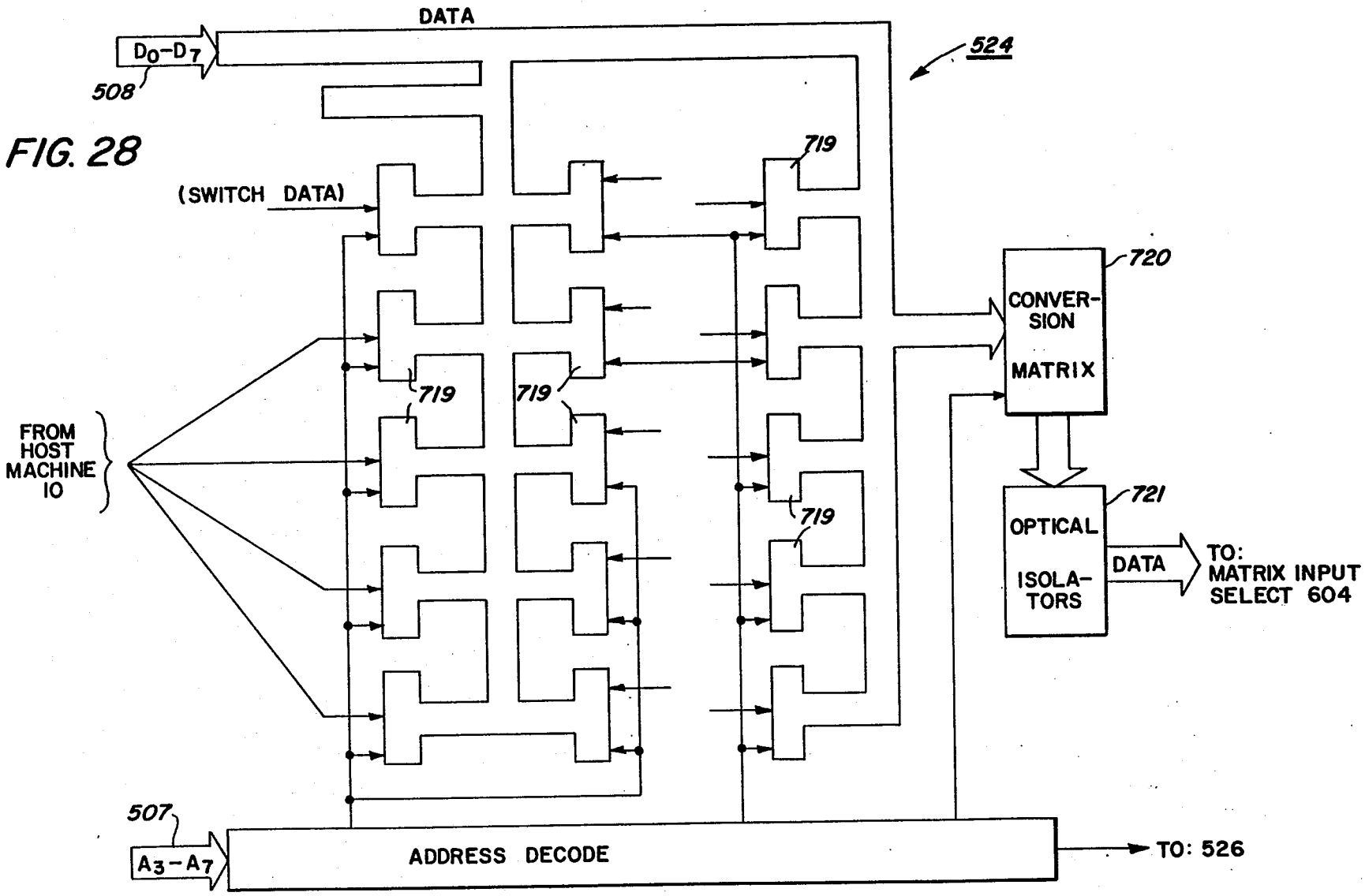
Figure 29:
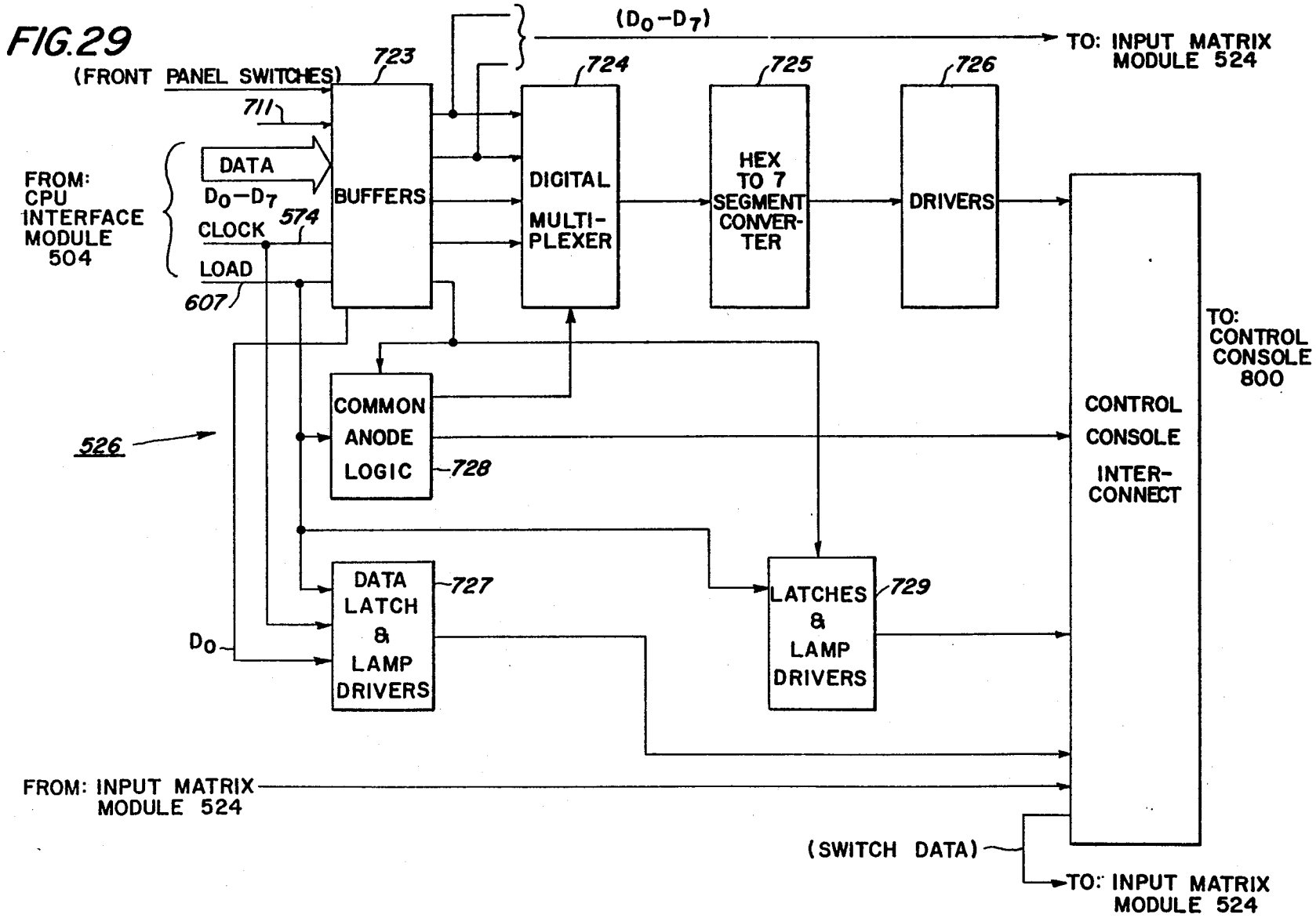
Figure 30:
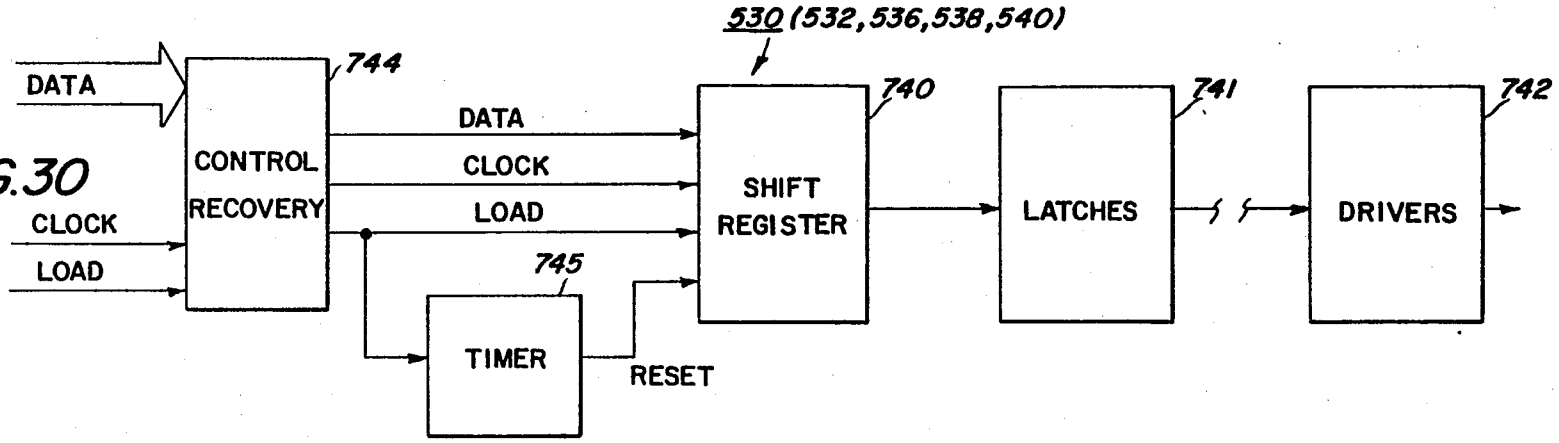
Figure 31:
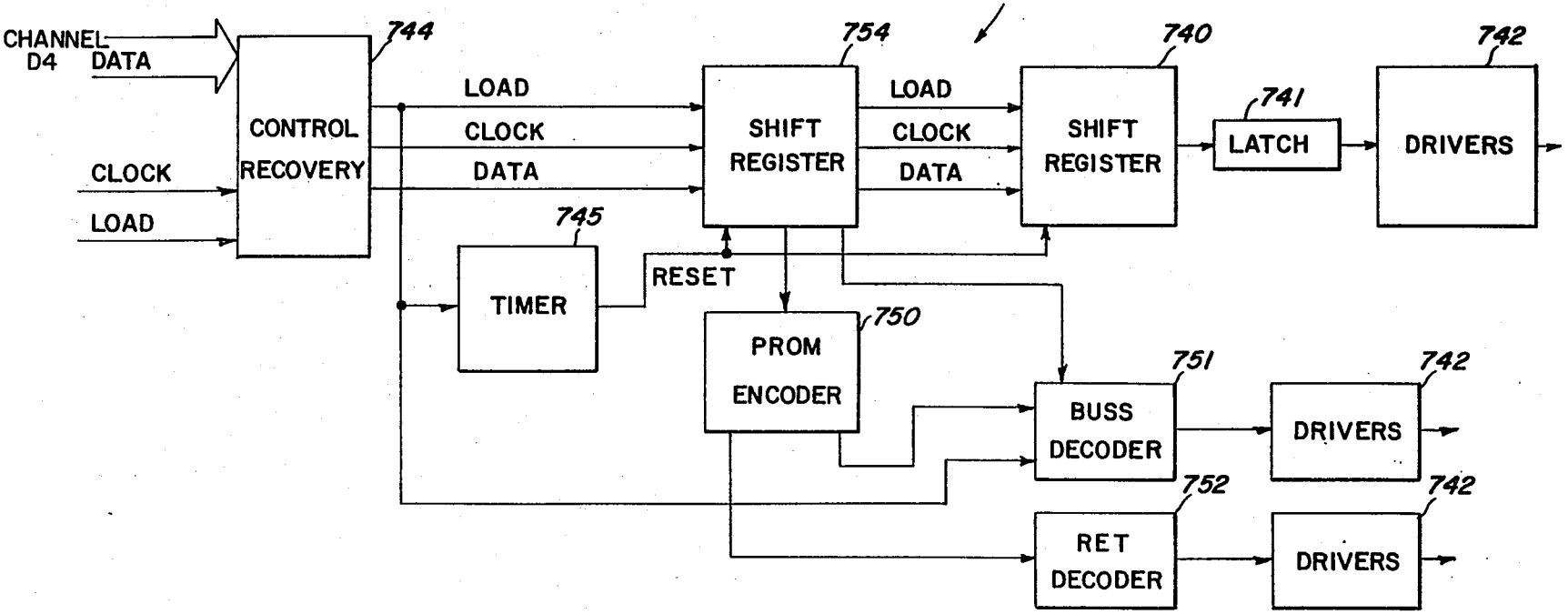
Figure 32:
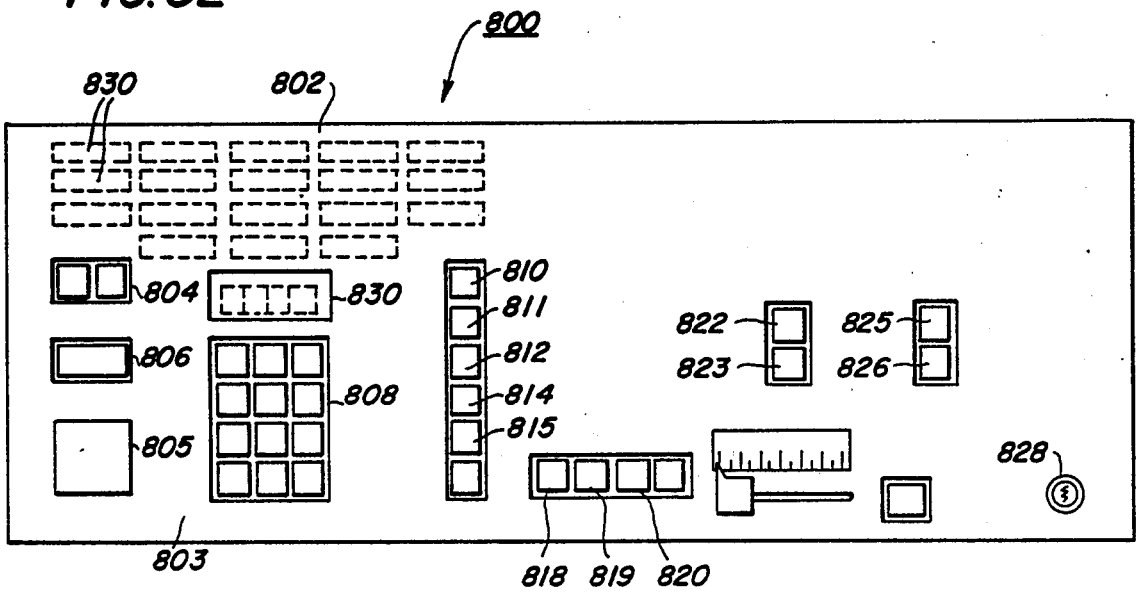
Figure 33:
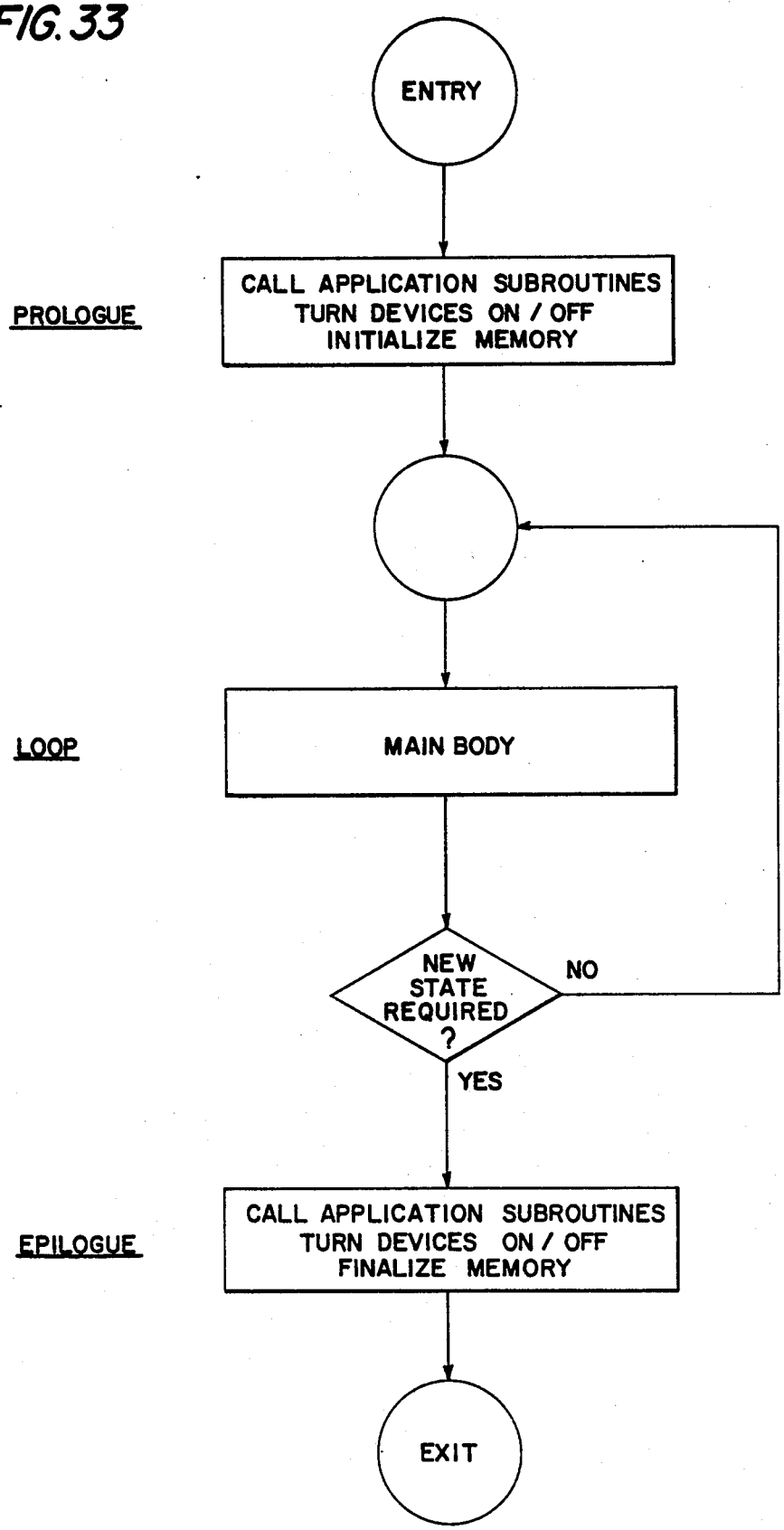
Figure 34A:
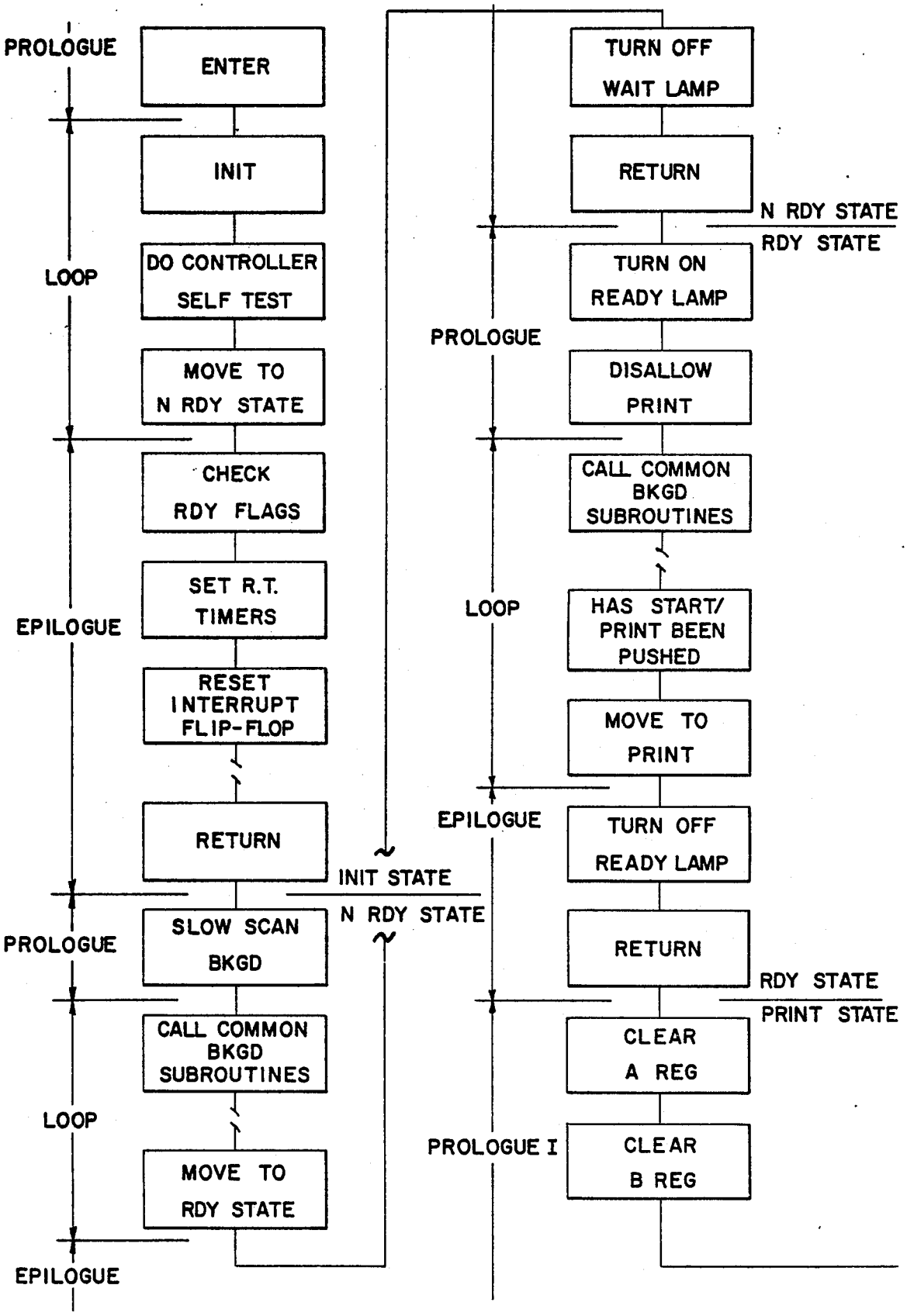
Figure 34B:
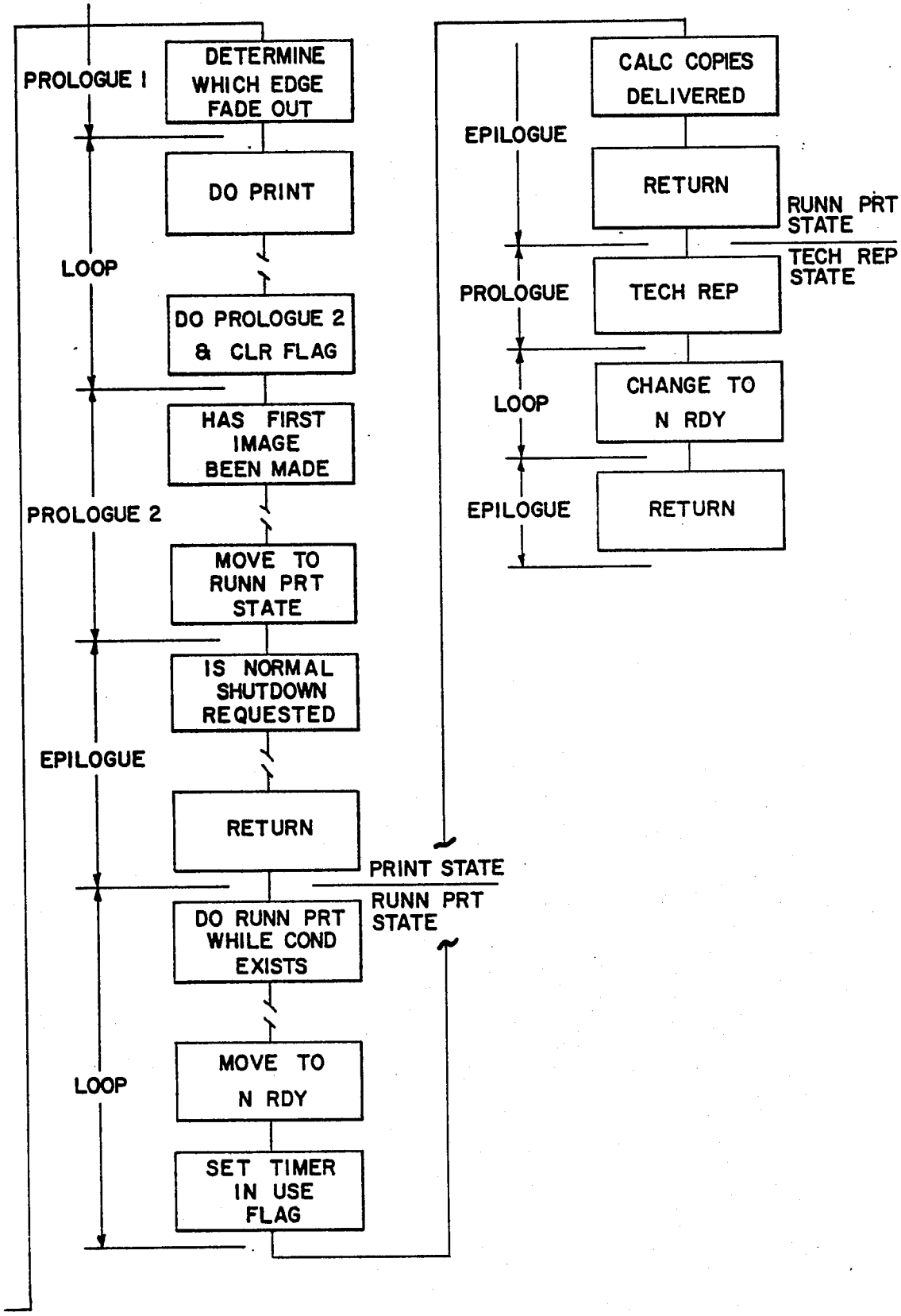
Figure 35:
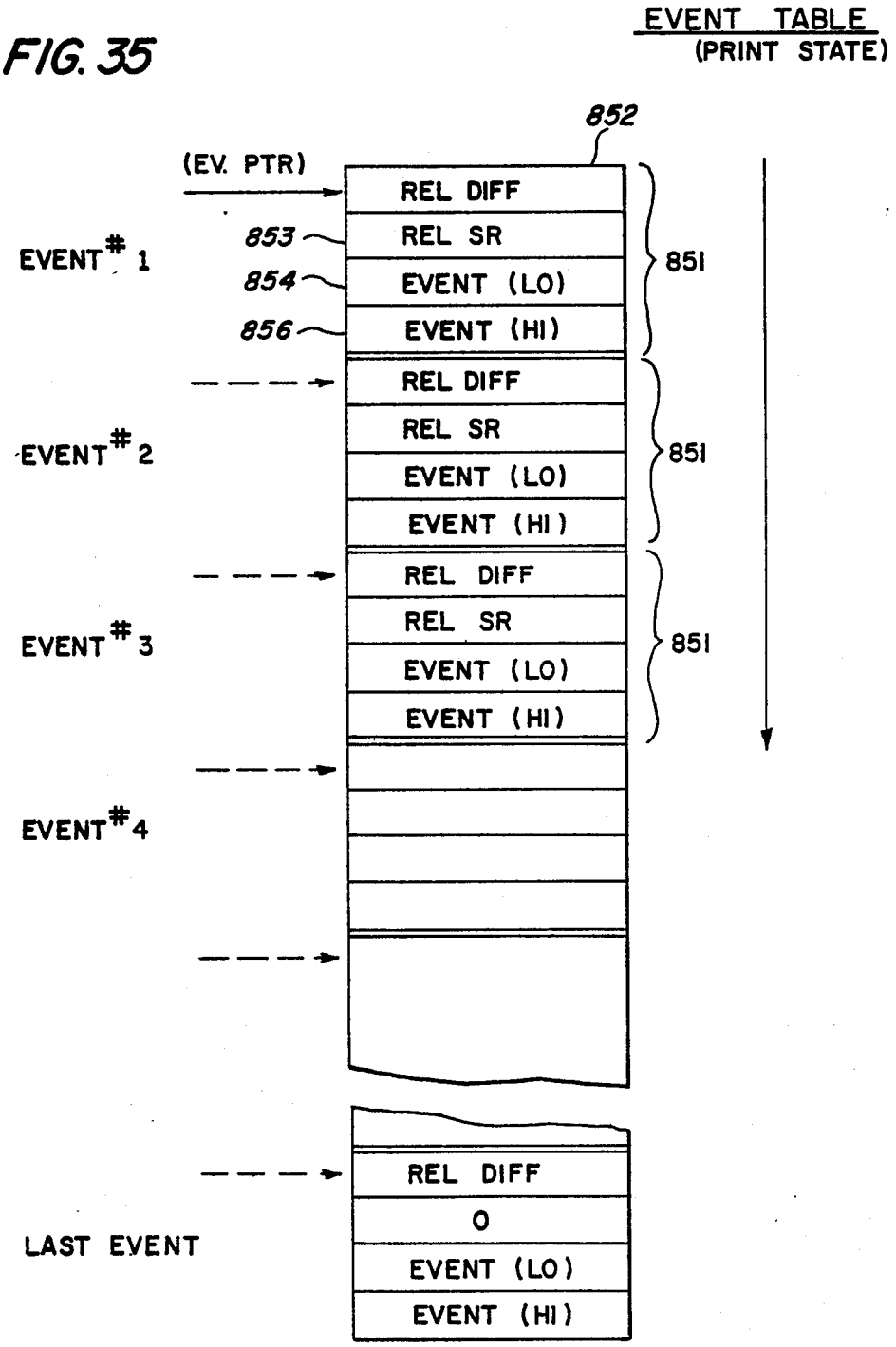
Figure 36:
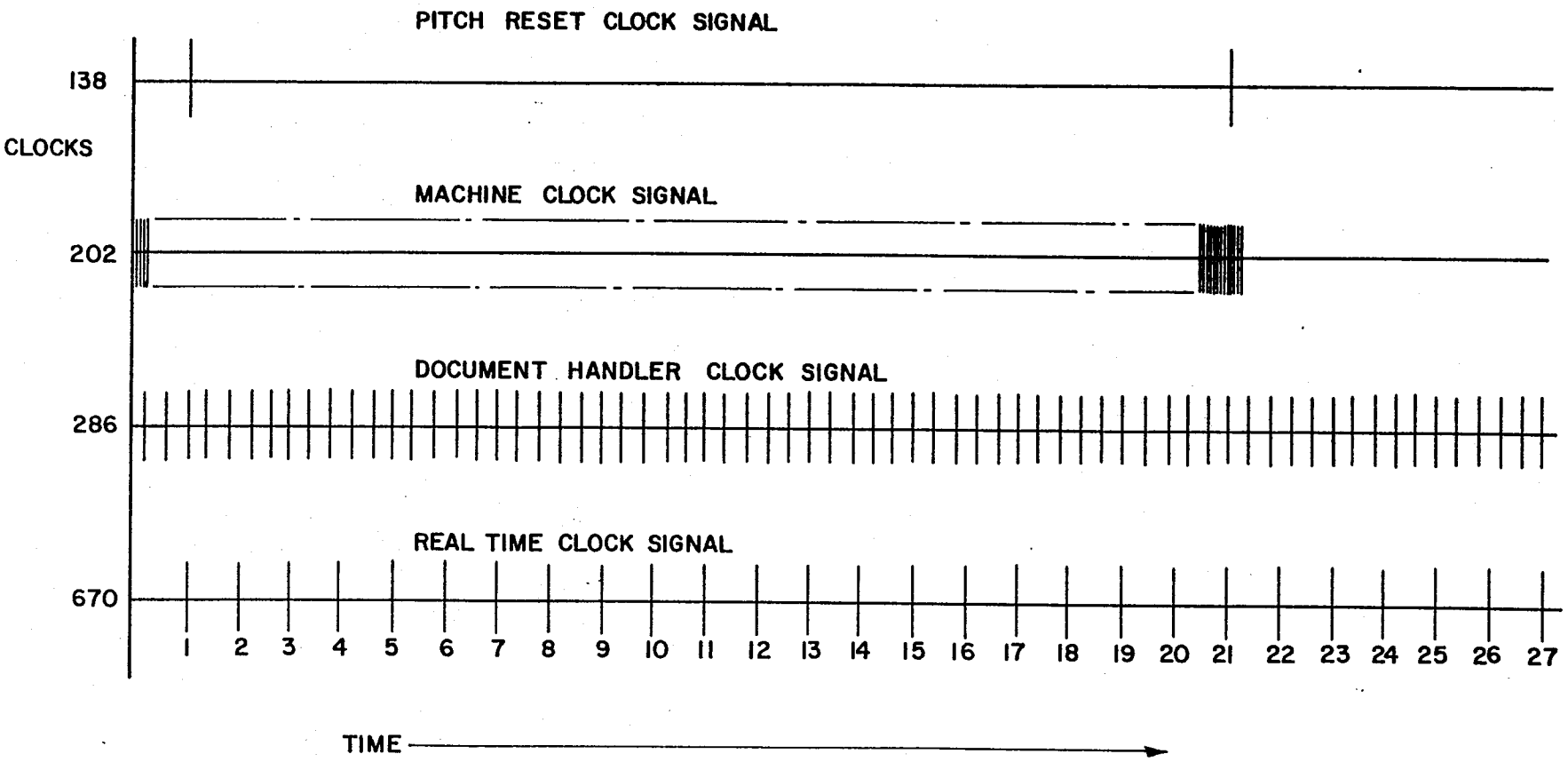
Figure 37:
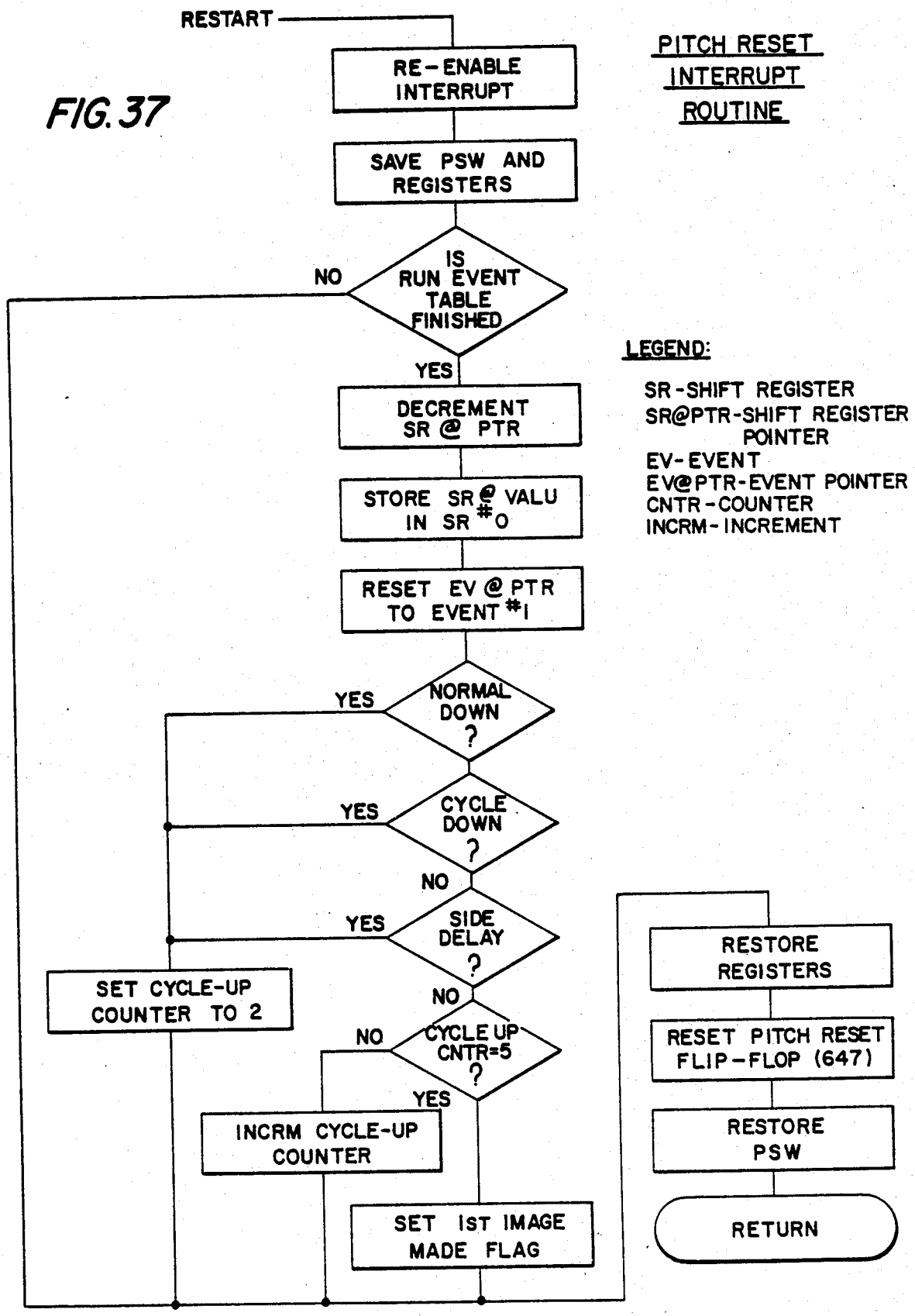
Figure 38:
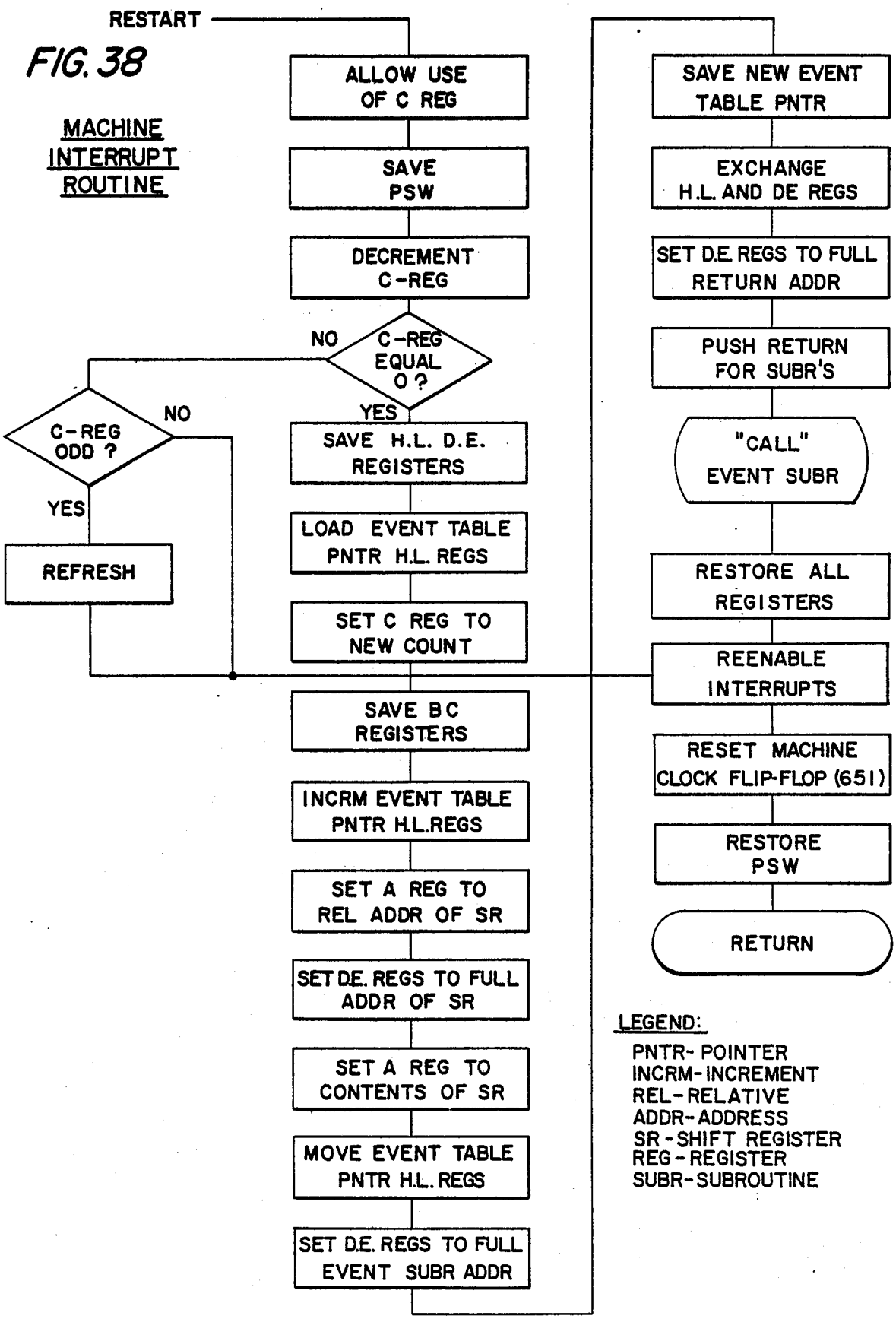
Figure 39:
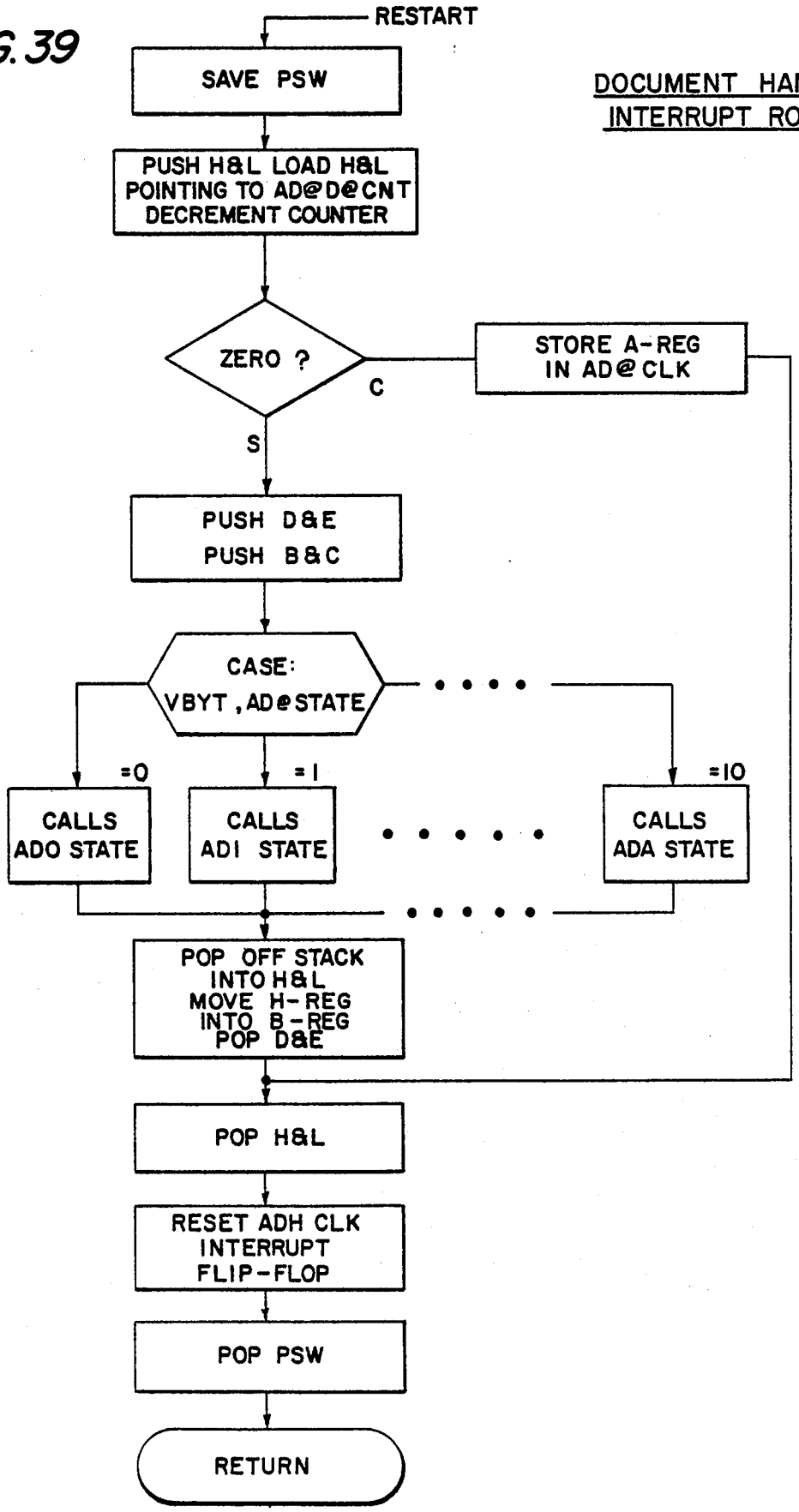
Figure 40A:
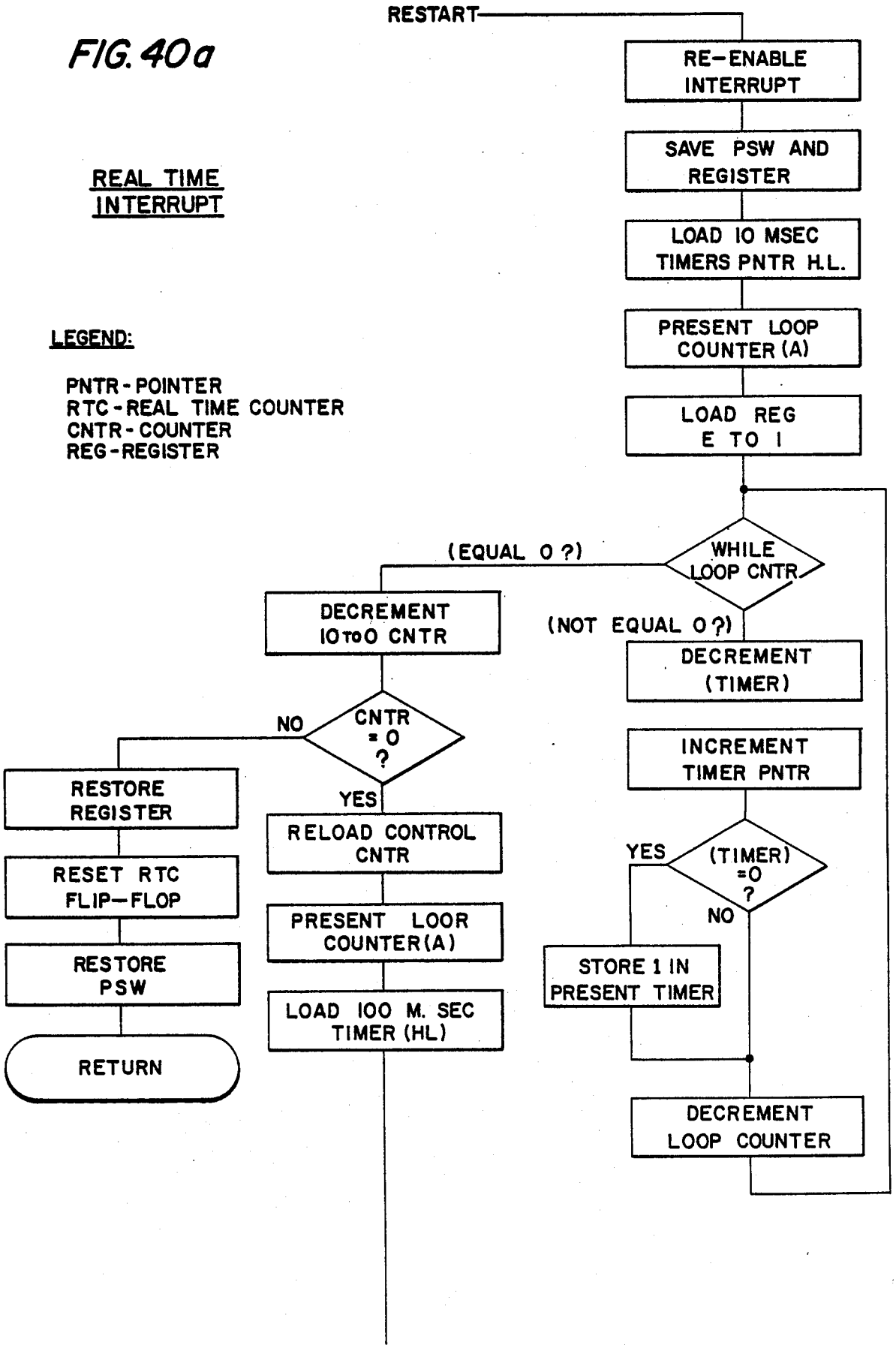
Figure 40B:
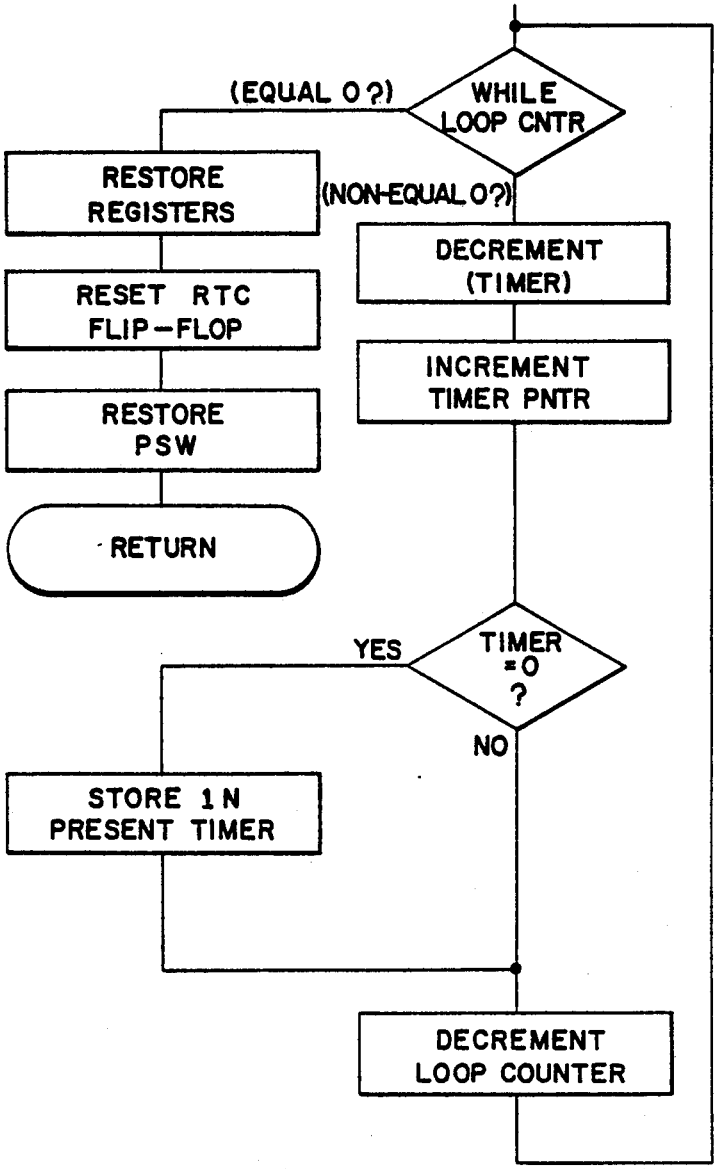
Figure 41A:
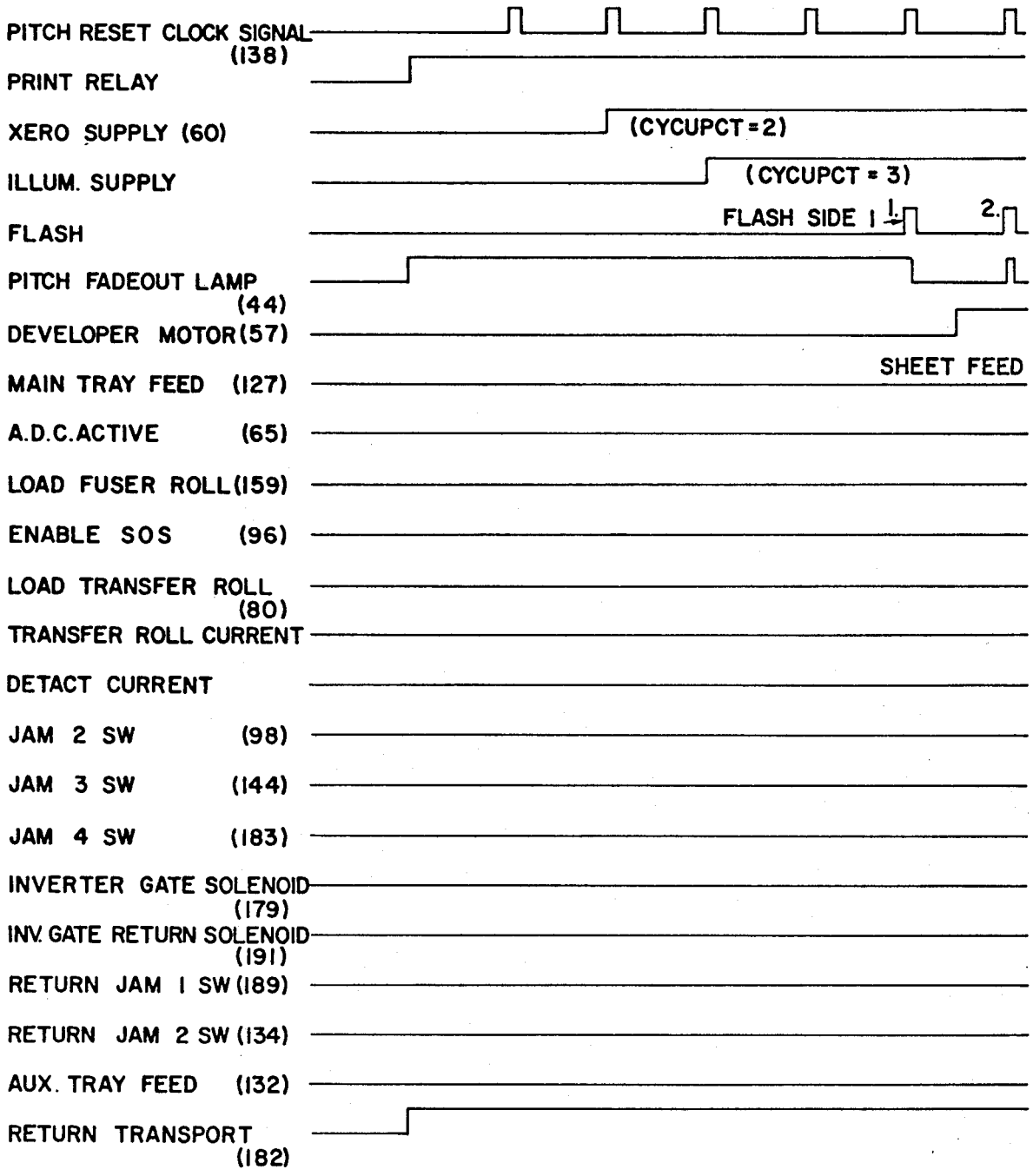
Figure 41B:
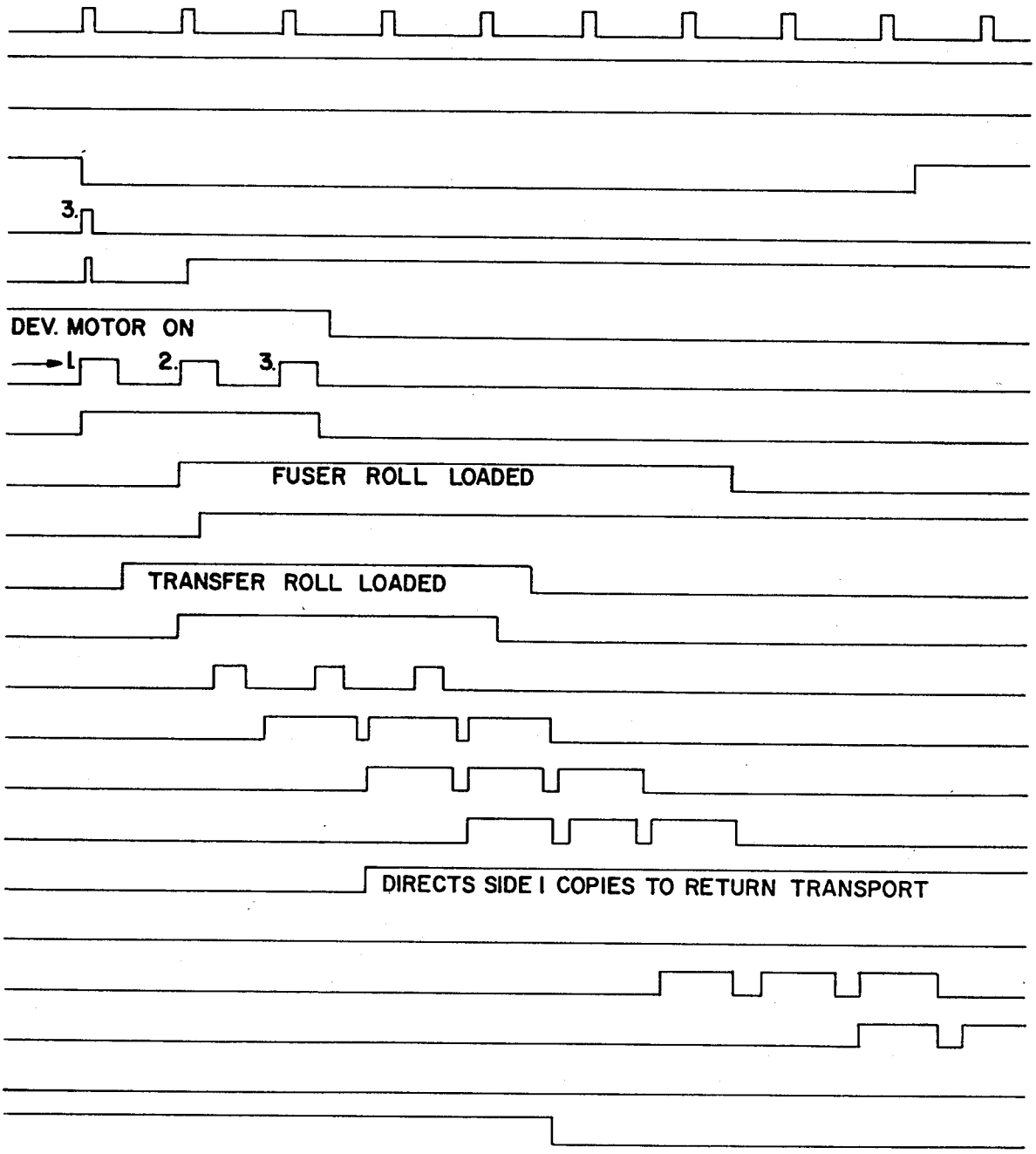
Figure 41C:
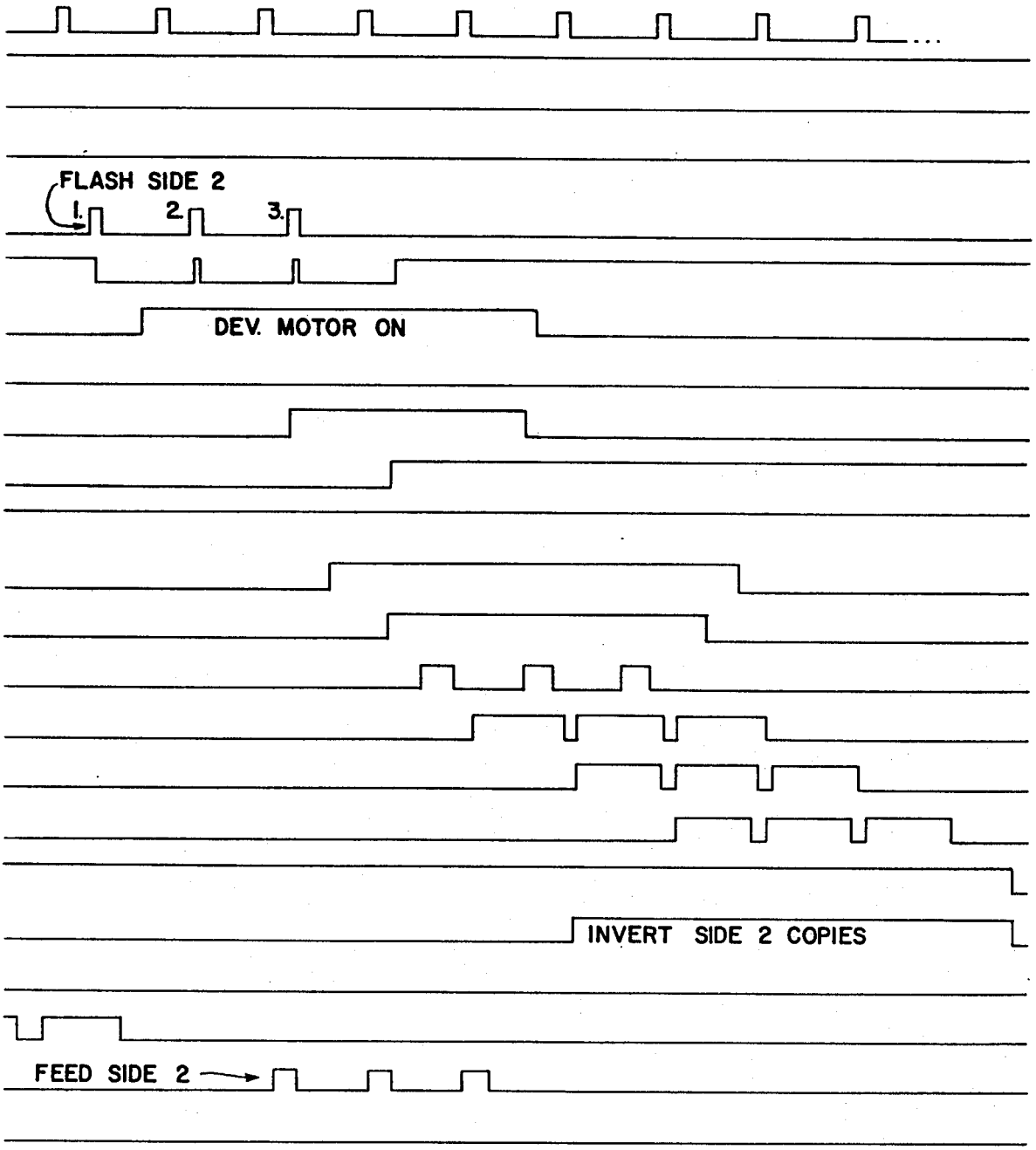

FIG. 20 is a logic schematic of the CPU memory;

FIG. 21 is a logic schematic of the CPU memory ready;

FIGS. 22*a*, 22*b*, 22*c* are logic schematics of the CPU power supply stages;

FIGS. 23*a* and 23*b* comprise a block diagram of the controller I/O module;

FIG. 24 is a logic schematic of the nonvolatile memory power supply;

FIG. 25 is a block diagram of the apparatus interface and remote output connections;

FIG. 26 is a block diagram of the CPU interface module;

FIG. 27 is a block diagram of the apparatus special circuits module;

FIG. 28 is a block diagram of the main panel interface module;

FIG. 29 is a block diagram of the input matrix module;

FIG. 30 is a block diagram of a typical remote;

FIG. 31 is a block diagram of the sorter remote;

FIG. 32 is a view of the control console for inputting copy run instructions to the apparatus shown in FIG. 1;

FIG. 33 is a flow chart illustrating a typical machine state;

FIGS. 34*a* and 34*b* are a flow chart of the machine state routine;

FIG. 35 is a view showing the event table layout;

FIG. 36 is a chart illustrating the relative timing sequences of the clock interrupt pulses;

FIG. 37 is a flow chart of the pitch interrupt routine;

FIG. 38 is a flow chart of the machine clock interrupt routine;

FIG. 39 is a flow chart of the document handler interrupt routine;

FIGS. 40*a* and 40*b* comprise a flow chart of the real time interrupt routines and FIGS. 41*a*, 41*b* and 41*c* are a timing chart of the principal operating components of the host machine in an exemplary copy run.

Figure 2:
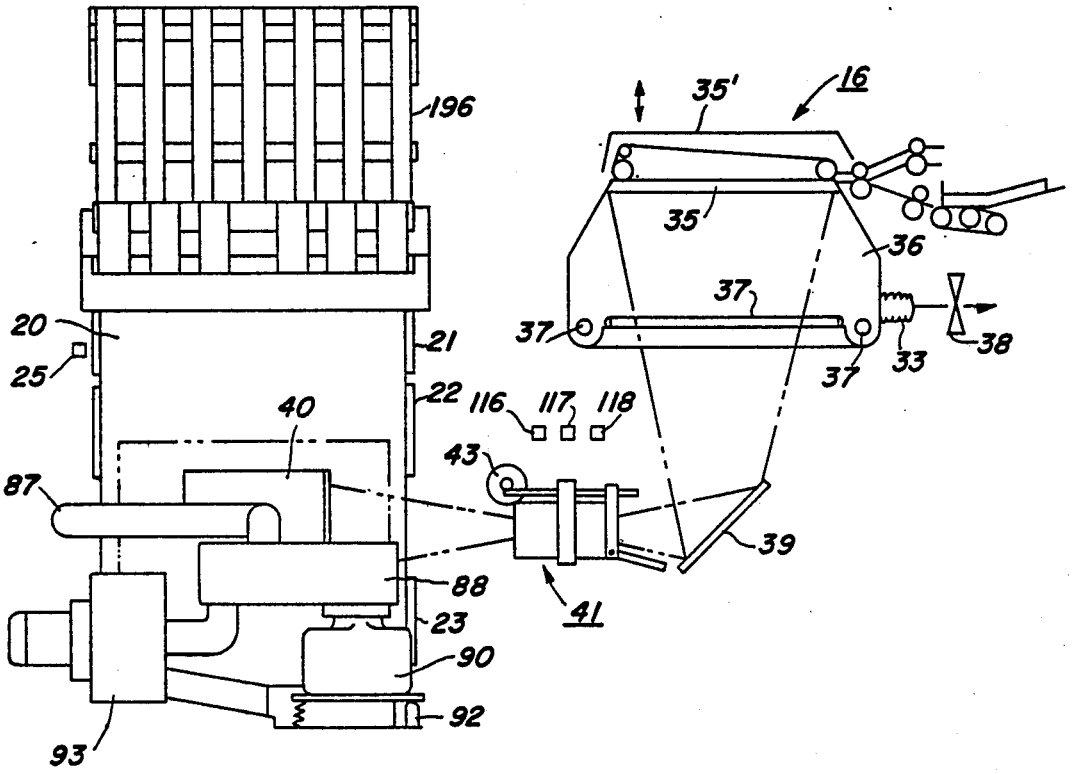
FIG. 2 is a vertical sectional view of the apparatus shown in FIG. 1 along the image plane.
Figure 3:
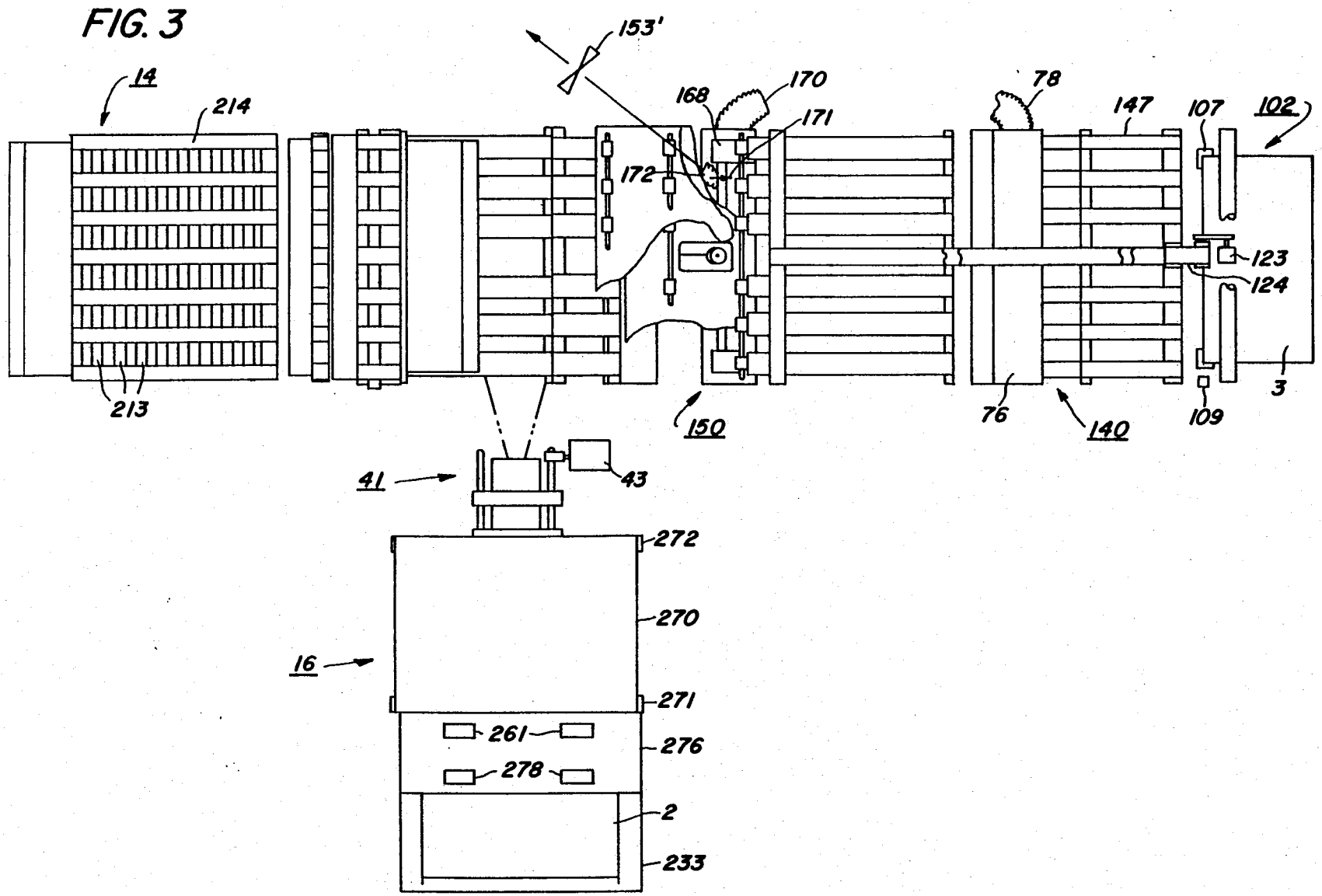
FIG. 3 is a top plane view of the apparatus shown in FIG. 1.

Referring particularly to FIGS. 1–3 of the drawings, there is shown, in schematic outline, an electrostatic reproduction system or host machine, identified by numeral 10, incorporating the control arrangement of the present invention. To facilitate description, the reproduction system 10 is divided into a main electrostatic xerographic processor 12, sorter 14, document handler 16, and controller 18. Other processor, sorter and/or document handler types and constructions, and different combustions thereof may instead be envisioned.

PROCESSOR

Processor 12 utilizes a photoreceptor in the form of an endless photoconductive belt 20 supported in generally triangular configuration by rolls 21, 22, 23. Belt supporting rolls 21, 22, 23 are in turn rotatably journaled on subframe 24.

In the exemplary processor illustrated, belt 20 comprises a photoconductive layer of selenium, which is the light receiving surface and imaging medium, on a conductive substrate. Other photoreceptor types and forms, such as comprising organic materials or of multilayers or a drum may instead be envisioned. Still other forms may comprise scroll type arrangements wherein webs of photoconductive material may be played in and out of the interior of supporting cylinders.

Figure 4:
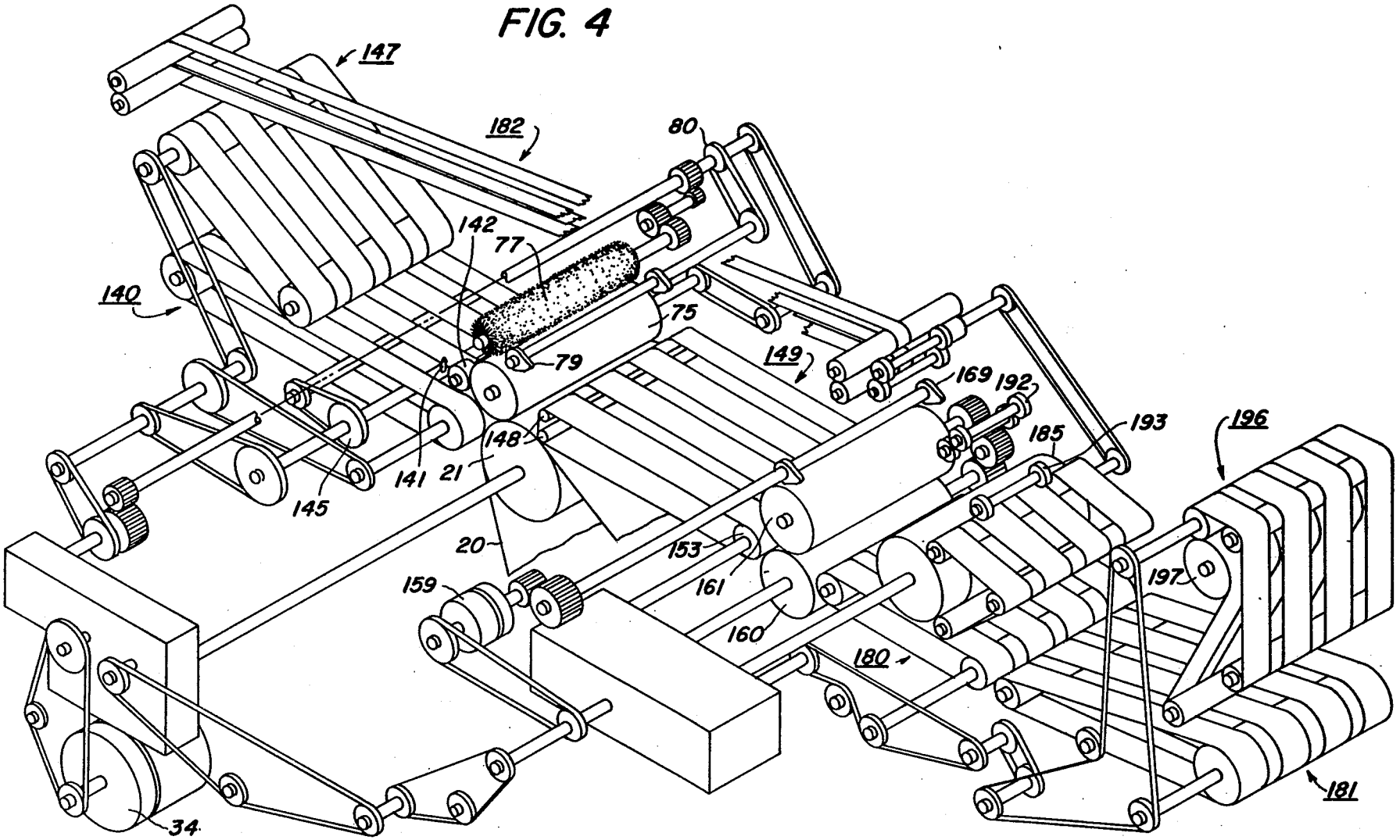
FIG. 4 is an isometric view showing the drive train for the apparatus shown in FIG. 1.

Suitable biasing means (not shown) are provided on subframe 24 to tension the photoreceptor belt 20 and insure movement of belt 20 along a prescribed operating path. Belt tracking switch 25 (shown in FIG. 2) monitors movement of belt 20 from side to side. Belt 20 is supported so as to provide a trio of substantially flat belt runs opposite exposure, developing, and cleaning stations 27, 28, 29 respectfully. To enhance belt flatness at these stations, vacuum platens 30 are provided under belt 20 at each belt run. Conduits 31 communicate vacuum platens 30 with a vacuum pump 32. Photoconductive belt 20 moves in the direction indicated by the solid line arrow, drive thereto being effected through roll 21, which in turn is driven by main drive motor 34, as seen in FIG. 4.

Processor 12 includes a generally rectangular, horizontal transparent platen 35 on which each original 2 to be copied is disposed. A two or four sided illumination assembly, consisting of internal reflectors 36 and flash lamps 37 (shown in FIG. 2) disposed below and along at least two sides of platen 35, is provided for illuminating the original 2 on platen 35. To control temperatures within the illumination space, the assembly is coupled through conduit 33 with a vacuum pump 38 which is adapted to withdraw overly heated air from the space. To retain the original 2 in place on platen 35 and prevent escape of extraneous light from the illumination assembly, a platen cover may be provided.

The light image generated by the illumination system is projected via mirrors 39, 40 and a variable magnification lens assembly 41 onto the photoreceptive belt 20 at the exposure station 27. Reversible motor 43 is provided to move the main lens and add on lens elements that comprise the lens assembly 41 to different predetermined positions and combinations to provide the preselected image sizes corresponding to push button selectors 818, 819, 820 or operator module 800. (See FIG. 32) Sensors 116, 117, 118 signal the present disposition of lens assembly 41. Exposure of the previously charged belt 20 selectively discharges the photoconductive belt to produce on belt 20 an electrostatic latent image of the original 2. To prepare belt 20 for imaging, belt 20 is uniformly charged to a preselected level by charge corotron 42 upstream of the exposure station 27.

Figure 5:
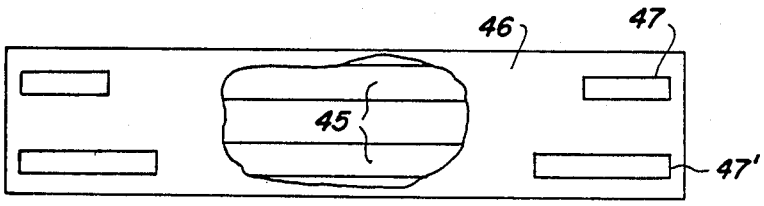
FIG. 5 is an enlarged view showing details of the photoreceptor edge fade-out mechanism for the apparatus shown in FIG. 1.

To prevent development of charged but unwanted image areas, erase lamps 44, 45 are provided. Lamp 44, which is referred to herein as the pitch fadeout lamp, is supported in transverse relationship to belt 20, lamp 44 extending across substantially the entire width of belt 20 to erase (i.e. discharge) areas of belt 20 before the first image, between successive images, and after the last image. Lamps 45, which are referred to herein as edge fadeout lamps, serve to erase areas bordering each side of the images. Referring particularly to FIG. 5, edge fadeout lamps 45, which extend transversely to belt 20, are disposed within a housing 46 having a pair of transversely extending openings 47, 47' of differing length adjacent each edge of belt 20. By selectively actuating one or the other of the lamps 45, the width of the area bordering the sides of the image that is erased can be controlled.

Figure 6:
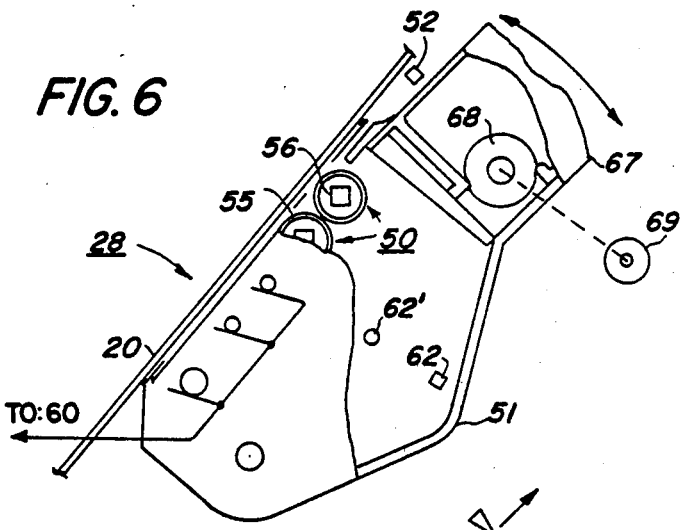
FIG. 6 is an enlarged view showing details of the developing mechanism for the apparatus shown in FIG. 1.
Figure 7:
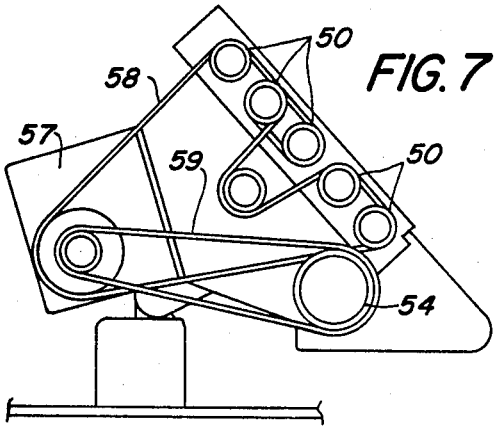
FIG. 7 is an enlarged view showing details of the developing mechanism drive.

Referring to FIGS. 1, 6 and 7, magnetic brush rolls 50 are provided in a developer housing 51 at developing station 28. Housing 51 is pivotally supported adjacent the lower end thereof with interlock switch 52 to sense disposition of housing 51 in operative position adjacent belt 20. The bottom of housing 51 forms a sump within which a supply of developing material is contained. A rotatable auger 54 in the sump area serves to mix the developing material and bring the material into operative relationship with the lowermost of the magnetic brush rolls 50.

As will be understood by those skilled in the art, the electrostatically attractable developing material commonly used in magnetic brush developing apparatus of the type shown comprises a pigmented resinous powder, referred to as toner, and larger granular beads referred to as carrier. To provide the necessary magnetic properties, the carrier is comprised of a magnetizable material such as steel. By virtue of the magnetic fields established by developing rolls 50 and the interrelationship therebetween, a blanket of developing material is formed along the surfaces of developing rolls 50 adjacent the belt 20 and extending from one roll to another. Toner is attracted to the electrostatic latent image from the carrier bristles to produce a visible powder image on the surface of belt 20.

Magnetic brush rolls 50 each comprise a rotatable exterior sleeve 55 with relatively stationary magnet 56 inside. Sleeves 55 are rotated in unison and at substantially the same speed as belt 20 by a developer drive motor 57 through a belt and pulley arrangement 58. A second belt and pulley arrangement 59 drives auger 54.

To regulate development of the latent electrostatic images on belt 20, magnetic brush sleeves 55 are electrically biased. A suitable power supply 60 is provided for this purpose with the amount of bias being regulated by controller 18.

Figure 8:
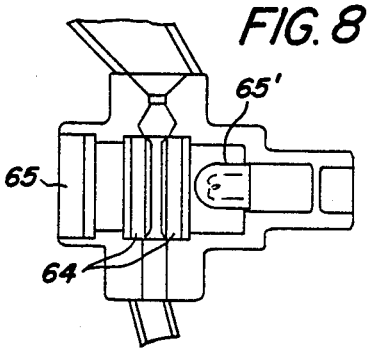
FIG. 8 is an enlarged view showing details of the developability control for the apparatus shown in FIG. 1.
Figure 11:
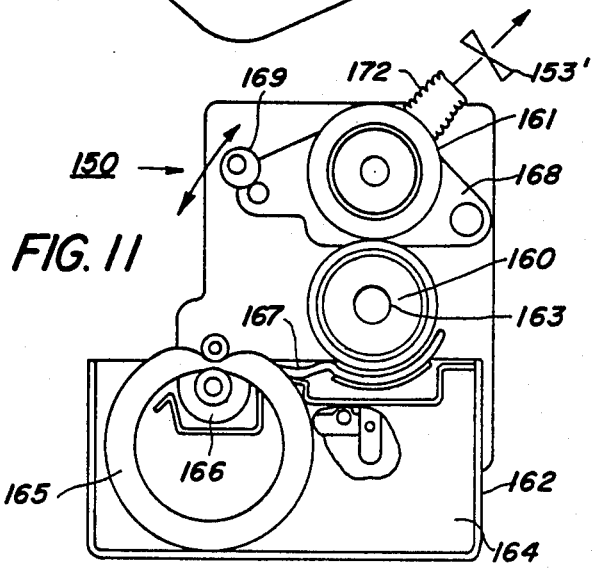
FIG. 11 is an enlarged view showing details of the fuser for the apparatus shown in FIG. 1.

Developing material is returned to the upper portion of developer housing 51 for reuse and is accomplished by utilizing a photocell 62 which monitors the level of developing material in housing 51 and a photocell lamp 62' spaced opposite to the photocell 62 in cooperative relationship therewith. The disclosed machine is also provided with automatic developability control which maintains an optimum proportion of toner-to-carrier material by sensing toner concentration and replenishing toner, as needed. As shown in FIG. 8, the automatic developability control comprises a pair of transparent plates 64 mounted in spaced, parrallel arrangement in developer housing 51 such that a portion of the returning developing material passes therebetween. A suitable circuit, not shown, alternately places a charge on the plate 64 to attract toner thereto. Photocell 65 on one side of the plate pair senses the developer material as the material passes therebetween. Lamp 65' on the opposite side of plate pair 64 provides reference illumination. In this arrangement, the returning developing material is alternately attracted and repelled to and from plate 64. The accumulation of toner, i.e. density determines the amount of light transmitted from lamp 62' to photocell 62. Photocell 65 monitors the density of the returning developing material with the signal output therefrom being used by controller 18 to control the amount of fresh or make-up toner to be added to developer housing 51 from toner supply container 67.

To discharge toner from container 67, rotatable dispensing roll 68 is provided in the inlet to developer housing 51. Motor 69 drives roll 68. When fresh toner is required, as determined by the signal from photocell 65, controller 18 actuates motor 69 to turn roll 68 for a timed interval. The rotating roll 68, which is comprised of a relatively porous sponge-like material, carries toner particles thereon into developer housing 51 where it is discharged. Pre-transfer corotron 70 and lamp 71 are provided downstream of magnetic brush rolls 50 to regulate developed image charges before transfer.

A magnetic pick-off roll 72 is rotatably supported opposite belt 20 downstream of pre-transfer lamp 71, roll 72 serving to scavenge leftover carrier from belt 20 preparatory to transfer of the developed image to the copy sheet 3. Motor 73 turns roll 72 in the same direction and at substantially the same speed as belt 20 to prevent scoring or scratching of belt 20. One type of magnetic pick-off roll is shown in U.S. Pat. No. 3,834,804, issued Oct. 10, 1974 to Bhagat et al.

Figure 9:
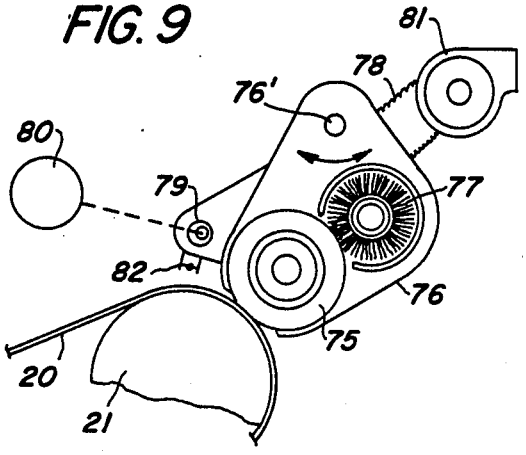
FIG. 9 is an enlarged view showing details of the transfer roll support mechanism for the apparatus shown in FIG. 1.
Figure 12:
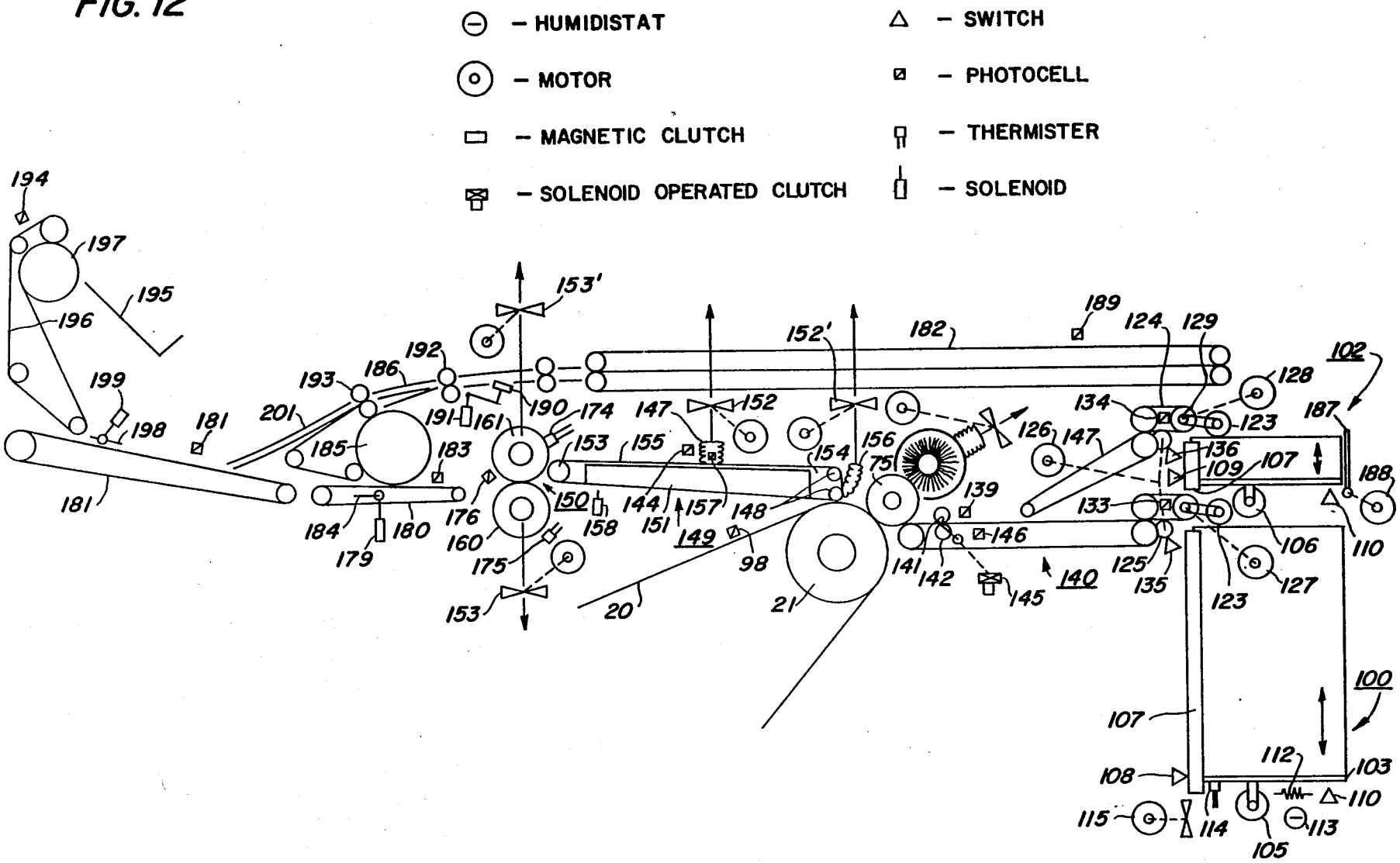
FIG. 12 is a schematic view showing the paper path and sensors of the apparatus shown in FIG. 1.

Referring to FIGS. 4, 9 and 12, to transfer developed images from belt 20 to the copy sheets 3, a transfer roll 75 is provided. Transfer roll 75, which forms part of the copy sheet feed path, is rotatably supported within a transfer roll housing opposite belt support roll 21. Housing 76 is pivotally mounted to permit the transfer roll assembly to be moved into and out of operative relationship with belt 20. A transfer roll cleaning brush 77 is rotatably journalled in transfer roll housing 76 with the brush periphery in contact with transfer roll 90. Transfer roll 75 is driven through contact with belt 20 while cleaning brush 77 is coupled to main drive motor 34. To remove toner, housing 76 is connected through conduit 78 with vacuum pump 81. To facilitate and control transfer of the developed images from belt 20 to the copy sheets 3, a suitable electrical bias is applied to transfer roll 75.

To permit transfer roll 75 to be moved into and out of operative relationship with belt 20, cam 79 is provided in driving contact with transfer roll housing 76. Cam 79 is driven from motor 34 through an electromagnetically operated one revolution clutch 80. Spring means (not shown) serves to maintain housing 76 in driving engagement with cam 79.

To facilitate separation of the copy sheets 3 from belt 20 following transfer of developed images, a detack corotron 82 is provided. Corotron 82 generates a charge designed to neutralize or reduce the charges tending to retain the copy sheet on belt 20. Corotron 82 is supported on transfer roll housing 76 opposite belt 20 and downstream of transfer roll 75.

Figure 10:
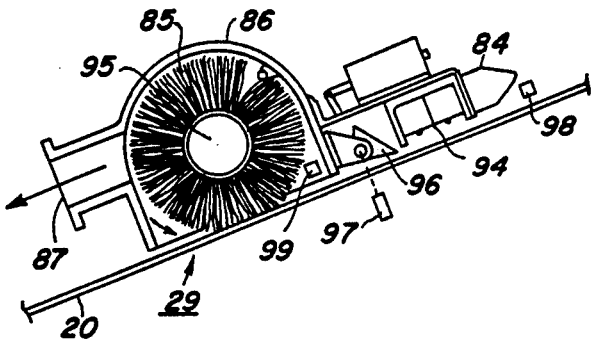
FIG. 10 is an enlarged view showing details of the photoreceptor cleaning mechanism for the apparatus shown in FIG. 1.

Referring to FIGS. 1, 2 and 10, to prepare belt 20 for cleaning, residual charges on belt 20 are removed by discharge lamp 84 and preclean corotron 94. A cleaning brush 85, rotatably supported within an evacuated semicircular shaped brush housing 86 at cleaning station 29, serves to remove residual developer from belt 20. Motor 95 drives brush 85, brush 85 turning in a direction opposite that of belt 20.

Vacuum conduit 87 couples brush housing 86 through a centrifugal type separator 88 with the suction side of vacuum pump 93. A final filter 89 on the outlet of motor 93 traps particles that pass through separator 88. The heavier toner particles separated by separator 88 drop into and are collected in one or more collecting bottles 90. Pressure sensor 91 monitors the condition of final filter 89 while a sensor 92 monitors the level of toner particles in collecting bottles 90.

To obviate the danger of copy sheets remaining on belt 20 and becoming entangled with the belt cleaning mechanism, a deflector 96 is provided upstream of cleaning brush 85. Deflector 96, which is pivotally supported on the brush housing 86, is operated by solenoid 97. In the normal or off position, deflector 96 is spaced from belt 20 (the solid line position shown in the drawings). Energization of solenoid 97 pivots deflector 96 downwardly to bring the deflector leading edge into close proximity to belt 20.

Sensors 98, 99 are provided on each side of deflector 96 for sensing the presence of copy material on belt 20. A signal output from upstream sensor 98 triggers solenoid 97 to pivot deflector 96 into position to intercept the copy sheet on belt 20. The signal from sensor 98 also initiates a system shutdown cycle (mis strip jam) wherein the various operating components are, within a prescribed interval, brought to a stop. The interval permits any copy sheet present in fuser 150 to be removed, sheet trap solenoid 158 having been actuated to prevent the next copy sheet from entering fuser 150 and becoming trapped therein. The signal from sensor 99, indicating failure of deflector 96 to intercept or remove the copy sheet from belt 20, triggers an immediate or hard stop (sheet on selenium jam) of the processor. In this type of power to drive motor 34 is interrupted to bring belt 20 and the other components driven therefrom to an immediate stop.

Referring particularly to FIGS. 1 and 12, copy sheets 3 comprise precut paper sheets supplied from either main or auxiliary paper trays 100, 102. Each paper tray has a platform or base 103 for supporting in stack like fashion a quantity of sheets. The tray platforms 103 are supported for vertical up and down movement as motors 105, 106. Side guide pairs 107, in each tray 100, 102 delimit the tray side boundaries, the guide pairs being adjustable toward and away from one another in accommodation of different size sheets. Sensors 108, 109 respond to the position of each side guide pair 107, the output of sensors 108, 109 serving to regulate operation of edge fadeout lamps 45 and fuser cooling valve 171. Lower limit switches 110 on each tray prevent overtravel of the tray platform in a downward direction.

A heater 112 is provided below the platform 103 of main tray 100 to warm the tray area and enhance feeding of sheets therefrom. Humidstat 113 and thermostat 114 control operation of heater 112 in response to the temperature/humidity conditions of main tray 100. Fan 115 is provided to circulate air within tray 100.

To advance the sheets 3 from either main or auxiliary tray 100, 102, main and auxiliary sheet feeders 120, 121 are provided. Feeders 120, 121 each include a nudger roll 123 to engage and advance the topmost sheet in the paper tray forward into the nip formed by a feed belt 124 and retard roll 125. Retard rolls 125, which are driven at an extremely low speed by motor 126, cooperate with feed belts 124 to restrict feeding of sheets from trays 100, 102 to one sheet at a time.

Feed belts 124 are driven by main and auxiliary sheet feed motors 127, 128 respectively. Nudger rolls 123 are supported for pivotal movement about the axis of feed belt drive shaft 129 with drive to the nudger rolls taken from drive shaft 129. Stack height sensors 133, 134 are provided for the main and auxiliary trays, the pivoting nudger rolls 123 serving to operate sensors 133, 134 in response to the sheet stack height. Main and auxiliary tray misfeed sensors 135, 136 are provided at the tray outlets.

Main transport 140 extends from main paper tray 100 to a point slightly upstream of the nip formed by photoconductive belt 20 and transfer roll 75. Transport 140 is driven from main motor 34. To register sheets 3 with the images developed on belt 20, sheet register fingers 141 are provided, fingers 141 being arranged to move into and out of the path of the sheets on transport 140 once each revolution. Registration fingers 141 are driven from main motor 34 through electromagnetic clutch 145. A timing or reset switch 146 is set once on each revolution of sheet register fingers 141. Sensor 139 monitors transport 140 for jams. Further amplification of sheet register system may be found in U.S. Pat. No. 3,781,004, issued Dec. 25, 1973 to Buddendeck et al.

Pinch roll pair 142 is interspaced between transport belts that comprise main transport 140 on the downstream side of register fingers 141. Pinch roll pair 142 are driven from main motor 34.

Auxiliary transport 147 extends from auxiliary tray 102 to main transport 140 at a point upstream of sheet register fingers 141. Transport 147 is driven from motor 34.

To maintain the sheets in driving contact with the belts of transports 140, 147, suitable guides or retainers (not shown) may be provided along the belt runs.

The image bearing sheets leaving the nip formed by photoconductive belt 20 and transfer roll 75 are picked off by belts 155 of the leading edge of vacuum transport 149. Belts 155, which are perforated for the admission of vacuum therethrough, ride on forward roller pair 148 and rear roll 153. A pair of internal vacuum plenums 151, 154 are provided, the leading plenum 154 cooperating with belts 155 to pick up the sheets leaving the belt/transfer roll nip. Transport 149 conveys the image bearing sheets to fuser 150. Vacuum conduits 147, 156 communicate plenums 151, 154 with vacuum pump 152. A pressure sensor 157 monitors operation of vacuum pump 152. Sensor 144 monitors transport 149 for jams.

To prevent the sheet on transport 149 from being carried into fuser 150 in the event of a jam or malfunction, a trap solenoid 158 is provided below transport 149. Energization of solenoid 158 raises the armature thereof into contact with the lower face of plenum 154 to intercept and stop the sheet moving therepast.

Referring particularly to FIGS. 4, 10 and 12, fuser 150 comprises a lower heated fusing roll 160 and upper pressure roll 161. Rolls 160, 161 are supported for rotation in fuser housing 162. The core of fusing roll 160 is hollow for receipt of heating rod 163 therewithin.

Housing 162 includes a sump 164 for holding a quantity of liquid release agent, herein termed oil. Dispensing belt 165, moves through sump 164 to pick up the oil, belt 165 being driven by motor 166. A blanket-like wick 167 carries the oil from belt 165 to the surface of fusing roll 160.

Pressure roll 161 is supported within an upper pivotal section 168 of housing 162. This enables pressure roll 161 to be moved into and out of operative contact fusing roll 160. Cam shaft 169 in the lower portion of fuser housing 162 serves to move housing section 168 and pressure roll 161 into operative relationship with fusing roll 160 against a suitable bias (not shown). Cam shaft 169 is coupled to main motor 34 through an electromagnetically operated one revolution clutch 159.

Fuser section 168 is evacuated, conduit 170 coupling housing section 168 with vacuum pump 152. The ends of housing section 168 are separated into vacuum compartments opposite the ends of pressure roll 161 thereunder to cool the roll ends where smaller size copy sheets 3 are being processed. Vacuum valve 171 in conduit 172 regulates communication of the vacuum compartments with vacuum pump 152 in response to the size sheets as sensed by side guide sensors 108, 109 in paper trays 100, 102.

Fuser roll 160 is driven from main motor 34. Pressure roll 161 is drivingly coupled to fuser roll 160 for rotation therewith.

Thermostat 174 in fuser housing 162 controls operation of heating rod 163 in response to temperature. Sensor 175 protects against fuser over-temperature. To protect against trapping of a sheet in fuser 150 in the event of a jam, sensor 176 is provided.

Following fuser 150, the sheet is carried by post fuser transport 180 to either discharge transport 181 or, where duplex or two sided copies are desired, to return transport 182. Sheet sensor 183 monitors passage of the sheets from fuser 150. Transports 180, 181 are driven from main motor 34. Sensor 181' monitors transport 181 for jams. Suitable retaining means may be provided to retain the sheets on transports 180, 181.

A deflector 184, when extended routes sheets on transport 180 onto conveyor roll 185 and into chute 186 leading to return transport 182. Solenoid 179, when energized raises deflector 184 into the sheet path. Return transport 182 carries the sheets back to auxiliary tray 102. Sensor 189 monitors transport 182 for jams. The forward stop 187 of tray 102 are supported for oscillating movement. Motor 188 drives stop 187 to oscillate stops 187 back and forth and tap sheets returned to auxiliary tray 102 into alignment for refeeding.

To invert duplex copy sheets following fusing of the second or duplex image, a displaceable sheet stop 190 is provided adjacent the discharge end of chute 186. Stop 190 is pivotally supported for swinging movement into and out of chute 186. Solenoid 191 is provided to move stop 190 selectively into or out of chute 186. Pinch roll pairs 192, 193 serve to draw the sheet trapped in chute 186 by stop 190 and carry the sheet forward onto discharge transport 181. Further description of the inverter mechanism may be found in U.S. Pat. No. 3,856,295, issued Dec. 24, 1974, to John H. Looney.

Output tray 195 receives unsorted copies. Transport 196 a portion of which is wrapped around a turn around roll 197, serves to carry the finished copies to tray 195. Sensor 194 monitors transport 196 for jams. To route copies into output tray 195, a deflector 198 is provided. Deflector solenoid 199, when energized, turns deflector 198 to intercept sheets on conveyor 181 and route the sheets onto conveyor 196.

When output tray 195 is not used, the sheets are carried by conveyor 181 to sorter 14.

SORTER

Figure 13:
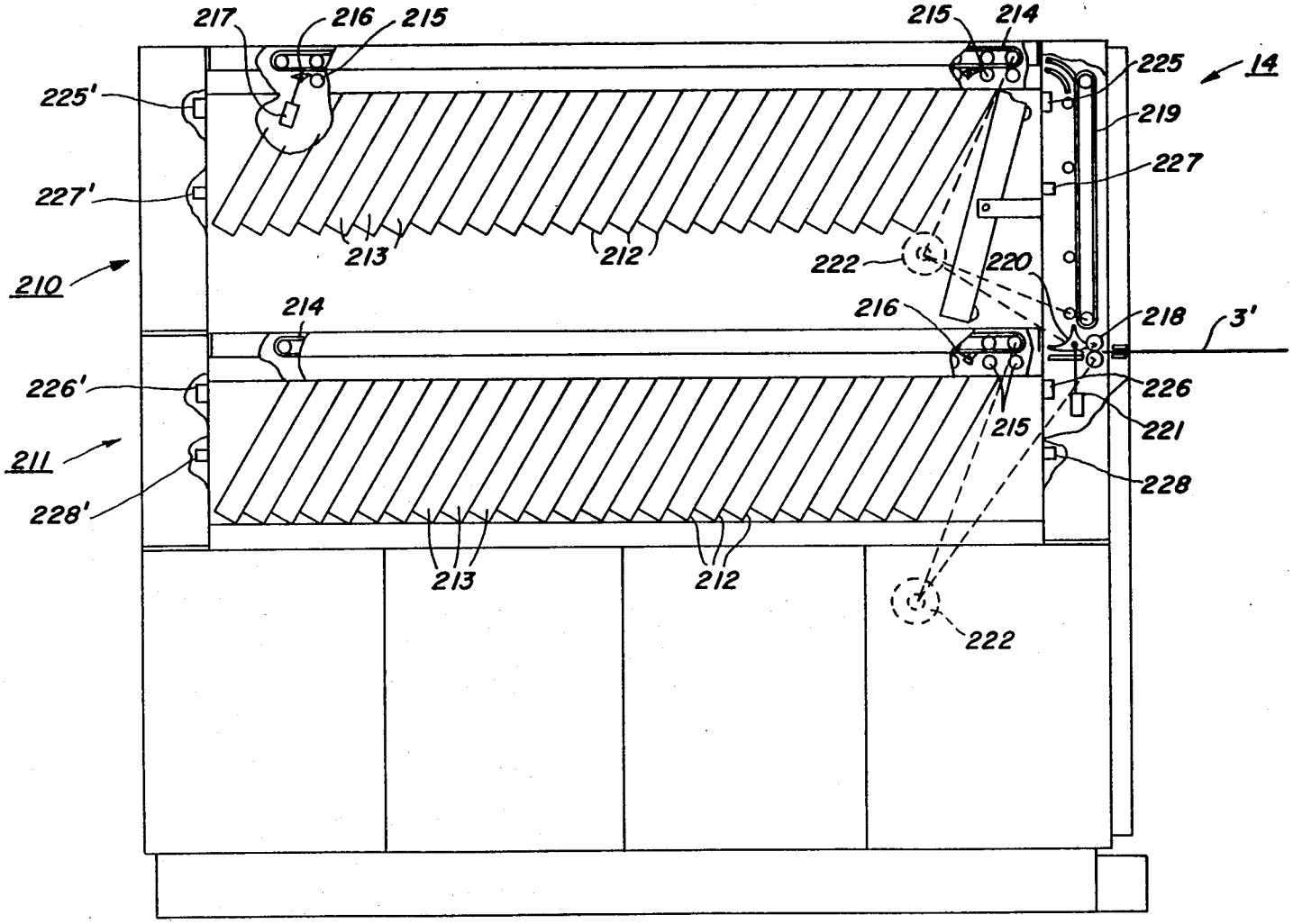
FIG. 13 is an enlarged view showing details of the copy sorter for the apparatus shown in FIG. 1.

Referring particularly to FIG. 13, sorter 14 comprises upper and lower bin arrays 210, 211. Each binary array 210, 211 consists of series of spaced downwardly inclined trays 212, forming a series of individual bins 213 for receipt of finished copies 3'. Conveyors 214 along the top of each bin array, cooperate with idler rolls 215 adjacent the inlet to each bin to transport the copies into juxtaposition with the bins. Individual deflectors 216 at each bin cooperate, when depressed, with the adjoining idler roll 215 to turn the copies into the bin associated therewith. An operating solenoid 217 is provided for each deflector.

A driven roll pair 218 is provided at the inlet to sorter 14. A generally vertical conveyor 219 serves to bring copies 3' to the upper bin array 210. Entrance deflector 220 routes the copies selectively to either the upper or lower bin array 210, 211 respectively. Solenoid 221 operates deflector 220.

Motor 222 is provided for each bin array to drive the conveyors 214 and 219 of upper bin array 210 and conveyor 214 of lower bin array 211. Roll pair 218 is drivingly coupled to both motors.

To detect entry of copies 3' in the individual bins 213, a photoresist type sensor 225, 226 is provided at one end of each bin array 210, 211 respectively. Sensor lamps 225', 226' are disposed adjacent the other end of the bin array. To detect the presence of copies in the bins 213, a second set of photoelectric type sensors 227, 228 is provided for each bin array, on a level with tray cutout 229. Reference lamps 227', 228' are disposed opposite sensors 227, 228.

DOCUMENT HANDLER

Figure 14:
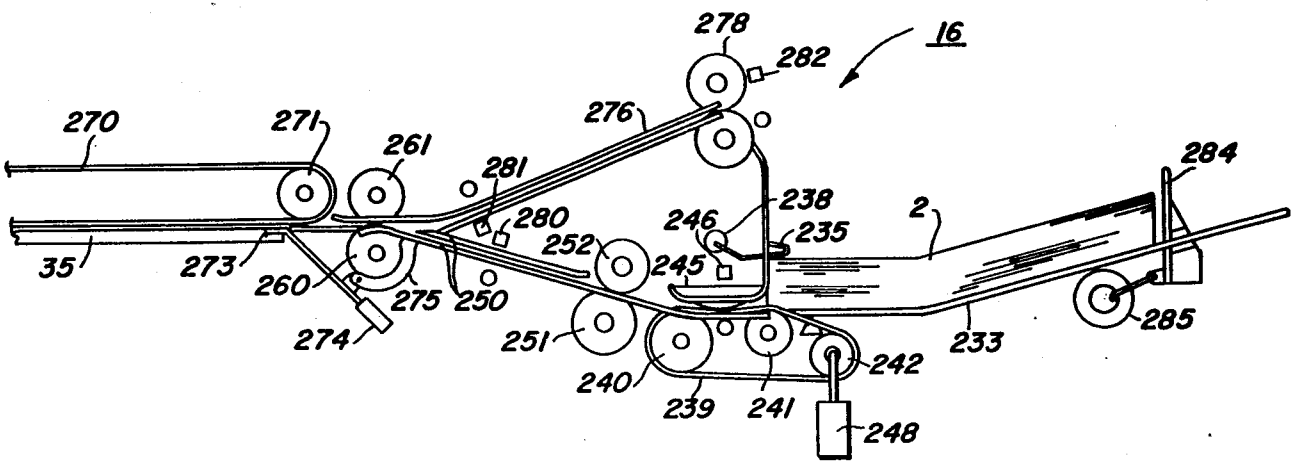
FIG. 14 is a schematic view showing details of the document handler for the apparatus shown in FIG. 1.
Figure 15:
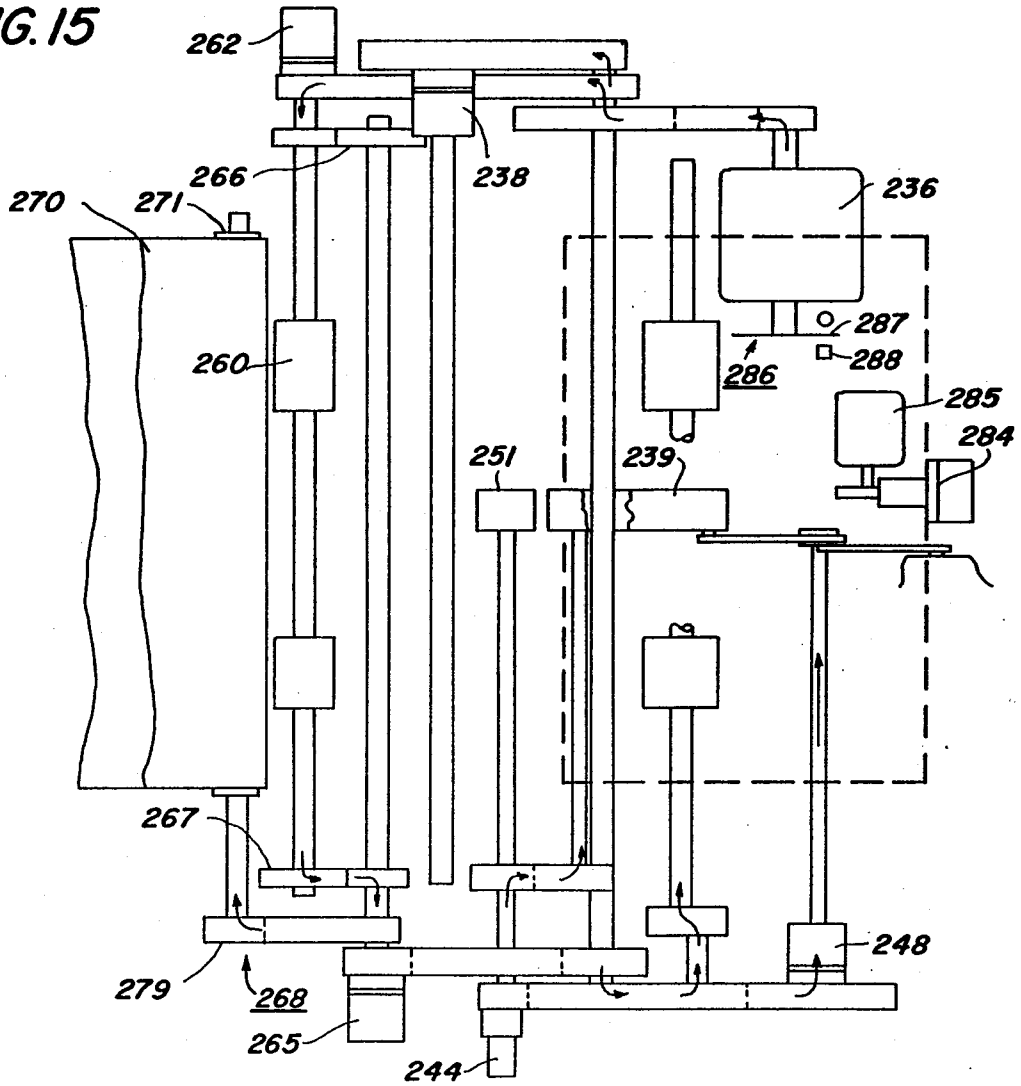
FIG. 15 is a view showing details of the drive mechanism for the document handler shown in FIG. 14.

Referring particularly to FIGS. 14 and 15, document handler 16 includes a tray 233 into which originals or documents 2 to be copied are placed by the operator following which a cover (not shown) is closed. A movable bail or separator 235, driven in an oscillatory path from motor 236 through a solenoid operated one revolution clutch 238, is provided to maintain document separation.

A document feed belt 239 is supported on drive and idler rolls 240, 241 and kicker roll 242 under tray 233, tray 233 being suitably apertured to permit the belt surface to project therewithin. Feed belt 239 is driven by motor 236 through electromagnetic clutch 244. Guide 245, disposed near the discharge end of feed belt 239, cooperates with belt 239 to form a nip between which the documents pass.

A photoelectric type sensor 246 is disposed adjacent the discharge end of belt 239. Sensor 246 responds on failure of a document to feed within a predetermined interval to actuate solenoid operated clutch 248 which raises kicker roll 242 and increase the surface area of feed belt 239 in contact with the documents.

Document guides 250 route the document fed from tray 233 via roll pair 251, 252 to platen 35. Roll 251 is drivingly coupled to motor 236 through electromagnetic clutch 244. Contact of roll 251 with roll 252 turns roll 252.

Roll pair 260, 261 at the entrance to platen 35 advance the document onto platen 35, roll 260 being driven through electromagnetic clutch 262 in the forward direction. Contact of roll 260 with roll 261 turns roll 261 in the document feeding direction. Roll 260 is selectively coupled through gearset 268 with motor 236 through electromagnetic clutch 265 so that on engagement of clutch 265 and disengagement of clutch 262, roll 260 and roll 261 therewith turn in the reverse direction to carry the document back to tray 233. One way clutches 266, 267 permit free wheeling of the roll drive shafts.

The document leaving roll pair 260, 261 is carried by platen feed belt 270 onto platen 35, belt 270 being comprised of a suitable flexible material having an exterior surface of xerographic white. Belt 270 is carried about drive and idler rolls 271, 272. Roll 271 is drivingly coupled to motor 236 for rotation in either a forward or reverse direction through clutches 262, 265. Engagement of clutch 262 operates through belt and pulley drive 279 to drive belt in the forward direction, engagement of clutch 265 operates through drive 279 to drive belt 270 in the reverse direction.

To locate the document in predetermined position on platen 35, a register 273 is provided at the platen inlet for engagement with the document trailing edge. For this purpose, control of platen belt 270 is such that following transporting of the document onto plate 35 and beyond register 273, belt 270 is reversed to carry the document backwards against register 273.

To remove the document from platen 35 following copying, register 273 is retracted to an inoperative position. Solenoid 274 is provided for moving register 273.

A document deflector 275, is provided to route the document leaving platen 35 into return chute 276. For this purpose, platen belt 270 and pinch roll pair 260, 261 are reversed through engagement of clutch 265. Discharge roll pair 278, driven by motor 236, carry the returning document into tray 233.

To monitor movement of the documents in document handler 16 and detect jams and other malfunctions, photoelectric type sensors 246 and 280, 281 and 282 are disposed along the document routes.

To align documents 2 returned to tray 233, a document patter 284 is provided adjacent one end of tray 233. Patter 284 is oscillated by motor 285.

To provide the requisite operational synchronization between host machine 10 and controller 18 as will appear, processor or machine clock 202 is provided. Referring particularly to FIG. 1, clock 202 comprises a toothed disc 203 drivingly supported on the output shaft of main drive motor 34. A photoelectric type signal generator 204 is disposed astride the path followed by the toothed rim of disc 203, generator 204 producing, whenever drive motor 34 is energized, a pulse like signal output at a frequency correlated with the speed of motor 34, and the machine components driven therefrom.

As described, a second machine clock, termed a pitch reset clock 138 herein, and comprising timing switch 146 is provided. Switch 146 cooperates with sheet register fingers 141 to generate an output pulse once each revolution of fingers 141. As will appear, the pulse like output of the pitch reset clock is used to reset or resynchronize controller 18 with host machine 10.

Referring to FIG. 15, a document handler clock 286 consisting of apertured disc 287 on the output shaft of document handler drive motor 236 and cooperating photoelectric type signal generator 288 is provided. As in the case of machine clock 202, document handler clock 286 produces pulses in synchronism with document handler 16 operation. A real time clock produce pulses 670 relative to real time intervals, such pulses being derived from clock 552 in this example.

CONTROLLER

Figure 16:
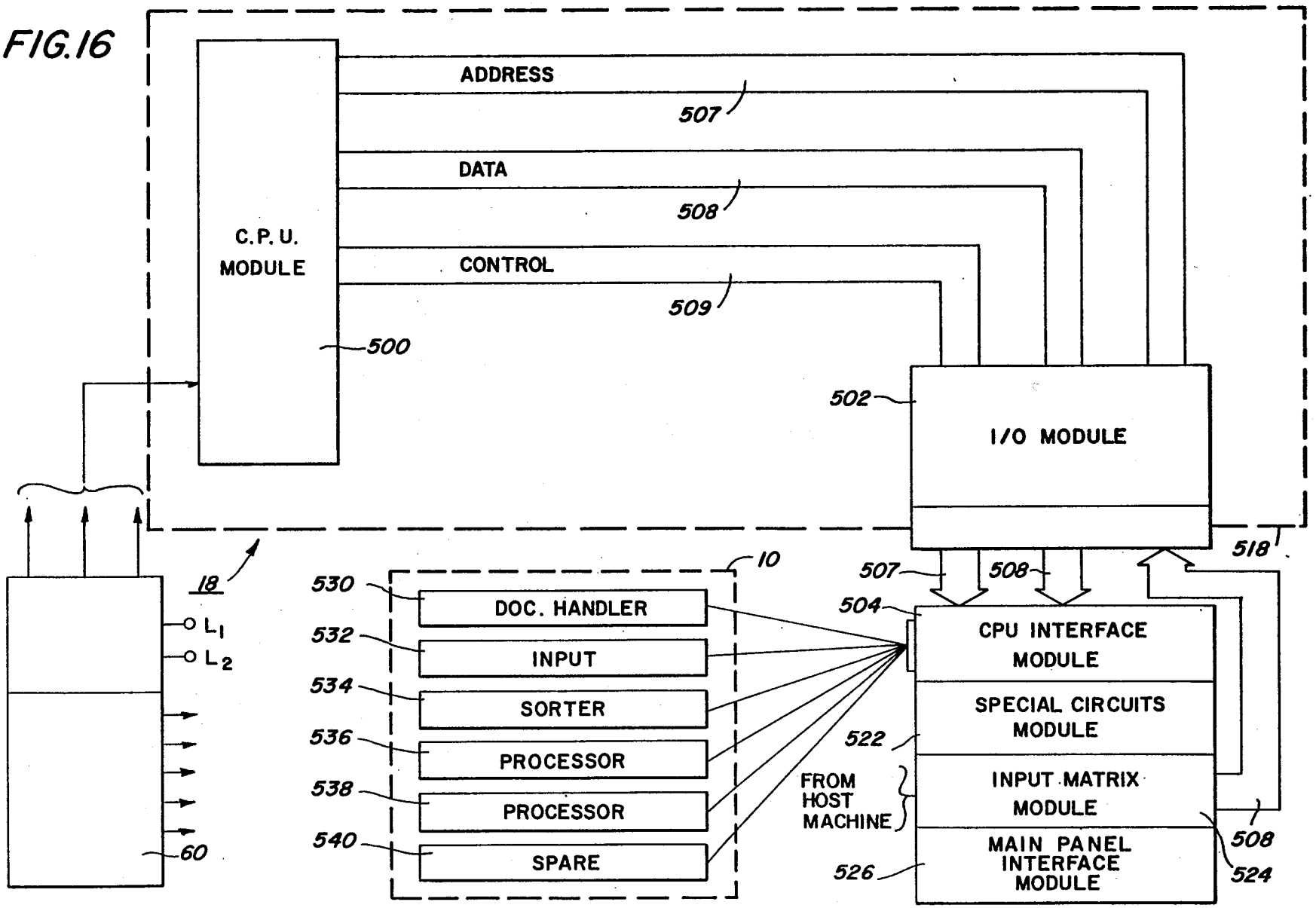
FIG. 16 is a block diagram of the controller for the apparatus shown in FIG. 1.

Referring to FIG. 16 controller 18 includes a Computer Processor Unit (CPU) Module 500, Input/Output (I/O) Module 502, and Interface 504. Address, Data, and Control Buses 507, 508, 509 respectively operatively couple CPU Module 500 and I/O Module 502. CPU Module 500 and I/O Module 502 are disposed within a shield 518 to prevent noise interference.

Interface 504 couples I/O Module 502 with special circuits module 522, input matrix module 524, and main panel interface module 526. Module 504 also couples I/O Module 502 to operating sections of the machine, namely, document handler section 530, input section 532, sorter section 534 and processor sections 536, 538. A spare section 540, which may be used for monitoring operation of the host machine, or which may be later utilized to control other devices, is provided.

Figure 17:
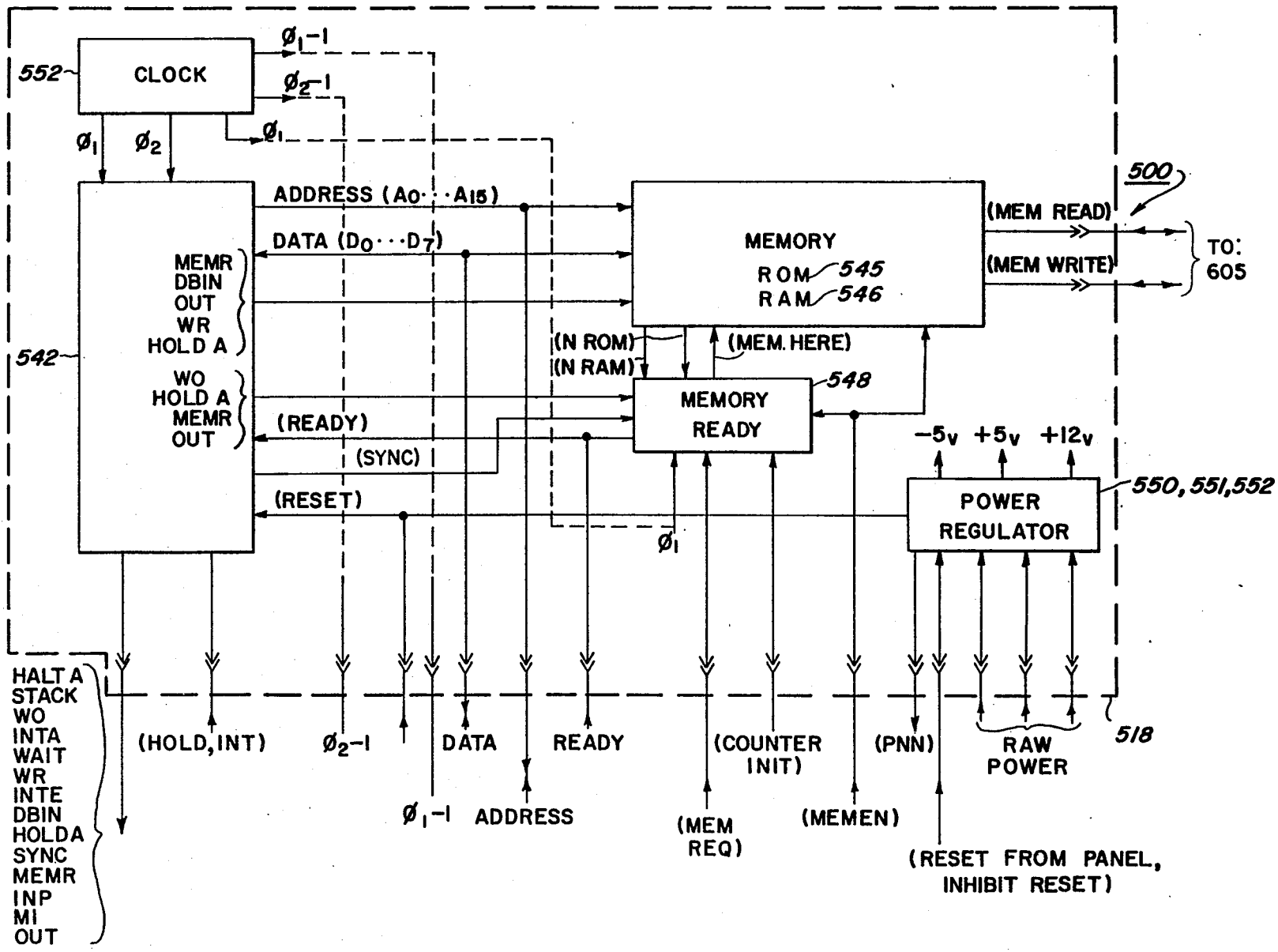
FIG. 17 is a block diagram of the controller CPU.

Referring to FIGS. 17, 18*a* and 18*b*, CPU module 500 comprises a processor 542 such as an Intel 8080 microprocessor manufactured by Intel Corporation, Santa Clara, Calif., 16K Read Only Memory (herein ROM) and 2K Random Access Memory (herein RAM) sections 545, 546, Memory Ready section 548, power regulator section 550, and onboard clock 552. Bipolar tristate buffers 510, 511 in Address and Data buses 507, 508 disable the bus on a Direct Memory Access (DMA) signal (HOLD A) as will appear. While the capacity of memory sections 545, 546 are indicated throughout as being 16K and 2K respectively, other memory sizes may be readily contemplated.

Referring particularly to FIG. 19*a*, clock 552 comprises a suitable clock oscillator 553 feeding a multi-bit (Qa–Qn) shift register 554. Register 554 includes an internal feedback path from one bit to the serial input of register 554. Output signal waveforms $\emptyset_1$, $\emptyset_2$, $\emptyset_{1-1}$ and $\emptyset_{2-1}$ are produced for use by the system.

Referring to FIG. 20, the memory bytes in ROM section 545 are implemented by Address signals (A0–A 15) from processor 542, selection being effected by 3 to 8 decode chip 560 controlling chip select 1 (CS-1) and a 1 bit selection (A 13) controlling chip select 2 (CS-2). The most significant address bits (A 14, A 15) select the first 16K of the total 64K bytes of addressing space. The memory bytes in RAM section 546 are implemented by Address signals (A0–A 15) through selector circuit 561. Address bit A 10 serves to select the memory bank while the remaining five most significant bits (A 11–A 15) select the last 2K bytes out of the 64K byte of addressing space. RAM memory section 546 includes a 40 bit output buffer 546', the output of which is tied together with the output from ROM memory section 545 and goes to tri-state buffer 562 to drive Data bus 508. Buffer 562 is enabled when either memory section 545 or 546 is being addressed and either a (MEM READ) or DMA (HOLD A) memory request exists. An enabling signal (MEMEN) is provided from the machine control or service panel (not shown) which is used to permit disabling of buffer 562 during servicing of CPU Module 500. Write control comes from either processor 542 (MEM WRITE) or from DMA (HOLD A) control. Tri-state buffers 563 permit Refresh Control 605 of I/O Module 502 to access MEM READ and MEM WRITE control channels directly on a DMA signal (HOLD A) from processor 542 as will appear.

Referring to FIG. 21, memory ready section 548 provides a READY signal to processor 542. A binary counter 566, which is initialized by a SYNC signal ($\emptyset_1$) to a prewired count as determined by input circuitry 567, counts up at a predetermined rate. At the maximum count, the output at gate 568 comes true stopping the counter 566. If the cycle is a memory request (MEM REQ) and the memory location is on board as determined by the signal (MEM HERE) to tri-state buffer 569, a READY signal is sent to processor 542. Tri-state buffer 570 in MEM REQ line permits Refresh Control 605 of I/O Module 502 to access the MEM REQ channel directly on a DMA signal (HOLD A) from processor 542 as will appear.

Referring to FIG. 22, power regulators 550, 551, 552 provide the various voltage levels, i.e. +5 v, +12 v, and −5 v D.C. required by the module 500. Each of the three on board regulators 550, 551, 552 employ filtered D.C. inputs. Power Not Normal (PNN) detection circuitry 571 is provided to reset processor 542 during the power up time. Panel reset is also provided via PNN. An enabling signal (INHIBIT RESET) allows completion of a write cycle in Non Volatile (N.V.) Memory 610 of I/O Module 502.

Referring to FIGS. 18*a*, 20, 21, and the DMA timing chart (FIG. 18*b*) data transfer from RAM section 546 to host machine 10 is effected through Direct Memory Access (DMA), as will appear. To initiate DMA, a signal (HOLD) is generated by Refresh Control 605 (FIG. 23*a*). On acceptance, processor 542 generates a signal HOLD ACKNOWLEDGE (HOLD A) which works through tri-state buffers 510, 511 and through buffers 563 and 570 to release Address bus 507, Data bus 508 and MEM READ, MEM WRITE, and MEM REQ channels (FIGS. 20, 21) to Refresh Control 605 of I/O Module 502.

Referring to FIGS. 23*a* and 23*b*, I/O module 502 interfaces with CPU module 500 through bi-directional Address, Data and Control buses 507, 508, 509. I/O module 502 appears to CPU module 500 as a memory portion. Data transfers between CPU and I/O modules 500, 502, and commands to I/O module 502 except for output refresh are controlled by memory reference instructions executed by CPU module 500. Output refresh which is initiated by one of several uniquely decoded memory reference commands, enables Direct Memory Access (DMA) by I/O Module 502 to RAM section 546.

I/O module 502 includes Matrix Input Select 604 (through which inputs from the host machine 10, are received), Refresh Control 605, Nonvolatile (NV) memory 610, Interrupt Control 612, Watch Dog Timer and Failure Flag 614 and clock 570.

A Function Decode Section 601 receives and interprets commands from CPU section 500 by decoding information on address bus 507 along with control signals from processor 542 on control bus 509. On command, decode section 601 generates control signals to perform the function indicated. These functions include (a) controlling tri-state buffers 620 to establish the direction of data flow in Data bus 508; (b) strobing data from Data bus 508 into buffer latches 622; (c) controlling multiplexer 624 to put data from Interrupt Control 612, Real Time clock register 621, Matrix Input Select 604 or N.V. memory 610 onto data bus 508; (d) actuating refresh control 605 to initiate a DMA operation; (e) actuating buffers 634 to enable address bits A0–A 7 to be sent to the host machine 10 for input matrix read operations; (f) commanding operation of Matrix Input Select 604; (g) initiating read or write operation of N.V. memory 610 through Memory Control 638; (h) loading Real Time clock register 621 from data bus 508; and (i) resetting the Watch Dog timer or setting the Fault Failure flag 614. In addition, section 601 includes logic to control and synchronize the READY control line to CPU module 500, the READY line being used to advise module 500 when data placed on the Data Bus by I/O Module 502 is valid.

Watch dog timer and failure flag 614, which serves to detect certain hardwired and software malfunctions, comprises a free running counter which under normal circumstances is periodically reset by an output refresh command (REFRESH) from Function Decode Section 601. If an output refresh command is not received within a preset time interval, (i.e. 25 m sec) a fault flip flop is set and a signal (FAULT) sent to the host machine 10. The signal (FAULT) also raises the HOLD line to disable CPU Module 500. Clearing of the fault flip flop may be by cycling power or generating a signal (RESET). A selector (not shown) may be provided to disable (DISABLE) the watch dog timer when desired. The fault flip flop may also be set by a command from the CPU Module to indicate that the operating program detected a fault.

Matrix Input Select 604 capacity to read up to 32 groups of 8 discrete inputs from host machine 10. Lines $A_2$ through $A_7$ of Address bus 507 are routed to host machine 10 via CPU Interface Module 504 to select the desired group of 8 inputs. The selected input from machine 10 are received via Input Matrix Module 524 (FIG. 28) and are placed by matrix 604 onto data bus 508 and sent to CPU Module 500 via multiplexer 624. Bit selection is effected by lines $A_0$ through $A_2$ of Address bus 507.

Output refresh control 605, when initiated, transfers either 16 or 32 sequential words from RAM memory output buffer 546' to host machine 10 at the predetermined clock rate in line 574. Direct Memory Access (DMA) is used to facilitate transfer of the data at a relatively high rate. On a Refresh signal from Function Decode Section 601, Refresh Control 605 generates a HOLD signal to processor 542. On acknowledgement (HOLD A) processor 542 enters a hold condition. In this mode, CPU Module 500 releases address and data buses 507, 508 to the high impedance state giving I/O module 502 control thereover. I/O module 502 then sequentially accesses the 32 memory words from output buffer 546' (REFRESH ADDRESS) and transfers the contents to the host machine 10. CPU Module 500 is dormant during this period.

A control signal (LOAD) in line 607 along with the predetermined clock rate determined by the clock signal (CLOCK) in line 574 is utilized to generate eight 32 bit serial words which are transmitted serially via CPU Interface Module 504 to the host machine remote locations where serial to parallel transformation is performed. Alternatively, the data may be stored in addressable latches and distributed in parallel directly to the required destinations.

N.V. memory 610 comprises a predetermined number of bits of non-volatile memory stored in I/O Module 502 under Memory Control 638. N.V. memory 610 appears to CPU module 500 as part of the CPU module memory complement and therefore may be accessed by the standard CPU memory reference instruction set. Referring particularly to FIG. 24, to sustain the contents of N.V. memory 610 should system power be interrupted, one or more rechargeable batteries 635 are provided exterior to I/O module 502. CMOS protective circuitry 636 couples batteries 635 to memory 610 to preserve memory 610 on a failure of the system power. A logic signal (INHIBIT RESET) prevents the CPU Module 500 from being reset during the N.V. memory write cycle interval so that any write operation in progress will be completed before the system is shut down.

For tasks that require frequent servicing, high speed response to external events, or synchronization with the operation of host machine 10, a multiple interrupt system is provided. These comprise machine based interrupts, herein referred to as Pitch Reset, Machine, and Document Handler interrupts. A fourth clock driven interrupt, the Real Time interrupt, is also provided.

Referring particularly to FIGS. 23*b* and 34, the highest priority interrupt signal, Pitch Reset signal 640, is generated by the signal output of pitch reset clock 138. The clock signal is fed via optical isolator 645 and digital filter 646 to edge trigger flip flop 647.

The second highest priority interrupt signal, machine clock signal 641, is sent directly from machine clock 202 through isolation transformer 648 to a phase locked loop 649. Loop 649, which serves as bandpath filter and signal conditioner, sends a square wave signal to edge trigger flip flop 651. The second signal output (LOCK) serves to indicate whether loop 649 is locked onto a valid signal input or not.

The third highest priority interrupt signal, Document Handler Clock signal 642, is sent directly from document handler clock 286 via isolation transformer 652 and phase locked loop 653 to flip flop 654. The signal (LOCK) serves to indicate the validity of the signal input to loop 653.

The lowest priority interrupt signal, Real Time Clock signal 643, is generated by register 621. Register 621 which is loaded and stored by memory reference instructions from CPU module 500 is decremented by a clock signal in line 643 which may be derived from I/O Module clock 570. On the register count reaching zero, register 621 sends an interrupt signal to edge trigger flip flop 656.

Setting of one or more of the edge trigger flip flops 647, 651, 654, 656 by the interrupt signals 640, 641, 642, 643 generates a signal (INT) via priority chip 659 to processor 542 of CPU Module 500. On acknowledgement, processor 542, issues a signal (INTA) transferring the status of the edge trigger flip flops 647, 651, 654, 656 to a four bit latch 660 to generate an interrupt instruction code (RESTART) onto the data bus 508.

Each interrupt is assigned a unique RESTART instruction code. Should an interrupt of higher priority be triggered, a new interrupt signal (INT) and RESTART instruction code are generated resulting in a nesting of interrupt software routines whenever the interrupt recognition circuitry is enabled within the CPU 500.

Priority chip 659 serves to establish a handling priority in the event of simultaneous interrupt signals in accordance with the priority schedule described.

Once triggered, the edge trigger flip flop 647, 651, 654, or 656 must be reset in order to capture the next occurrence of the interrupt associated therewith. Each interrupt subroutine serves, in addition to performing the functions programmed, to reset the flip flops (through the writing of a coded byte in a uniquely selected address) and to re-enable the interrupt (through execution of a re-enabling instruction). Until re-enabled, initiation of a second interrupt is precluded while the first interrupt is in progress.

Lines 658 permit interrupt status to be interrogated by CPU module 500 on a memory reference instruction.

I/O Module 502 includes a suitable pulse generator or clock 570 for generating the various timing signals required by module 502. Clock 570 is driven by the pulse-like output $\emptyset_1$, $\emptyset_2$ of processor clock 552 (FIG. 19*a*). As described, clock 570 provides a reference clock pulse (in line 574) for synchronizing the output refresh data and is the source of clock pulses (in line 643) for driving Real Time register 621.

CPU interface module 504 interfaces I/O module 502 with the host machine 10 and transmits operating data stored in RAM section 546 to the machine. Referring particularly to FIGS. 25 and 26, data and address information are inputted to module 504 through suitable means such as optical type couplers 700 which convert the information to single ended logic levels. Data in bus 508 on a signal from Refresh Control 605 in line 607 (LOAD), is clocked into module 504 at the reference clock rate in line 574 parallel by bit, serial by byte for a preset byte length, with each data bit of each successive byte being clocked into a separate data channel D0–D7. As best seen in FIG. 25, each data channel D0–D7 has an assigned output function with data channel D0 being used for operating the front panel lamps 830 in the digital display, (see FIG. 32), data channel D1 for special circuits module 522, are remaining data channels D2–D7 allocated to the host machine operating sections 530, 532, 534, 536, 538 and 540. Portions of data channels D1–D7 have bits reserved for front panel lamps and digital display.

Since the bit capacity of the data channels D2–D7 is limited, a bit buffer 703 is preferably provided to catch any bit overflow in data channels D2–D7.

Inasmuch as the machine output sections 530, 532, 534, 536, 538 and 540 are electrically a long distance away, i.e. take, from CPU interface module 504, and the environment is electrically "noisy", the data stream in channels D2–D7 is transmitted to remote sections 530, 532, 534, 536, 538 and 540 via a shielded twisted pair 704. By this arrangement, induced noise appears as a differential input to both lines and is rejected. The associated clock signal for the data is also transmitted over line 704 with the line shield carrying the return signal currents for both data and clock signals.

Data in channel $D_1$ destined for special circuits module 522 is inputted to shift register type storage circuitry 705 for transmittal to module 522. Data is also inputted to main panel interface module 526. Address information in bus 507 is converted to single ended output by couplers 700 and transmitted to Input Matrix Module 524 to address host machine inputs.

CPU interface module 504 includes fault detector circuitry 706 for monitoring both faults occurring in host machine 10 and faults or failures along the buses, the latter normally comprising a low voltage level or failure in one of the system power lines. Machine faults may comprise a fault in CPU module 500, a belt mistrack signal from sensor 27 (see FIG. 2), opening one of the machine doors or covers as responded to by conventional cover interlock sensors (not shown), a fuser over temperature as detected by sensor 175, etc. In the event of a bus fault, a reset signal (RESET) is generated automatically in line 709 to CPU module 500 (see FIGS. 17 and 18) until the fault is removed. In the event of a machine fault, a signal is generated by the CPU in line 710 to actuate a suitable relay (not shown) controlling power to all or a portion of host machine 10. A load disabling signal (LOAD DISBL) is inputted to optical couplers 700 via line 708 in the event of a fault in CPU module 500 to terminate input of data to host machine 10. Other fault conditions are monitored by the software background program. In the event of a fault, a signal is generated in line 711 to the digital display on control console 800 (via main panel interface module 526) signifying a fault.

Referring particularly to FIGS. 25 and 27, special circuits module 522 comprises a collection of relatively independent circuits for either monitoring operation of and/or driving various elements of host machine 10. Module 522 incorporates suitable circuitry 712 for amplifying the output of sensors 225, 226, 227, 228 and 280, 281, 282 of sorter 14 and document handler 16 respectively; circuitry 713 for operating fuser release clutch 159; and circuitry 714 for operating main and auxiliary paper tray feed roll clutches 130, 131 and document handler feed clutch 244.

Additionally, fuser detection circuitry 715 monitors temperature conditions of fuser 150 as responded to by sensor 174. On overheating of fuser 150, a signal (FUS-OT) is generated to turn heater 163 off, actuate clutch 159 to separate fusing and pressure rolls 160, 161; trigger trap solenoid 158 to prevent entrance of the next copy sheet into fuser 150, and initiate a shutdown of host machine 10. Circuitry 715 also cycles fuser heater 163 to maintain fuser 150 at proper operating temperatures and signals (FUS-RDUT) host machine 10 when fuser 150 is ready for operation.

Circuitry 716 provides closed loop control over sensor 98 which responds to the presence of a copy sheet 3 on belt 20. On a signal from sensor 98, solenoid 97 is triggered to bring deflector 96 into intercepting position adjacent belt 20. At the same time, a backup timer (not shown) is actuated. If the sheet is lifted from the belt 20 by deflector 96 within the time allotted, a signal from sensor 99 disables the timer and a mis strip type jam condition of host machine 10 is declared and the machine is stopped. If the signal from sensor 99 is not received within the allotted time, a sheet on selenium (SOS) type jam is declared and an immediate machine stop is effected.

Circuitry 718 controls the position (and hence the image reduction effected) by the various optical elements that comprise main lens 41 in response to the reduction mode selected by the operator and the signal inputs from lens position responsive sensors 116, 117, 118. The signal output of circuitry 718 serves to operate lens drive motor 43 as required to place the optical elements of lens 41 in proper position to effect the image reduction programmed by the operator.

Referring to FIG. 28, input matrix module 524 provides analog gates 719 for receiving data from the various host machine sensors and inputs (i.e. sheet sensors 135, 136; pressure sensor 157; etc), module 524 serving to convert the signal input to a byte oriented output for transmittal to I/O module 502 under control of Input Matrix Select 604. The byte output to module 524 is selected by address information inputted on bus 507 and decoded on module 524. Conversion matrix 720, which may comprise a diode array, converts the input logic signals of "0" to logic "1" true. Data from input matrix module 524 is transmitted via optical isolators 721 and Input Matrix Select 604 of I/O module 502 to CPU Module 500.

Referring particularly to FIG. 29, main panel interface module 526 serves as interface between CPU interface module 504 and operator control console 800 for display purposes and as interface between input matrix module 524 and the console switches. As described, data channels D0–D7 have data bits in each channel associated with the control console digital display or lamps. This data is clocked into buffer circuitry 723 and from there, for digital display, data in channels D1–D7 is inputted to multiplexer 724. Multiplexer 724 selectively multiplexes the data to HEX to 7 segment converter 725. Software controlled output drivers 726 are provided for each digit which enable the proper display digit in response to the data output of converter 725. This also provides blanking control for leading zero suppression or inter digit suppression.

Buffer circuitry 723 also enables through anode logic 728 the common digit anode drive. The signal (LOAD) to latch and lamp driver control circuit 729 regulates the length of the display cycle.

For console lamps 830, data in channel D0 is clocked to shift register 727 whose output is connected by drivers to the console lamps. Access by input matrix module 524 to the console switches and keyboard is through main panel interface module 526.

The machine output sections 530, 532, 534, 536, 538, 540 are interfaced with I/O module 502 by CPU interface module 504. At each interrupt/refresh cycle, data is outputted to sections 530, 532, 534, 536, 538, 540 at the clock signal rate in line 574 over data channels D2, D3, D4, D5, D6, D7 respectively.

Referring to FIG. 30, wherein a typical output section i.e. document handler section 530 is shown, data inputted to section 530 is stored in shift register/latch circuit combination 740, 741 pending output to the individual drivers 742 associated with each machine component. Preferably d.c. isolation between the output sections is maintained by the use of transformer coupled differential outputs and inputs for both data and clock signals and a shielded twisted conductor pair. Due to transformer coupling, the data must be restored to a d.c. waveform. For this purpose, control recovery circuitry 744, which may comprise an inverting/non-inverting digital comparator pair and output latch is provided.

The LOAD signal serves to lockout input of data to latches 741 while new data is being locked into shift register 740. Removal of the LOAD signal enables commutation of the fresh data to latches 741. The LOAD signal also serves to start timer 745 which imposes a maximum time limit within which a refresh period (initiated by Refresh Control 605) must occur. If refresh does not occur within the prescribed time limit, timer 745 generates a signal (RESET) which sets shift register 740 to zero.

With the exception of sorter section 534 discussed below, output sections 532, 536, 538 and 540 are substantially identical to document handler section 530.

Referring to FIG. 31 wherein like numbers refer to like parts, to provide capacity for driving the sorter deflector solenoids 221, a decode matrix arrangement consisting of a Prom encoder 750 controlling a pair of decoders 751, 752 is provided. The output of decoders 751, 752 drive the sorter solenoids 221 of upper and lower bin arrays 210, 211 respectively. Data is inputted to encoder 750 by means of shift register 754.

Referring now to FIG. 32, control console 800 serves to enable the operator to program host machine 10 to perform the copy run or runs desired. At the same time, various indicators on console 800 reflect the operational condition of machine 10. Console 800 includes a bezel housing 802 suitably supported on host machine 10 at a convenient point with decorative front or face panel 803 on which the various machine programming buttons and indicators appear. Programming buttons include power on/off buttons 804, start print (PRINT) button 805, stop print (STOP) button 806 and keyboard copy quantity selector 808. A series of feature select buttons consisting of auxiliary paper tray button 810, two sided copy button 811, copy lighter button 814, and copy darker button 815, are provided.

Additionally, image size selector buttons 818, 819, 820; multiple or single document select buttons 822, 823 for operation of document handler 14; and sorter sets or stacks buttons 825, 826 are provided. An on/off service selector 828 is also provided for activation during machine servicing.

Indicators comprise program display lamps 830 and displays such as READY, WAIT, SIDE 1, SIDE 2, ADD PAPER, CHECK STATUS PANEL, PRESS FAULT CODE, QUANTITY COMPLETED, CHECK DOORS, UNLOAD AUX TRAY, CHECK DOCUMENT PATH, CHECK PAPER PATH, and UNLOAD SORTER. Other display information may be envisioned.

OPERATION

As will appear, host machine 10 is conveniently divided into a number of operational states. The machine control program is divided into Background routines and Foreground routines with operational control normally residing in the Background routine or routines appropriate to the particular machine state then in effect. The output buffer 546' of RAM memory section 546 is used to transfer/refresh control data to the various remote locations in host machine 10, control data from both Background and Foreground routines being inputted to buffer 546' for subsequent transmittal to host machine 10. Transmittal/refresh of control data presently in output buffer 546' is effected through Direct Memory Access (DMA) under the aegis of a Machine Clock interrupt routine.

Foreground routine control data which includes a Run Event Table built in response to the particular copy run or runs programmed, is transferred to output buffer 546' by means of a multiple prioritized interrupt system wherein the Background routine in process is temporarily interrupted while fresh Foreground routine control data is inputted to buffer 546' following which the interrupted Background routine is resumed.

The operating program for host machine 10 is divided into a collection of foreground tasks, some of which are driven by the several interrupt routines and background or non-interrupt routines. Foreground tasks are tasks that generally require frequent servicing, high speed response, or synchronization with the host machine 10. Background routines are related to the state of host machine 10, different background routines being performed with different machine states. A single background software control program (STATCHK), (TABLE I) composed of specific sub-programs associated with the principal operating state of host machine 10 is provided. A byte called STATE contains a number indicative of the current operating state of host machine 10. The machine STATES are as follows:

| STATE NO. | MACHINE STATE | CONTROL SUBR. |
|---|---|---|
| 0 | Software Initialize | INIT |
| 1 | System Not Ready | NRDY |
| 2 | System Ready | RDY |
| 3 | Print | PRINT |
| 4 | System Running, Not Print | RUNNPRT |

-continued

| STATE NO. | MACHINE STATE | CONTROL SUBR. |
|---|---|---|
| 5 | Service | TECHREP |

Referring to FIG. 33, each STATE is normally divided into PROLOGUE, LOOP and EPILOGUE sections. As will be evident from the exemplary program STATCHK reproduced in TABLE I, entry into a given STATE (PROLOGUE) normally causes a group of operations to be performed, these consisting of operations that are performed once only at the entry into the STATE. For complex operations, a CALL is made to an applications subroutine therefor. Relatively simpler operations (i.e. turning devices on or off, clearing memory, presetting memory, etc.) are done directly.

Once the STATE PROLOGUE is completed, the main body (LOOP) is entered. The program (STATCHK) remains in this LOOP until a change of STATE request is received and honored. On a change of STATE request, the STATE EPILOGUE is entered wherein a group of operations are performed, following which the STATE moves into the PROLOGUE of the next STATE to be entered.

Referring to FIGS. **34*a* and 34*b* and the exemplary program (STATCHK) in TABLE I, on actuation of the machine POWER-ON button 804**, the software Initialize STATE (INIT) is entered. In this STATE, the controller is initialized and a software controlled self test subroutine is entered. If the self test of the controller is successfully passed, the System Not Ready STATE (NRDY) is entered. If not, a fault condition is signalled.

In the System Not Ready STATE (NRDY), background subroutines are entered. These include setting of Ready Flags, control registers, timers, and the like; turning on power supplies, the fuser, etc., initializing the Fault Handler, checking for paper jams (left over form a previous run), door and cover interlocks, fuser temperatures, etc. During this period, the WAIT lamp on console 800 is lit and operation of host machine 10 precluded.

When all ready conditions have been checked and found acceptable, the controller moves to the System Ready State (RDY). The READY lamp on console 800 is lit and final ready checks made. Host machine 10 is now ready for operation upon completion of input of a copy run program, loading of one or more originals 2 into document handler 16 (if selected by the operator), and actuation of START PRINT button 805. As will appear hereinafter, the next state is PRINT wherein the particular copy run programmed is carried out.

Following the copy run, (PRINT), the controller normally enters the System Not Ready state (NRDY) for rechecking of the ready conditions. If all are satisfied, the system proceeds to the System Ready State (RDY) unless the machine is turned off by actuation of POWER OFF button 804 or a malfunction inspired shutdown is triggered. The last state (TECH REP) is a machine servicing state wherein certain service routines are made available to the machine/repair personal, i.e. Tech Reps.

Referring particularly to FIG. 32 and Tables II, III, IV, V, VI and VII, the machine operator uses control console 800 to program the machine for the copy run desired. Programming may be done during either the System Not Ready (NRDY) or System Ready (RDY) states, although the machine will not operate during the System Not Ready state should START PRINT button 805 be pushed. The copy run includes selecting (using keyboard 808) the number of copies to be made, and such other ancilliary program features as may be desired, i.e. use of auxiliary paper tray 102, (push button 810), image size selection (push buttons 818, 819, 820), document handler/sorter selection (push buttons 822, 823, 825 826), copy density (push buttons 814, 815) etc. On completion of the copy run program, START PRINT button 805 is actuated to start the copy run programmed (presuming the READY lamp is on and an original or originals 2 have been placed in tray 233 of document handler 16 if the document handler has been selected).

With programming of the copy run instructions, controller 18 enters a Digit Input routine in which the program information is transferred to RAM section 546. The copy run program data passes via Main Panel Interface Module 526 to Input Matrix Module 524 and from there is addressed through Matrix Input Select 604, Multiplexer 624, and Buffers 620 of I/O Module 502 to RAM section 546 of CPU Module 500.

On entering PRINT STATE, a Run Event Table (FIG. 35) comprised of Foreground tasks is built for operating in cooperation with the Background tasks the various components of host machine 10 in an integrated manner to produce the copies programmed. The Run Event Table is formed by controller 18 through merger of a Fixed Pitch Event Table (TABLE II) (stored in ROM 545 and Non Volatile Memory 610) and a Variable Pitch Event Table (TABLE III) in a fashion appropriate to the parameters of the job selected.

The Fixed Pitch Event Table (TABLE II) is comprised of machine events whose operational timing is fixed during each pitch cycle such as the timing of bias to transfer roll 75, (TRN 2 CUPR), actuating toner concentration sensor 65 (ADC ACT), loading roll 161 of fuser 150 (FUS*LOAD), and so forth, irrespective of the particular copy run programmed. The Variable Pitch Table (TABLE III) is comprised of machine events whose operational timing varies with the individual copy run programmed, i.e. timing of pitch fade-out lamp 44 (FO*ONBSE), timing of flash illumination lamps 37 (FLSH BSE), etc. The variable Pitch Table is built by the Pitch Table Builder (TABLE IV) from the copy run information programmed in by controller 18 (using the machine control program stored in ROM section 545 and Non-Volatile Memory 610), coupled with event address information from ROM section 545, sorted by absolute clock count (Table V), and stored in RAM section 546 (TABLE VI). The Fixed Pitch Event Table and Variable Pitch Table are merged with the relative clock count differences between Pitch events calculated to form a Run Event Table (TABLE VII).

Referring particularly to FIG. 35, the Run Event Table consists of successive groups of individual events 851. Each event 851 is comprised of four data blocks, data block 852 containing the number of clock pulses (from machine clock 202) to the next scheduled pitch event (REL DIFF), data block 853 containing the shift register position associated with the event (REL SR), and data blocks 854, 855 (EVENT LO) (EVENT HI) containing the address of the event subroutine.

In machine states other than PRINT, data blocks 852, 853 (REL DIFF) (REL SR) are set to zero. Data blocks 854, 855 hold the address information for the non-Print state event.

Control data in the Run Event Table represents a portion of the foreground tasks and is transferred to the output buffer 546' of RAM memory section 546 by the Pitch Reset and Machine Clock interrupt routines. Other control data, representing foreground tasks not in the Run Event Table is transferred to RAM output buffer 546' by the Document Handler Clock and Real Time Clock interrupt routines. Transfer of the remainder of the control data to output buffer 546' is by means of background (non-interrupt) routines.

Transfer of control data from output buffer 546' of RAM memory section 546 to the various locations in host machine 10 is through output Refresh via Direct Memory Access (DMA) in response to machine clock interrupt signals as will appear. The interrupt routines are initiated by the respective interrupt signals 640, 641, 642, 643.

Referring particularly to FIGS. 23 and 35–37 and TABLES VII, the interrupt having the highest priority, the Pitch Reset interrupt signal 640, is operable only during the PRINT State, and occurs once each revolution of sheet register fingers 141 as responded to by sensor 146 of pitch reset clock 138. At each pitch reset interrupt signal, after a determination of priority by Priority Chip 659 in the event of multiple interrupt signals, an interrupt signal (INT) is generated. The acknowledgement signal (INTA) from processor 542 initiates the pitch reset interrupt routine.

On entering the pitch reset routine, the interrupt is re-enabled and the contents of the program working registers stored. A check is made to determine if building of the Run Event Table is finished. Also checks are made to insure that a new shift register value has been build and at least 910 clock counts since last pitch reset have elapsed. If not, an immediate machine shutdown is initiated.

Presuming that the above checks are satisfactory, the shift register pointer (SR PTR), which is the byte variable containing the address of a pre-selected shift register position (SR O), is decremented by one and adjusted for overflow and the shift register contents are updated with a byte variable (SR+VALUV) containing the new shift register value to be shifted in following the pitch reset interrupt. The event pointer (EV*PTR), a two byte variable containing the full address of the next scheduled event, is reset to Event #1. The count in the C register equals the time to the first event.

Machine Cycle Down, Normal Down, and Side One Delay checks are made, and if negative, the count on a cycle up counter (CYC UP CT) is checked. If the count is less than a predetermined control count (i.e. 5), the counter (CYC UP CT) is incremented by one. When the count on the cycle up counter equals the control count, an Image Made Flag is set.

If a Normal Down, Cycle Down, or Side One Delay has been initiated, the cycle up counter (CYC UP CT) is reset to a preset starting count (i.e. 2). The pitch reset interrupt routine is exited with restoration of the working registers and resetting of pitch reset flip flop 647.

The Machine Clock Interrupt routine, which is second in priority, is operative in all operational states of host machine 10. Although nominally driven by machine clock 202, which is operative only during Print state when processor main drive motor 34 is energized, machine clock pulses are also provided by phase locked loop 649 when motor 34 is stopped.

Referring particularly to FIG. 38 and TABLE IX entry to the Machine Clock interrupt routine there shown is on signal (INTA) from processor 542 following a machine clock interrupt signal 642 as described earlier. On entry, the event control register (CREG) is obtained and the working register contents stored. The C REG is decremented by one, the register having been previously set to a count corresponding to the next event in the Event Run Table.

The control register (C REG) is checked for zero. If the count is not zero and is an odd number, an output refresh cycle is initiated with a request for refresh (REFRESH) to Refresh Control 601. Refresh Control 601 generates a HOLD signal which when acknowledged by processor 542 (HOLD A) provides Direct Memory Access (D M A) to effect transfer/refresh of data in RAM output buffer 546' to host machine 10. If the number is even, or following an output refresh, the interrupt system is re-enabled, the machine clock interrupt flip flop 651 is reset and the working registers are restored. Return is then made to the interrupted routine.

If the control register (C REG) count is zero, the Event Pointer (EV*PTR), which identifies the clock count (in data block 852) for the next scheduled event (REL DIFF), is loaded and the control register (C REG) reset to a new count equal the time to the next event. The Event Pointer (EV*PTR) is incremented to the relative shift register address for the event (REL SR data block 853), and the shift register address information is set in appropriate shift registers (B, D, E, A registers).

The Event Pointer (EV*PTR) is incremented successively to the Event subroutine address information (EVENT LO) (EVENT HI) in the Event Run Table, and the address information therefrom loaded into a register pair (D and E registers). The Event Pointer (EV PTR) is incremented to the first data block (REL DIFF) of the next succeeding event in the Run Event Table, saved, and the register pair (H and L registers) that comprise the Event Pointer are loaded with the event subroutine address from the register pair (D and E registers) holding the information. The register pair (D and E registers) are set to the return address for the Event Subroutine. Using the address information, the Event Subroutine is called and the subroutine data transferred to RAM output buffer 546' for transfer to the host machine on the next Output Refresh.

Following this, the Machine Clock interrupt routine is exited as described earlier.

The Output Refresh cycle alluded to earlier functions, when entered, to transfer/refresh data from the output buffer of 546' RAM section 546 to host machine 10. Direct Memory Access (DMA) is used to insure a high data transfer rate.

On a refresh, Refresh Control 605 (see FIG. 23) raises the HOLD line to processor 542, which on completion of the operation then in progress, acknowledges by a HOLD A signal. With processor 542 in a hold mode and Address and Data buses 507, 508 released to I/O Module 502 (through operation of tri-state buffers 510, 511, 563, 570), the I/O module then sequentially accesses the output buffer 546' of RAM section 546 and transfers the contents thereof to host machine 10. Data previously transferred is refreshed.

The Document Handler interrupt routine operates only when document handler drive motor 236 is energized. The Document Handler interrupt is third in priority.

Referring particularly to FIG. 39 and TABLE X, the Document Handler interrupt routine is effected in the same manner as described earlier in connection with the Pitch Reset and Machine interrupts, entry being in response to a specific RESTART instruction code for this routine. On entry, the interrupt is enabled and the program registers stored. A control counter which counts clock counts between events is decremented and the count queried. Based on the count, the appropriate document handler routine (AD-STATE) is called. The registers are then restored and the Document handler interrupt re-enabled.

The Real Time Interrput, which carries the lowest priority, is active in all machine states. Primarily, the interrupt acts as an interval timer by decrementing a series of timers which in turn serve to control initiation of specialized background subroutines used for control and error checking purposes.

Referring particularly to FIG. 40 and TABLE XI, the Real Time interrupt routine is entered in the same manner as the interrupt routines previously described, entry being in response to a specific RESTART instruction code assigned to the Real Time interrupt. On entry, the interrupt is re-enabled and the register contents stored. The timer pointer (PNTR) for the first class of timers (i.e. 10 msec TIMERS) is loaded, and a loop counter identifying the number of timers of this class (i.e. 10 msec TIMERS) preset. A control register (E REG) is loaded and a timer decrementing loop is entered for the first timer. The loop decrements the particular timer, increments the timer pointer (PNTR) to the location of the next timer in this class, checks the timer count, and decrements the loop counter. The decrementing loop routine is repeated for each timer in the class (i.e. 10 msec TIMERS) following which a control counter (CNTR) for the second group of timers (i.e. 100 msec TIMERS) is decremented by one and the count checked.

The control counter (CNTR) is initially set to a count equal to the number of times the first timer interval is divisible into the second timer interval. For example, if the first class of timers are 10 msec timers and the second timer class are 100 msec timers, the control counter (CNTR) is set at 10 initially and decremented on each Real Time interrupt by one down to zero.

If the count on the control counter (CNTR) is not zero, the registers are restored, Real Time interrupt flip flop 856 reset, and the routine exited. If the count on the control counter is zero, the counter is reloaded to the original maximum count (i.e. 10) and a loop is entered decrementing individually the second group of timers (i.e. 100 msec TIMERS). On completion, the routine is exited as described previously.

In the following TABLES:

"*"—is used to indicate flags, counters and subroutine names.

"#"—is used to indicate output signals.

"$"—is used to indicate macro instructions, system subroutines, system flags, and data, etc.

":"—is used to indicate macro instructions, system subroutines, system flags, and data, etc.

TABLE I

| STATE CHECKER ROUTINE (STATCHK) |
|---|
| INITIALIZATION STATE BACKGROUND- PROLOG |

TABLE I-continued

STATE CHECKER ROUTINE (STATCHK)

```
001D6              INIT: EQU
                   INITIALIZATION STATE BACKGROUND- WHILE: LOOP
001D6   3A08FE     WHILE:      XBYT,STATE:,EQ,0     DO INIT LOOP WHILE COND EXISTS
001D9   FE00
001DB   C2EE01
001DE   CDF305     CALL        SELFTEST             CALL CONTROLLER SELF TEST SUBR
001E1   78         IF:         XBYT,B,EQ,0          DID CONTROLLER PASS SELF TEST
001E2   FE00
001E4   C2EB01
001E7   2108FE     INCBYT      STATE:               YES, MOVE TO NOT-READY STATE
001EA   34
                   ENDIF
001EB   C3D601     ENDWHILE
                   INITIALIZATION STATE BACKGROUND- EPILOG
001EE   2184F7     LXI         H,RDYFLGS:           H&L=ADDR OF FIRST RDY FLAG
001F1   060A       MVI         B,RDYFNUM:           B=NUMBER OF RDY FLAGS
001F3   1680       MVI         D,X'80'              D-REG TO SET FLAGS
001F5   78         WHILE:      XBYT,B,NE,0          DO LOOP = TO # IN B-REG
001F6   FE00
001F8   CA0102
001FB   72         MOV         M,D                  SET FLAG
001FC   23         INX         H                    H&L=ADDR OF NEXT FLAG
001FD   05         DCR         B                    DECR LOOP COUNTER
001FE   C3F501     ENDWHILE
                   LOOP TO SET ALL RDY FLAGS
00201   3E80       SFLG        2SD*ENAB
00203   325FF4
00206   3E80       SFLG        PROG*RDY             SET PROG ROUTINE READY
00208   3287F7
00208   3E80       SFLG        DSPL*SEL             INIT PROG TO DISPLAY QTY SELECT
0020D   3234F4
00210   2106FE     LXI         H,DIVD10:            H&L= ADDR OF 100 MSEC CNTR
00213   360A       MVI         M,10                 PRESET TO 10
00215   2120F8     LXI         H,TMRBASE:           H&L=ADDR OF 1ST 10 MSEC TIMER
00218   AF         XRA         A                    A=0 (SET 'Z' CONDITION CODE)
00219   C          ADI         TIMCNT1:+TIMCNT2:    A=TOTAL # OF TIMERS (10 & 100)
00218   1601       MVI         D,1                  SET ALL TIMERS TO TERMINAL CNT
0021D   CA2602     WHILE       CC,Z,C               WHILE # TIMERS .NE. 0...
00220   72         MOV         M,D                  HALT THE PRESENT TIMER
00221   23         INX         H                    MOVE TO NEXT TIMER LOC
00222   3D         DCR         A                    DECRM LOOP CNTR (# OF TIMERS)
00223   C31D02     ENDWHILE
00226   2121F7     LXI         H,FLT*TBL            INITIALIZE WHERE FLT HANDLER
00229   2279F8     SHLD        FLT*ADDR             STARTS TO LOOK FOR FAULTS
0022C   3E80       SYLG        FLT*TOP              USED TO INITIALIZE FAULT VALUE
0022E   325EF4
00231   21CB01     LXI         H,EV*STBY:           H&L= ADDR OF STBY EVENT TABLE
00234   2250F8     SHLD        EV*PTR:              SAVE FOR MACH CLK ROUTINE
00237   2EF0       MVI         A,X'FO'              LOAD 'RESET INTERRUPTS' DATA
00239   3200E6     STA         RSINTFF:             RESET ALL INTERRUPT FLIP-FLOPS
0023C   FB         EI                               ENABLE INTERRUPT SYSTEM
0023D   21DCFF     SOBIT       PFO$OFF              TURN OFF PITCH FADE-OUT LAMP
0024D   3E20
00242   F3
00243   B6
00244   77
00245   FB
00246   2131FF     SOBIT       24V$SPL              TURN ON 24 VOLT SUPPLY
00249   3E20
0024B   F3
0024C   B6
0024D   77
0024E   FB
0024F   3E47       STIM        ILK*TIME,7000        SET BLOWER START-UP DELAY
00251   322FF8
00254   C9         RET                              RETURN TO STATE CHECKER
                   SYSTEM NOT-READY STATE BACKGROUND- PROLOG
0032C   DC5C03     NRDY:CALL   NRDY:SSL             DO SLW-SCAN BKGD AT LEAST ONCE
                   SYSTEM NOT-READY STATE BACKGROUND- WHILE: LOOP
00255   3A08FE     NRDY: WHILE:  XBYT,STATE:,EQ,1   DO NRDY LOOP WHILE COND EXISTS
00258   FE01
0025A   C28002
0025D   CD2C06     CALL        STBYBKG:             CALL COMMON STBY BKGND SUBRIS
00260   CD4B06     CALL        DELAY
00263   CD0000     CALL        FLT*DISP             DISPLAY FAULT CODE
00266   CD0000     CALL        RED*BGND             CONTROL LENS IN NRDY: STATE
00269   CD0000     CALL        SOS*SUS              SOS JAM DETECTION
0026C   CD0000     CALL        BLK*NRDY             BLINK THE WAIT LAMP
0026F   CD205      CALL        RDYTEST:             CALL READY CONDITION TEST SUBR
00272   3A09F4     IF:         FLG,ALL*RDY,T        ARE ALL READY CONDITIONS OK
```

TABLE I-continued

STATE CHECKER ROUTINE (STATCHK)

```
00275   07
00276   D27D02
00279   2108FE   INCBYT        STATE:          YES, MOVE TO RDY STATE
0027C   34
                 ENDIF
0027D   C35502   ENDWHILE
                 SYSTEM NOT-READY STATE BACKGROUND. EPILOG
00280   21E9FF   COBIT         WAIT$           TURN OFF WAIT LAMP
00283   3EFE
00285   FE
00286   A6
00287   77
00288   FB
00289   C9       RET                            RETURN TO STATE CHECKER
                 SYSTEM READY STATE BACKGROUND- PROLOG
0028A   21E7FF   RDY: SOBIT    READY$          TURN OFF READY LAMP
0028D   3E01
0028F   F3
00290   B6
00291   77
00292   FB
00293   AF       CFLG          STRT:PRT        DISALLOW PRINT UNTIL SWSK CALLS
00294   324EF4
                 SYSTEM READY STATE BACKGROUND. WHILE: LOOP
00297   3A08FE   WHILE:        XBYT,STATE:,EQ,2  DO RDY LOOP WHILE COND EXISTS
0029A   FE02
0029C   C2C602
0029F   CD2C06   CALL          STBYBKG:        CALL COMMON STBY BKGND SUBRIS
002A2   CD4B06   CALL          DELAY
002A5   CD0000   CALL          SFT*CALC        CALC SHIFTED IMAGE VALUES
002A8   CDD205   CALL          RDYTEST:        CALL READY CONDITION TEST SUBR
002AB   2108FE   LXI           H,STATE:        H&L= ADDR OF STATE:
002AE   3A09F4   IF:           FLG,ALL*RDY,F   ARE ALL READY CONDITIONS OK
002B1   07
002B2   DABA02
002B5   3601     MVI           M,1             NO, LOAD 1 INTO STATE: (NRDY)
002B7   C3C302   ELSE:                         ALL READY CONDITIONS MET
002BA   3A4EF4   IF:           FLG,STRT:PRT,T  HAS 'START PRINT' BEEN PUSHED
002BD   07
002BE   D2C302
002C1   3603     MVI           M,3             YES, LOAD 3 INTO STATE: (PRINT)
                 ENDIF
                 ENDIF
002C3   C39702   ENDWHILE
                 SYSTEM READY STATE BACKGROUND- EPILOG
002C6   21E7FF   COBIT         READY$          TURN OFF READY LAMP
002C9   3EFE
002CB   F3
002CC   A6
002CD   77
002CE   FB
002CF   C9       RET                            RETURN TO STATE CHECKER
                 PRINT STATE BACKGROUND- PROLOG 1
002D0   AF       PRINT: XRA    A               CLR A-REG FOR USE AS CN3R
002D1   47       MOV           B,A             CLR B-REG (O'S INTO SHIFTREG)
002D2   2100F8   LXI           H,SHIFTREG      H&L= START ADDR OF SHIFTREG
002D5   FE20     WHILE:        XBYT,A,LT,32    WHILE STILL IN SR...(CLR SR)
002D7   D2E002
002DA   70       MOV           M,B             CLR PRESENT SR LOCATION
002DB   23       INX           H               MOVE TO NEXT SR LOCATION
002DC   3C       INR           A               INCRM LOOP CNTR
002DD   C3D502   ENDWHILE
002E0   3E80     SFLG          910*DONE        ALLOW FIRST PITCH RESET
002E2   3260F4
002E5   3E80     SFLG          SRSK*FLG        SIGNAL NEW SR VALUE REQ'D
002E7   321CF4
002EA   AF       XRA           A
002EB   3207FE   STA           CYCUPCT:        INIT CYCLE-UP CNTR TO 0
002EE   3205FE   STA           SR*VALU:        INIT 'NEW SR VALUE' TO 0
002F1   3E03     MVI           A,3
002F3   320AFE   STA           NOIMGCT:        INIT 'NO IMAGE CNTR' TO 3
002F6   CD0000   CALL          SRSK            SHIFT REG SCHEDULER (INIT SR#0)
002F9   CD0000   CALL          TBLD*PRT        BUILD NEW PITCH TABLE
002FC   3E51     STIM          SYS:TIMR,800    INIT 'OVER-RUN EVENT' TIMER
002FE   3221F8
00301   21F5FF   SOBIT         PRNT$RLY        TURN ON PRINT RELAY (PRINT)
00304   3E08
00306   F3
00307   B6
00308   77
```

TABLE I-continued

STATE CHECKER ROUTINE (STATCHK)

| | | | | |
|---|---|---|---|---|
| 00309 | FB | | | |
| 0030A | 21DCFF | COBIT | PFO$OFF | TURN ON FADE-OUT LAMP |
| 0030D | 3EDF | | | |
| 0030F | F3 | | | |
| 00310 | A6 | | | |
| 00311 | 77 | | | |
| 00312 | FB | | | |
| 00313 | AF | CFLG | NORM*DN: | CLR NORMAL SHUTDOWN REQUEST |
| 00314 | 3210F4 | | | |
| 00317 | AF | CFLG | SK1*DLY | CLR SIDE 1 DELAY FLAG |
| 00318 | 3216F4 | | | |
| 0031B | AF | CFLG | TIME*DN: | CLR TIMED SHUTDOWN REQUEST FLAG |
| 0031C | 324BF7 | | | |
| 0031F | AF | CFLG | IMGMADE: | CLR 1st IMAGE MADE FLAG |
| 00320 | 320FF4 | | | |
| 00323 | AF | CFLG | CYCL*DN: | CLR CYCLE-DOWN REQUEST FLAG |
| 00324 | 3249F7 | | | |
| 00327 | AF | CFLG | IMED*DN: | CLR IMMED SHUTDOWN REQUEST FLAG |
| 00328 | 324AF7 | | | |
| 0032B | AF | CFLG | SD1*TIMO | CLR SIDE 1 TIME OUT FLAG |
| 0032C | 3207F4 | | | |
| 0032F | AF | CFLG | PROC*JAM | CLEAR IN CASE THERE WAS A JAM |
| 00339 | CD0000 | CALL | PAP*SIZE CHECK PAPER WIDTH FOR FUSER | |
| 0033C | CD0000 | CALL | PROG*UP | PROG INITIALIZATION SUBR |
| 0033F | CD0000 | CALL | CLBK*SPR | COLOR BKGRD HI BIAS AT SRT PRT |
| 00342 | CD0000 | CALL | SET*UP | INITIALIZE ITEMS FOR PAPER PATH |
| 00345 | CD0000 | CALL | FDR*PRT | CHECK FEEDER SELECTION |
| CALL | CALL | | | |
| TO | TO | | | |
| ED- | PAP*- | | | |
| GE*FB | SIZE | | | |
| MUST | | | | |
| BE | | | | |
| AFTER | | | | |
| 00348 | CD0000 | CALL | EDGE*FO | DETERMINE WHICH EDGE FADE OUT |
| | | | PRINT STATE BACKGROUND- WHILE: LOOP | |
| 0034B | 3A08FE | WHILE: | XBYT,STATE:,EQ,3 | DO PRINT WHILE COND EXISTS |
| 0034E | FE03 | | | |
| 00350 | C27404 | | | |
| 00353 | 3A07FE | IF: | XBYT,CYCUPCT:,EQ,3 | IS CYCLE-UP CNTR= 3 |
| 00356 | FE03 | | | |
| 00358 | C26303 | | | |
| 00358 | 3E80 | SFLG | PRT*PRO2 | YES, SET 'PRINT PROLOG 2' FLAG |
| 0035D | 3220F4 | | | |
| 00360 | C37D03 | ORIF: | XBYT,A,EQ,4 | NO, IS CYCLE-UP CNTR= 4 |
| 00363 | FE04 | | | |
| 00365 | C27D03 | | | |
| 00368 | 3A20F4 | ANDIF: | FLG,PRT*PRO2,T | YES, AND IS PROLOG 2 FLAG SET |
| 0036B | 07 | | | |
| 0036C | D27D03 | | | |
| 0036F | AF | CFLG | PRT*PRO2 | YES, DO PROLOG 2 AND CLR FLAG |
| 00370 | 3220F4 | | | |
| | | | PRINT STATE BACKGROUND- PROLOG 2 | |
| 00373 | 3A0FF4 | IF: | FLG,IMGMADE:,T | HAS 1ST IMAGE BEEN MADE |
| 00376 | 07 | | | |
| 00377 | D27D03 | | | |
| 0037A | CD0000 | CALL | PROG*UP | YES,CALL PROG INITIALIZATION |
| | | ENDIF | | |
| | | ENDIF | | |
| 0037D | CD0000 | CALL | SRSK | SHIFT REG SCHEDULER SUBR |
| 00380 | CD0000 | CALL | PRT*SWS | PRINT SWITCH SCAN SUBR |
| 00389 | CD4B06 | CALL | DELAY | |
| 0038C | CD0000 | CALL | READY*CK | CONTROL READY LAMP IN PRINT |
| 0038F | CD0000 | CALL | DSPL*CTL | CONTROL DIGITAL DISPLAY |
| 00392 | CD0000 | CALL | RLTIM*DO | COMPLETE PROG PITCH EVENTS |
| 00395 | CD0000 | CALL | FUS*RDUT | TEST FUSER FOR UNDER-TEMP |
| 00398 | CD0000 | CALL | OIL*MSFD | STOP OIL IF MISFEED |
| 0039B | CD0000 | CALL | SOS*JMDT | SOS PRT JAM CHECK |
| 003A1 | CD0000 | CALL | MANL*DN | CHECK MANUAL DN SW |
| 003A4 | CD0000 | CALL | NM*ELV*P | MONITOR MAIN TRAY IN PRINT |
| 003A7 | CD0000 | CALL | TON*DIS | TONER DISPENSE ROUTINE |
| 003AA | CD0000 | CALL | DVLMB*JM | DVL OPERATION IF MISFEED |
| 003AD | CD0000 | CALL | SETJ6TOG | CHECK JAM6 FOR EXIT OF COPY |
| 003B0 | CD0000 | CALL | FDR*BK*R | RESET FEEDER HARDWARE |
| 003B3 | CD0000 | CALL | FDR*BKF1 | 1ST SHEET FAULT DETECT (FDR) |
| 003B6 | CD0000 | | | |
| 003B9 | 2108FE | LXI | H,STATE: | H&L= ADDR OF STATE: BYTE |
| 003BC | 3A4AF7 | IF: | FLG,IMED*DN:,T | IS IMMED SHUTDOWN REQUESTED |
| 003BF | 07 | | | |
| 003C0 | D2C703 | | | |

TABLE I-continued

STATE CHECKER ROUTINE (STATCHK)

| | | | | |
|---|---|---|---|---|
| 003C3 | 34 | INR | M | YES, MOVE TO RUNNPRT: STATE |
| 003C4 | C34B04 | ELSE: | | IMMED SHUTDOWN NOT REQUESTED |
| 003C7 | 3A0AFE | LDA | NOIMGCT: | PREPARE TO TEST 'NO IMAGE CNTR' |
| 003CA | 47 | MOV | B,A | B=<NO IMAGE CNTR> |
| 003CB | 3A49F7 | IF: | FLG,CYCL*DN:,T | IS CYCLE-DOWN REQUESTED |
| 003CE | 07 | | | |
| 003CF | D2F803 | | | |
| 003D2 | 3A0FF4 | IF: | FLG,IMGMADE:,F | YES, HAS 1ST IMAGE BEEN MADE |
| 003D5 | 07 | | | |
| 003D6 | DADD03 | | | |
| 003D9 | 34 | INR | M | NO, MOVE TO RUNNPRT: STATE |
| 003DA | C3F503 | ORIF: | FLG,SD1*TIMEO,T | IS PROC MAKING SIDE 1'S - DUPLEX |
| 003DD | 3A07F4 | | | |
| 003E0 | 07 | | | |
| 003E1 | D2EE03 | | | |
| 003E4 | 78 | IF: | XBYT,B,GE,16 | YES, WERE THERE>15 NO IMAGES |
| 003E5 | FE10 | | | |
| 003E7 | DAEB03 | | | |
| 003EA | 34 | INR | M | YES, MOVE TO RUNNPRT: STATE |
| | | ENDIF | | |
| 003EB | C3F503 | ORIF: | XBYT,B,GE,13 | WERE THERE>12 NO IMAGES |
| 003EE | 78 | | | |
| 003EF | FE0D | | | |
| 003F1 | DAF503 | | | |
| 003F4 | 34 | INR | M | YES, MOVE TO RUNNPRT: STATE |
| | | ENDIF | | |
| 003F5 | C34B04 | ORIF: | FLG,NORM*DN:,T | IS A NORMAL SHUTDOWN REQUESTED |
| 003F8 | 3A10F4 | | | |
| 003FB | 07 | | | |
| 003FC | D20A04 | | | |
| 003FF | 3A0FF4 | ANDIF: | FLG,IMGMADE:,F | YES, AND ARE 0 IMAGES FLASHED |
| 00402 | 07 | | | |
| 00403 | DA0A04 | | | |
| 00406 | 34 | INR | M | YES, MOVE TO RUNNPRT: STATE |
| 00407 | C34B04 | ORIF: | FLG,SD1*TIMO,T | IS PROC MAKING SIDE 1'S- DUPLEX |
| 0040A | 3A07F4 | | | |
| 0040D | 07 | | | |
| 0040E | D22C04 | | | |
| 00411 | 3A39F4 | IF: | FLG,ADH*MUTF,F | YES, IS ADH IN MULT FEED MODE |
| 00414 | 07 | | | |
| 00415 | DA2204 | | | |
| 00418 | 78 | IF: | XBYT,B,GE,36 | NO, WERE THERE>35 NO IMAGES |
| 00419 | FE24 | | | |
| 00418 | DA1F04 | | | |
| 0041E | 34 | INR | M | YES, MOVE TO RUNNPRT: STATE |
| | | ENDIF | | |
| 0041F | C32904 | ELSE: | | |
| 00422' | 78 | IF: | XBYT,B,GE,16 | WERE THERE>15 NO IMAGES |
| 00423 | FE10 | | | |
| 00425 | DA2904 | | | |
| 00428 | 34 | INR | M | YES, MOVE TO RUNNPRT: STATE |
| | | ENDIF | | |
| | | ENDIF | | |
| 00429 | C34B04 | ORIF: | FLG,ADH*MUTF,F | IS ADH NOT IN MULTIPLE FEED |
| 0042C | 3A39F4 | | | |
| 0042F | 07 | | | |
| 00430 | DA4404 | | | |
| 00433 | 3A38F4 | ANDIF: | FLG,ADH*SINF,F | YES, AND IS IT NOT IN SINGLE |
| 00436 | 07 | | | |
| 00437 | DA4404 | | | |
| 0043A | 78 | IF: | XBYT,B,GE,21 | NO, WERE THERE>20 NO IMAGES |
| 0043B | FE15 | | | |
| 0043D | DA4104 | | | |
| 00440 | 34 | INR | M | YES, MOVE TO RUNNPRT: STATE |
| | | ENDIF | | |
| 00441 | C34B04 | ELSE: | | ADH IS SELECTED |
| 00444 | 78 | IF: | XBYT,B,GE,13 | WERE THERE>12 NO IMAGES |
| 00445 | FEOD | | | |
| 00447 | DA4B04 | | | |
| 0044A | 34 | INR | M | YES, MOVE TO RUNNPRT: STATE |
| | | ENDIF | | |
| | | ENDIF | | |
| | | | PRINT STATE BACKGROUND-EPILOG | |
| 0044B | 3A10F4 | IF: | FLG,NORM*DN:,F | IS NORMAL SHUTDOWN REQUESTED |
| 0044E | 07 | | | |
| 0044F | DA6304 | | | |
| 00452 | 3A49F7 | ANDIF: | FLG,CYCL*DN:,F | NO, IS CYCLE-DOWN REQUESTED |
| 00455 | 07 | | | |
| 00456 | DA6304 | | | |
| 00459 | 3A16F4 | ANDIF: | FLG,SD1*DLY,F | NO, IS PROC DEAD CYCLING |
| 0045C | 07 | | | |

TABLE I-continued

STATE CHECKER ROUTINE (STATCHK)

| | | | | |
|---|---|---|---|---|
| 0045D | DA6304 | | | |
| 00460 | C37104 | ELSE: | | 1 OR BOTH COND'S REQUESTED |
| 00463 | 3E02 | MVI | A,2 | LOAD 2 INTO CYCLE-UP CNTR TO |
| 00465 | 3207FE | STA | CYCUPCT: | FORCE THE CYCLE-UP MODE AGAIN |
| 00468 | 21DAFF | COBIT | ILLM$SPL | ILLM SPL OFF DURING DEAD CYCLE |
| 0046B | 3EF7 | | | |
| 0046D | F3 | | | |
| 0046E | A6 | | | |
| 0046F | 77 | | | |
| 00470 | FB | | | |
| | | ENDIF | | |
| 00471 | C34B03 | ENDWHILE | | |
| 00474 | 21D5FF | COBIT | PRNT$RLY | TURN OFF PRINT RELAY |
| 00477 | 3EF7 | | | |
| 00479 | F3 | | | |
| 0047A | A6 | | | |
| 0047B | 77 | | | |
| 0047C | FB | | | |
| 0047D | AF | CFLG | TBLD*FIN | SIGNAL NEW PITCH TABLE REQ'D |
| 0047E | 325DF4 | | | |
| 00481 | 21CB01 | LXI | H,EV*STBY: | H&L= ADDR STBY EVENT TABLE |
| 00484 | 2250F8 | SHLD | EV*PTR: | SAVE FOR MACH CLK ROUTINE |
| 00487 | 21DCFF | COBIT | PFO$OFF | TURN OFF FADE-OUT LAMP |
| 0048A | 3EDF | | | |
| 0048C | F3 | | | |
| 0048D | A6 | | | |
| 0048E | 77 | | | |
| 0048F | FB | | | |
| 00490 | 21EEFF | COBIT | EF0$11 | CLEAR 11 IN EDGE FADE-OUT LAMP |
| 00493 | 3EF7 | | | |
| 00495 | F3 | | | |
| 00496 | A6 | | | |
| 00497 | 77 | | | |
| 00498 | FB | | | |
| 00499 | 21D9FF | COBIT | EFO$12$5 | CLEAR 12.5 IN EDGE FADE-OUT |
| 0049C | 3EF7 | | | |
| 0049E | F3 | | | |
| 0049F | A6 | | | |
| 004A0 | 77 | | | |
| 004A1 | FB | | | |
| 004A2 | CD0000 | CALL | FUSNTRDY | TURN OFF FUSER STUFF |
| 004A5 | CD0000 | CALL | SOS*STBY | CLEAR SOS ENABLE |
| 004A8 | 21EEFF | COBIT | DTCK$EDG | |
| 004AB | 3EBF | | | |
| 004AD | F3 | | | |
| 004AE | A6 | | | |
| 004AF | 77 | | | |
| 004B0 | FB | | | |
| 004B1 | 21F6FF | COBIT | XER$CURR | TURN OFF TRANSFER CIRCUIT |
| 004B4 | 3EBF | | | |
| 004B6 | F3 | | | |
| 004B7 | A6 | | | |
| 004B8 | 77 | | | |
| 004B9 | FB | | | |
| 004BA | 21F0FF | COBIT | XER$LOAD | RELEASE TRANSFER ROLL |
| 004BD | 3EDF | | | |
| 004BF | F3 | | | |
| 004C0 | A6 | | | |
| 004C1 | 77 | | | |
| 004C2 | FB | | | |
| 004C3 | 21F3FF | COBIT | AX$WT | TURN OFF AUXILIARY TRAY WAIT |
| 004C6 | 3EFD | | | |
| 004C8 | F3 | | | |
| 004C9 | A6 | | | |
| 00004CA | 77 | | | |
| 004CB | FB | | | |
| 004CC | 21F4FF | COBIT | MN$WT | TURN OFF MAIN TRAY WAIT |
| 004CF | 3EFD | | | |
| 004D1 | F3 | | | |
| 004D2 | A6 | | | |
| 004D3 | 77 | | | |
| 004D4 | FB | | | |
| 004D5 | 21FBFF | COBIT | AXFD$INT | TURN OFF AUXILIARY FEEDER |
| 004D8 | 3EFD | | | |
| 004DA | F3 | | | |
| 004DB | A6 | | | |
| 004DC | 77 | | | |
| 004DD | FB | | | |
| 004DE | 21FAFF | COBIT | MNFD$INT | TURN OF MAIN FEEDER |
| 004E1 | 3EFD | | | |
| 004E3 | F3 | | | |

TABLE I-continued

STATE CHECKER ROUTINE (STATCHK)

```
004E4   A6
004E5   77
004E6   FB
004E7   21DAFF  COBIT          ILLM$SPL          TURN OFF ILLUMINATION LAMP SUPPLY
004EA   3EF7
004EC   F3
004ED   A6
004EE   77
004EF   FB
004F0   CD0000  CALL           DVL*NRDY          TURNS OFF DVL IF JAM
004F3   C9      RET                              RETURN TO STATE CHECKER
                SYSTEM RUNNING, NOT PRINT STATE BACKGROUND- WHILE: LOOP
004F4   3A08FE  RUNNPRT WHILE: XBYT,STATE:,EQ,4  DO RUNNPRT WHILE COND EXISTS
004F7   FE04
004F9   C28805
004FC   CD0000  CALL           READY*CK          CONTROL READY LAMP IN RUNNPRT:
004FF   CD0000  CALL           DSPL*CTL          CONTROL DIGITAL DISPLAY
00502   CD0000  CALL           RLTIM*DO          COMPLETE PROG PITCH EVENTS
00505   CD0000  CALL           ILK*CK
00508   CD0000  CALL           RILK*CK
00508   CD0000  CALL           FUS*RDUT          TEST FUSER FOR UNDER-TEMP
0050E   CD0000  CALL           MANL*DN           CHECK MANUAL DN SW
00511   CD0000  CALL           MN*ELV*S          MONITORS MAIN TRAY IN SDBY
00514   CD4B06  CALL           DELAY
00517   CD0000  CALL           SETJ6TOG          CHECK JAM6 SW FOR EXIT OF COPY
0051A   3A58F4  IF:            FLG,SRT*SETF,T    IS SRT SELECTED (SETS MADE)
0051D   07
0051E   D23205
00521   3A6EF4  ANDIF:         FLG,SRT*COPY,F    YES, AND ARE SRT COPIES ,NE.0
00524   07
00525   DA3205
00528   3A6CF4  ANDIF:         FLG,SRT*JAM,F     YES, AND IS SRT JAM-FREE
0052B   07
0052C   DA3205
                ALL TESTS PASSED- STAY IN RUNNPRT: STATE
0052F   C38505  ORIF:          FLG,SRT*STKF,T    IS SRT SELECTED (STKS MODE)
00532   3A59F4
00535   07
00536   D24A05
00539   3A6EF4  ANDIF:         FLG,SRT*COPY,F    YES, AND ARE SRT COPIES ,NE.0
0053C   07
0053D   DA4A05
00540   3A6CF4  ANDIF:         FLG,SRT*JAM,F     YES, AND IS SRT JAM-FREE
00543   07
00544   DA4A05
                ALL TESTS PASSED- STAY IN RUNNPRT: STATE
00547   C38505  ORIF:          FLG,SD1*TIMO,T    ARE SIDE 1 COPIES GOING TO AUX
0054A   3A07F4
0054D   07
0054E   D25C05
00551   3AF1FF  ANDIF:         OBIT,RET$MOT,T    YES, AND IS RETURN PATH MOTOR ON
00554   E608
0556    CA5C05
                ALL TESTS PASSED- STAY IN RUNNPRT: STATE
00559   C38505  ORIF:          FLG,SYS:TIME,T    HAS TIMER BEEN INITIATED (PLL
0055C   3A1FF4
0055F   07
00560   D27305                                   UNLOCKED LAST TIME THRU)
00563   3A21F8  IF:            TIM,SYS:TIMR,L    YES, IS TIMER TIMED OUT
00566   D601
00568   C27005
0056B   3E01    MVI            A,1               YES, LOAD 1 INTO STATE: FORCING
0056D   3208FE  STA            STATE:            MOVE TO NRDY STATE
                ENDIF
00570   C38505  ORIF:          XBYT,RIS#BYT,AND,PLL,NZ TIMER NOT USED: IS PLL LOCKED
00573   3A0036
00576   E610
00578   CA8505
00578   3E1F    STIM           SYS:TIMR,300      NO, SET TIMER TO 300 MSEC
0057D   3221F8
00580   3E80    SFLG           SYS:TIMF          SET 'TIMER IN USE' FLAG
00582   321FF4
                ENDIF
00585   C3F404  ENDWHILE
                SYSTEM RUNNING, NOT PRINT STATE BACKGROUND-EPILOG
00588   CD0000  CALL           DEL*CK            CALC COPIES DELIVERED INFO
00588   21F3FF  COBIT          FUS$TRAP          INSURE FUSER TRAP SOL OFF
0058E   3EDF
00590   F3
```

TABLE I-continued

| STATE CHECKER ROUTINE (STATCHK) | | | | |
|---|---|---|---|---|
| 00591 | A6 | | | |
| 00592 | 77 | | | |
| 00593 | FB | | | |
| 00594 | C9 | RET | | RETURN TO STATE CHECKER |
| | | TECH REP STATE BACKGROUND- WHILE: LOOP | | |
| 00595 | 3A08FE | TECHREP: WHILE | XBYT,STATE:,EQ,5 | DO TECHREP WHILE COND EXISTS |
| 00598 | FE05 | | | |
| 0059A | C2AB05 | | | |
| 0059D | CD0000 | CALL | ILK*CK | |
| 005A0 | CD0000 | CALL | NRILK*CK | |
| 005A3 | 3E01 | MVI | A,1 | LOAD 1 INTO STATE: TO FORCE A |
| 005A5 | 3208FE | STA | STATE: | CHANGE TO NRDY STATE |
| 005A8 | C39505 | ENDWHILE | | |
| 005AB | C9 | RET | | RETURN TO STATE CHECKER |

TABLE II

| FIXED PITCH EVENT TABLE | | | | |
|---|---|---|---|---|
| 0001E | 0200 | EVENT | 2,3,TRN2CUPR | |
| 00020 | 03 | | | |
| 00021 | 0000 | | | |
| 00023 | 0300 | EVENT | 3,2,ADC*ACT | |
| 00025 | 02 | | | |
| 00026 | 0000 | | | |
| 00028 | 0700 | EVENT | 7,0,SPLYS*ON | |
| 0002A | 00 | | | |
| 0002B | 0000 | | | |
| 0002D | 0A00 | EVENT | 10,2,FUS*LOAD | |
| 0002F | 02 | | | |
| 00030 | 0000 | | | |
| 00032 | 3000 | EVENT | 48,8,DECG*INV | DECISION GATE FOR INVTD COPIES |
| 00034 | 08 | | | |
| 00035 | 0000 | | | |
| 00037 | 3600 | EVENT | 54,5,FUS*NTLD | FUSER LOADED TEST |
| 00039 | 05 | | | |
| 0003A | 0000 | | | |
| 0003C | 3C00 | EVENT | 60,3,FDR6MELT | CHECK IF MAIN FDR STILL ON |
| 0003E | 03 | | | |
| 0003F | 0000 | | | |
| 00041 | 4000 | EVENT | 64,2,FDR2MNFD | MAIN FEED TIME |
| 00043 | 02 | | | |
| 00044 | 0000 | | | |
| 00046 | 5D00 | EVENT | 93,8, JAM6*NON | PAPER PATH JAM SW PITCH EVENT |
| 00048 | 08 | | | |
| 00049 | 0000 | | | |
| 0004B | 7600 | EVENT | 118,9,JAM5*INV | PAPER PATH MAM SW PITCH EVENT |
| 0004D | 09 | | | |
| 0004E | 0000 | | | |
| 00050 | 7800 | EVENT | 120,0,FSH*OFF | |
| 00052 | 00 | | | |
| 00053 | 0000 | | | |
| 00055 | 8200 | EVENT | 130,0,FLASHING | |
| 00057 | 00 | | | |
| 00058 | 0000 | | | |
| 0005A | 8700 | EVENT | 135,0,PROG&HST | PROG HISTORY FILE UPDATE |
| 00u5C | 00 | | | |
| 0005D | 0000 | | | |
| 0005F | 8F00 | EVENT | 143,6,JAM4&CHK | PAPER PATH JAM SW PITCH EVENT |
| 00061 | 06 | | | |
| 00062 | 0000 | | | |
| 00064 | AA00 | EVENT | 170,10,RET2*CHK | PAPER PATH JAM SW PITCH EVENT |
| 00066 | 0A | | | |
| 00067 | 0000 | | | |
| 00069 | CF00 | EVENT | 207,3,SOS*CLN | |
| 0006B | 03 | | | |
| 0006C | 0000 | | | |
| 0006E | D100 | EVENT | 209,2,TRN5CURR | |
| 00070 | 02 | | | |
| 00071 | 0000 | | | |
| 00073 | E300 | EVENT | 227,5,JAM*CHK | PAPER PATH JAM SW PITCH EVENT |
| 00075 | 05 | | | |
| 00076 | 0000 | | | |
| 00078 | 0901 | EVENT | 265,2,FDR3EDG | ENABLE AUX EDR WT SENSOR |
| 0007A | 02 | | | |
| 0007B | 0000 | | | |
| 0007D | 0B01 | EVENT | 267,4,JAM2*CHK | PAPER PATH JAM SW PITCH EVENT |
| 0007F | 04 | | | |
| 00080 | 0000 | | | |
| 00082 | 0E01 | EVENT | 270,8,RET1*CHK | PAPER PATH JAM SW PITCH EVENT |

TABLE II-continued

FIXED PITCH EVENT TABLE

| | | | | |
|---|---|---|---|---|
| 00084 | 08 | | | |
| 00085 | 0000 | | | |
| 00087 | 4201 | EVENT | 322,0,200US | |
| 00089 | 00 | | | |
| 0008A | 0000 | | | |
| 0008C | 6901 | EVENT | 361,3,TRN3DTCK | |
| 0008E | 03 | | | |
| 0008F | 0000 | | | |
| 00091 | 6C01 | EVENT | 364,2,FDR4MFDG | ENABLE MAIN WT SENSOR |
| 00093 | 02 | | | |
| 00094 | 0000 | | | |
| 00096 | 7A01 | EVENT | 378,0,DVLMR418 | |
| 00098 | 00 | | | |
| 00099 | 0000 | | | |
| 0009B | B901 | EVENT | 441,9,JAM6*INV | PAPER PATH JAM SW PITCH EVENT |
| 0009D | 09 | | | |
| 0009E | 0000 | | | |
| 000A0 | C201 | EVENT | 450,4,FUS*UNLD | |
| 000A2 | 04 | | | |
| 000A3 | 0000 | | | |
| 000A5 | C301 | EVENT | 451,2,TRN1ROLL | |
| 000A7 | 02 | | | |
| 000A8 | 0000 | | | |
| 000AA | F401 | EVENT | 500,0,SMPL*ON | |
| 000AC | 00 | | | |
| 000AD | 0000 | | | |
| 000AF | F501 | EVENT | 501,0,SMPL*OFF | |
| 000B1 | 00 | | | |
| 000B2 | 0000 | | | |
| 000B4 | 0F02 | EVENT | 526,3,TRN4DICK | |
| 000B6 | 03 | | | |
| 000B7 | 0000 | | | |
| 000B9 | 2602 | EVENT | 550,0,200US | |
| 000BB | 00 | | | |
| 000BD | 0000 | | | |
| 000BE | 5802 | EVENT | 600,0,BIL*PLOP | TEST FOR PLATEN OPEN (BLG) |
| 000C0 | 00 | | | |
| 000C1 | 0000 | | | |
| 000C3 | 7602 | EVENT | 630,5,INVTRCTL | INVTR GATE & RETURN CONTROL |
| 000C5 | 05 | | | |
| 000C6 | 0000 | | | |
| 000C8 | 8A02 | EVENT | 650,6,DECG*NON | DECISION GATE FOR NON-INVTD |
| 000CA | 06 | | | |
| 000CB | 0000 | | | |
| 000CD | 9A02 | EVENT | 660,0,JAM*DLY | |
| 000CF | 00 | | | |
| 000D0 | 0000 | | | |
| 000D2 | BC02 | EVENT | 700,7,JAM5*NON | PAPER PATH JAM SW PITCH EVENT |
| 000D4 | 07 | | | |
| 000D5 | 0000 | | | |
| 000D7 | E702 | EVENT | 743,0,200US | |
| 000D9 | 00 | | | |
| 000DA | 0000 | | | |
| 000DC | EE02 | EVENT | 750,0,200US | |
| 000DE | 00 | | | |
| 000DF | 0000 | | | |
| 000E1 | 1C03 | EVENT | 796,0,200US | |
| 000E3 | 00 | | | |
| 000E4 | 0000 | | | |
| 000E6 | 2003 | EVENT | 800,0,PROGMODE | |
| 000E8 | 00 | | | |
| 000E9 | 0000 | | | |
| 000EB | 2203 | EVENT | 802,0,FSH*FNB | |
| 000ED | 00 | | | |
| 000EE | 0000 | | | |
| 000F0 | 5203 | EVENT | 850,4,SRSK&EV | INIT SRSK & SRT MOTOR |
| 000F2 | 04 | | | |
| 000F3 | 0000 | | | |
| 000F5 | 6B03 | EVENT | 875,0,200US | |
| 000F7 | 00 | | | |
| 00078 | 0000 | | | |
| 000FA | 6F03 | EVENT | 878,2,FDR5AFLT | CHECK IF AUX FOR STILL ON |
| 000FC | 02 | | | |
| 000FD | 0000 | | | |
| 000FF | 7203 | EVENT | 882,1,FDR1AXFD | AUX FEED TIME |
| 00101 | 01 | | | |
| 00102 | 0000 | | | |
| 00104 | 8403 | EVENT | 900,0,200US | |
| 00106 | 00 | | | |
| 00107 | 0000 | | | |
| 00109 | 8E03 | EVENT | 910,0,91*FV | |

TABLE II-continued

FIXED PITCH EVENT TABLE

| | | | |
|---|---|---|---|
| 0010B | 00 | | |
| 0010C | 0000 | | |
| 0010E | E703 | EVENT | 999,0,OVER*RUN |
| 00110 | 00 | | |
| 00111 | 0000 | | |
| | | ENDTABLE | |

TABLE III

VARIABLE PITCH EVENT TABLE

| | | | | |
|---|---|---|---|---|
| 00 | 01 | FLSH*BSE | FQU | 1 |
| 00 | 0F | FO&ONBSE | FQU | 15 |
| 00 | 6F | FO*OFFBS | FQU | 111 |
| 00000 | 0100 | ROM*FSH | DW | FLSH*BSE |
| 00002 | 00 | | DB | O |
| 00003 | 0000 | | DW | FSH*ON |
| 00005 | 6F00 | ROM*OFF | DW | FO*OFFBS |
| 00007 | 00 | | DB | O |
| 00008 | 0000 | | DW | FO*OFF |

TABLE III-continued

VARIABLE PITCH EVENT TABLE

| | | | | |
|---|---|---|---|---|
| 0000A | 0F00 | ROM*ON | DW | FO*ONBSE |
| 0000C | 00 | | DB | O |
| 0000D | 0000 | | DW | FO*ON |
| 0000F | 0100 | ROM*FSHS | DW | FLSH*BSE |
| 00011 | 00 | | DB | O |
| 00012 | 0000 | | DW | FSH*ON*S |
| 00014 | 6F00 | ROM*OFFS | DW | FO*OFFBS |
| 00016 | 00 | | DB | O |
| 00017 | 0000 | | DW | FO*OFF*S |

TABLE IV

PITCH TABLE BUILDER

| | | | | | |
|---|---|---|---|---|---|
| 00113 | 2A0000 | TBLD*PRT | LHLD | ROM*FSH | H&L= BASE CNT OF FLASH |
| 00116 | EB | XCHG | | | D&E= BASE CNT OF FLASH |
| 00117 | 2A56F8 | LHLD | | 1FLSH*ON | H&L= RED ADJ |
| 0011A | 19 | DAD | | D | H&L= BASE + ADJ |
| 0011B | 2283F8 | SHLD | | RAM*FSH | RAM*FSH= BASE + ADJ |
| 0011E | 2AC500 | LHLD | | ROM*OFF | H&L= BASE CNT OF FO OFF |
| 00121 | EB | XCHG | | | B&E= BASE CNT OF FO OFF |
| 00122 | 2A58F8 | LHLD | | 1FO*OFF | H&L= BASE ADJ + TRIM ADJ |
| 00125 | 19 | DAD | | D | H&L= BASE + ADJ |
| 00126 | 2288F8 | SHLD | | RAM*OFF | RAM*OFF= BASE + ADJ |
| 00129 | 2A0A00 | LHLD | | ROM*ON | H&L= BASE CNT OF FO ON |
| 0012C | EB | XCHG | | | B&E= BASE CNT OF FO ON |
| 0012D | 2A5AF8 | LHLD | | 1FO*ON | H&L= RED ADJ + TRIM ADJ |
| 00130 | 19 | DAD | | D | H&L= BASE + ADJ |
| 00131 | CD0303 | CALL | | ON*MOD | CALL MOD ROUTINE TO MOD IF 0 |
| 00134 | 228DF8 | SHLD | | RAM*ON | RAM*ON= RESULTS OF ABOVE |
| 00137 | 3A1DF4 | IF: | | FLG,IMG*SFT,T | IS THERE IMAGE SHIFT |
| 0013A | 07 | | | | |
| 0013B | D26F01 | | | | |
| 0013E | 3E06 | MVI | | A,6 | YES, # OF VAR EVENTS TO USE= 6 |
| 00140 | 47 | MOV | | B,A | SET UP B-REG FOR LOOP CONTROL |
| 00141 | 3215FE | STA | | TBLD*NUM | STORE # OF VAR EVENTS |
| 00144 | 3D | DCR | | A | SET UP # OF TIMES TO GO |
| 00145 | 3221FE | STA | | TBLD*TMP | THRU SORT |
| 00148 | 2A0F00 | LHLD | | ROM*FSHS | UPDATE ROM*FSHS TO |
| 0014B | EB | SCHG | | | INCLUDE RED MODE ADJ + SHIFT |
| 0014C | 2A5CF8 | LHLD | | 2FLSH*ON | ADJ AND SAVE FOR THE |
| 0014F | 19 | DAD | | D | IMAGE SHIFT |
| 00150 | 2292F8 | SHLD | | RAM*FSHS | FLASH EVENT |
| 00153 | 2A1400 | LHLD | | ROM*OFFS | UPDATE ROM*OFFS TO INCLUDE |
| 00156 | EB | XCHG | | | RED MODE ADJ + TRIM ADJ + |
| 00157 | 2A5EF8 | LHLD | | 2FO*OFF | SHIFT ADJ AND SAVE |
| 0015A | 19 | DAD | | D | FOR THE IMAGE SHIFT |
| 0015B | 2297F8 | SHLD | | RAM*OFFS | FADE OUT EVENT |
| 0015E | 2A1900 | LHLD | | ROM*ONS | UPDATE ROM*ONS TO INCLUDE |
| 00161 | EB | XCHG | | | RED MODE ADJ + TRIM ADJ + |
| 00162 | 2A60F8 | LHLD | | 2FO*ON | SHIFT ADJ |
| 00165 | 19 | DAD | | D | |
| 00166 | CD0303 | CALL | | ON*MOD | CALL MOD ROUTINE TO MOD IF 0 |
| 00169 | 229CF8 | SHLD | | RAM*ONS | SAVE THE RESULTS |
| 0016C | C37901 | ELSE: | | | |
| 0016F | 3F303 | MVI | | A,3 | IF IMAGE SHIFT NOT SET |
| 00171 | 47 | MOV | | B,A | #OF VAR EVENTS TO USE = 3 |
| 00172 | 3215FE | STA | | TBLD*NUM | SET UP B-REG LOOP CONTROL |
| 00175 | 3D | DCR | | A | STORE # OF VAR EVENTS & SETUP |
| 00176 | 3221FE | STA | | TBLD&TMP | #OF TIMES TO GO THRU SORT |
| | | ENDIF | | | |

TABLE V

SORTS VARIABLE RAM EVENT TABLE BY
ABS CLK COUNT & LOWEST ENDS IN EV*RAM

| | | | | |
|---|---|---|---|---|
| 00197 | 2183F8 | 1XI | H,FV*RAM | H&L= ADDR OF TOP OF VAR RAM TBL |

TABLE V-continued

SORTS VARIABLE RAM EVENT TABLE BY
ABS CLK COUNT & LOWEST ENDS IN EV*RAM

| | | | | |
|---|---|---|---|---|
| 0019A | 3A21FE | WHILE: | XBYT,TBLD*TMP,NE,0 | TIMES TO GO THRU OUTER LOOP |
| 0019D | FE00 | | | |
| 0019F | CA1602 | | | |
| 001A2 | 3223FE | STA | IN*LP*CT | INTER LOOP CNT=OUTER LOOP CNT |
| 001A5 | 3E80 | SFLG | TBLD*1ST | SET 1ST FLAG FOR THIS POSITION |
| 001A7 | 3261F4 | | | |
| 001AA | 227FF8 | SHLD | FIX*ADDR | ADDR OF POSITION TO FULL |
| 001AD | B7 | ORA | A | CLEAR Z CONDITION BIT |
| 001AE | CA0802 | WHILE: | CC,Z,C | |
| 001B1 | 5F | MOV | E,M | E= LS PART OF ABS CLK COUNT |
| 001B2 | 23 | INX | H | |
| 001B3 | 56 | MOV | D,M | D= MS PART OF ABS CLK COUNT |
| 001B4 | D5 | PUSH | D | STORE ABS CLK CNT OF FILL POS |
| 001B5 | 3A61F4 | IF: | FLG,TB1D*1ST,T | IS IT 1ST TIME FOR THIS POS |
| 001B8 | 07 | | | |
| 001B9 | D2C701 | | | |
| 001BC | AF | CFLG | TB1D*1ST | YES, CLEAR ITS FLAG |
| 001BD | 3261F4 | | | |
| 001C0 | 23 | INX | H | AND INCREMENT |
| 001C1 | 23 | INX | H | POINTER TO LS PART OF |
| 001C2 | 23 | INX | H | ABS CLK COUNT OF NEXT |
| 001C3 | 23 | INX | H | EVENT |
| 001C4 | C3CF01 | ELSE: | | |
| 001C7 | 2A7DF8 | 1HLD | VAR*ADDR | H&L= ADDR |
| 001CA | 23 | INX | H | OF LS PART OF |
| 001CB | 23 | INX | H | ABS CLK COUNT TO |
| 001CC | 23 | INX | H | COMPARE TO FILL |
| 001CD | 23 | INX | H | POSITION |
| 001CE | 23 | INX | H | |
| | | ENDIF | | |
| 001CF | 227DF8 | SHLD | VAR*ADDR | STORE POINTER TO COMPARE EVENT |
| 001D2 | 5F | MOV | EM, | F= LS PART OF COMPARE ABS CLK |
| 001D3 | 23 | INX | H | |
| 001D4 | 56 | MOV | D,M | D= MS PART OF COMPARE ABS CLK |
| 001D5 | E1 | POP | H | H&L= ABS CLK COUNT OF FILL POS |
| 001D6 | EB | IF: | XWRD,D,LT,H | IS CLK OF COMPARE<FILL |
| 001D7 | CD0000 | | | |
| 001DA | D2FE01 | | | |
| 001DD | 2A7DF8 | LHLD | VAR*ADDR | YES, SWITCH THE 2 EVENTS |
| 001E0 | EB | XCHG | | D&F= ADDR LOWER CLK VALUE |
| 001E1 | 2A7FF8 | LHLD | FIX*ADDR | H&L= ADDR LARGER CLK VALUE |
| 001E4 | 3FFB | MVI | A,-5 | INITIALIZE LOOP COUNTER TO 5 |
| 001E6 | 3222FE | STA | TSW*NUM | WHICH = # OF ITEMS TO MOVE |
| 001E9 | B7 | ORA | A | CLEAR Z CONDITION BIT |
| 001EA | CAFE01 | WHILE: | CC,Z,C | |
| 001ED | 1A | LDAX | D | A= CONTAINS OF COMPARE EVENT |
| 001EE | 46 | MOV | B,M | B= CONTAINS OF FILL EVENT |
| 001EF | 77 | MOV | M,A | UPDATE FILL POS |
| 001F0 | 78 | MOV | A,B | UPDATE COMPARE POS |
| 001F1 | 12 | STAX | D | WITH NEW VALUE |
| 001F2 | 13 | INX | D | MOVE POINTERS TO |
| 001F3 | 23 | INX | H | NEXT ITEM |
| 001F4 | 3A22FE | LDA | TSW*NUM | INC MOVE |
| 001F7 | 3C | INR | A | LOOP CONTROL |
| 001F8 | 3222FE | STA | TSW*NUM | COUNTER |
| 001FB | C3EA01 | ENDWHILE | | |
| | | ENDIF | | |
| 001FE | 2123FE | DECBYT | IN*LP*CT | DECRM INNER LOOP CNTR |
| 00201 | 35 | | | |
| 00202 | 2A7FF8 | LHLD | FIX*ADDR | H&L= ADDR OF FILL POSITION |
| 00205 | C3AE01 | ENDWHILE | | |
| 00208 | 110500 | LXI | D,5 | MOV H&L TO LOOK AT NEXT EVENT |
| 0020B | 19 | DAD | D | POSITION TO FILL |
| 0020C | 3A21FE | LDA | TBLD*TMP | DECREMENT # OF EVENTS |
| 0020F | 3D | DCR | A | TO SORT |
| 00210 | 3221FE | STA | TBLD*TMP | |
| 00213 | C39A01 | ENDWHILE | | |

TABLE VI

MOVE THE SR# & EVENT ADDR FROM ROM TABLE TO RAM TABLE

| | | | | |
|---|---|---|---|---|
| 00179 | 1183F8 | 1XI | D,RAM*FSH | D&F= ADDR OF RAM TABLE |
| 0017C | 210000 | 1XI | H,ROM*FSH | H&L= ADDR OF ROM TABLE |
| 0017F | BO | CRA | B | CLEAR Z CONDITION BIT |
| 00180 | CA9701 | WHILE: | CC,Z,C | |
| 00183 | 23 | INX | H | INCREMENT H&L AND D&E |
| 00184 | 23 | INX | H | POINTERS OVER THE |
| 00185 | 13 | INX | D | ABS CLK COUNT |

TABLE VI-continued

| MOVE THE SR# & EVENT ADDR FROM ROM TABLE TO RAM TABLE | | | | |
|---|---|---|---|---|
| 00186 | 13 | INX | D | |
| 00187 | 7E | MOV | A,M | LOAD A WITH SR# |
| 00188 | 12 | STAX | D | STORE SR# IN RAM TABLE |
| 00189 | 23 | INX | H | MOVE POINTERS TO LS |
| 0018A | 13 | INX | D | ADDR OF EVENT |
| 0018B | 7F | MOC | A,M | LOAD A WITH LS ADDR OF EVENT |
| 0018C | 1P | STAX | D | & STORE IT IN RAM TABLE |
| 0018D | 23 | INX | H | MOVE POINTERS TO MS |
| 0018E | 13 | INX | D | ADDR OF EVENT |
| 0018F | 7E | MOV | A,M | MOVE MS ADDR OF EVENT |
| 00190 | 12 | STAX | D | TO RAM |
| 00191 | 23 | INX | H | MOVES POINTERS TO |
| 00192 | 13 | INX | D | LS PART OF ABS CLK COUNT |
| 00193 | 05 | DCR | B | DECREMENT LOOP COUNTER |
| 00194 | C38001 | ENDWHILE | | |

TABLE VII

| MERGE VARIABLE PITCH EVENT TABLE & FIXED EVENT TABLE CALCULATING THE REL DIFFERENCE WITH THE RESULTS GOING INTO THE RUN EVENT TABLE | | | | |
|---|---|---|---|---|
| 00216 | 2A83F8 | LHLD | EV*RAM | INITIALIZE VAR*CLK TO ABS CLK |
| 00219 | 227BF8 | SHLD | VAR*CLK | COUNT OF 1ST VAR PITCH EVENT |
| 0021C | 2183F8 | LXI | H,EV*RAM | INITIALIZE VAR*ADDR TO ADDR OF |
| 0021F | 227DF8 | SHLD | VAR*ADDR | 1ST VAR PITCH EVENT |
| 00222 | 211E00 | LXI | H,EV*ROM | INITIALIZE FIX*ADDR TO ADDR OF |
| 00225 | 227FF8 | SHLD | FIX*ADDR | 1ST FIXED PITCH EVENT |
| 00228 | 3E80 | SFLG | TB1D*1ST | NOTES 1ST EVENT TO RUN TABLE |
| 0022A | 3261F4 | | | |
| 0022D | 3E31 | MVI | A,TABLENUM | INITIALIZE TSW*NUM TO # OF |
| 0022F | 3222FE | STA | TSW*NUM | EVENTS IN FIXED PITCH TABLE |
| 00232 | 2A1E00 | LHLD | EV*ROM | INITIALIZE D&E WITH ABS CLOCK |
| 00235 | EB | XCHG | | COUNT OF 1ST FIXED EVENT |
| 00236 | AF | CFLG | VAR*DONE | FLAG DENOTES VAR EVENTS |
| 00237 | 3262F4 | | | |
| 0023A | 3A62F4 | WHILE: | FLG,VAR*DONE,F | WHILE THERE ARE MORE VAR EVENTS |
| 0023D | 07 | | | |
| 0023E | DA8802 | | | |
| 00241 | 2A7BF8 | IF: | XWRD,VAR*CLK,LE,D | IS VAR CLK CNT = FIXED CLK CNT |
| 00244 | CD0000 | | | |
| 00247 | DA4D02 | | | |
| 0024A | C27202 | | | |
| 0024D | 2A7DF8 | LHLD | VAR*ADDR | YES, H&L= VAR EVENT ADDR |
| 00250 | CDAC02 | CALL | TBLD*UPD | PLACE VAR EVENT AT END RUN TBL |
| 00253 | 3A15FE | LDA | TBLD*NUM | DECREMENT # OF |
| 00256 | 2D | DCR | A | VARIABLE EVENTS LEFT |
| 00257 | 3215FE | STA | TBLD*NUM | TO MERGE |
| 0025A | C26502 | IF: | CC,Z,S | DID TBLD*NUM GO TO 0 |
| 0025D | 3F80 | SFLG | VAR*DONE | YES, DENOTE NO MORE VAR EVENTS |
| 0025F | 3262F4 | | | |
| 00262 | 036F02 | ELSE: | | |
| 00265 | 227DF8 | SHLD | VAR*ADDR | STORE ADDR OF NEXT VAR EVENT |
| 00268 | 5F | MOV | E,M | UPDATE VAR*CLK TO |
| 00269 | 23 | INX | H | VALUE OF ABS CLK COUNT |
| 0026A | 56 | MOV | D,M | OF PRESENT VARIABLE |
| 0026B | EB | XCHG | | EVENT |
| 0026C | 227BF8 | SHLD | VAR*CLK | |
| | | ENDIF | | |
| 0026F | C37F02 | ELSE: | | IF FIXED TABLE CLK COUNT IS |
| 00272 | 2A7FF8 | LHLD | FIX*ADDR | LESS THEN VAR TABLE UPDATE THE |
| 00275 | CDAC02 | CALL | TBLD*UPD | RUN TABLE WITH THAT EVENT |
| 00278 | 227FF8 | SHLD | FIX*ADDR | UPDATE TO NEXT FIXED EVENT |
| 0027B | 2122FE | LXI | H,TSW*NUM | DECREMENT # OF FIXED EVENTS |
| 0027E | 35 | DCR | M | LEFT |
| | | ENDIF | | |
| 0027F | 2A7EF8 | LHLD | FIX*ADDR | |
| 00282 | 5F | MOV | E,M | UPDATE D&L TO = |
| 00283 | 23 | INX | H | ABS CLK CNT VALUE |
| 00284 | 56 | MOV | D,M | OF PRESENT FIXED TABLE |
| 00285 | C33A02 | ENDWHILE | | |
| 00288 | 3FFF | MVI | A,X'FF' | CLEAR Z CONDITION |
| 0028A | B7 | ORA | A | BIT FOR LOOP |
| 0028B | 2A7FF8 | LHLD | FIX*ADDR | NO MORE VAR EVENTS, USE FIXED |
| 0028E | CA9D02 | WHILE: | CC,Z,C | DONE WITH FIXED TABLE |
| 00291 | CDAC02 | CALL | TBLD*UPD | NO, UPDATE RUN TABLE |
| 00294 | EB | XCHG | | SAVE H&L IN D&F |
| 00295 | 2122FE | LXI | H,TSW*NUM | DECREMENT # OF FIXED |
| 00298 | 35 | DCR | M | EVENTS LEFT |
| 00299 | EB | XCHG | | RESTORE H&L |

TABLE VII-continued

MERGE VARIABLE PITCH EVENT TABLE & FIXED EVENT TABLE CALCULATING THE REL DIFFERENCE WITH THE RESULTS GOING INTO THE RUN EVENT TABLE

| | | | | |
|---|---|---|---|---|
| 0029A | C38E02 | ENDWHILE | | |
| 0029D | 2A81F8 | LHLD | P*TBL*A | H&L= ADDR OF LAST MS ADDR IN RUN |
| 002A0 | 2B | DCX | H | MOVE H&L POINTER BACK TO PRINT |
| 002A1 | 2B | DCX | H | AT THE BEGINNING OF THE LAST |
| 002A2 | 2B | DCX | H | EVENT (OVER*RUN) & STORE IT |
| 002A3 | 2250F8 | SHLD | EV*PTR: | FOR MACH CLK INTERRUPT HANDLER |
| 002A6 | 3E80 | SFLG | TB1D*FIN | DENOTES PITCH TABLE IS COMPLETE |
| 002A8 | 325DF4 | | | |
| 002AB | C9 | RET | | |

TABLE VIII

PITCH RESET INTERRUPT HANDLER

| | | | | | |
|---|---|---|---|---|---|
| 00 | 01 | C | SET | 1 | ALLOW THE USE OF C-REG |
| 000EE | FB | RSET: | EI | | RE-ENABLE INTERRUPTS |
| 000EF | F5 | | PUSH | PSW | SAVE A-REG & CONDITION BITS |
| 000F0 | 3A5DF4 | | IF: | FLG,TBLD*FIN,T | IS RUN TABLE BUILD FINISHED |
| 000F3 | 07 | | | | |
| 000F4 | D25401 | | | | |
| 000F7 | 3A21F4 | | IF: | FLG,SR*DONE,T | YES, IS THERE A NEW SR VALUE |
| 000FA | 07 | | | | |
| 000FB | D24A01 | | | | |
| 00145 | 3A60F4 | | ANDIF | FLG,910*DONE,T | YET,DID 910 EVENT GET DONE |
| 00148 | 07 | | | | |
| 00149 | D29B01 | | | | |
| 000FE | AF | | CFLG | SR*DONE | YES, CLR FLAG FOR NEXT SR EVENT |
| 000FF | 3221F4 | | | | |
| 00102 | E5 | | PUSH | H | SAVE H&L |
| 00103 | 2101FE | | LXI | H,SR*PTR: | H&L= ADDR OF REL PNTR TO SR#0 |
| 00106 | 7E | | MOV | A,M | A = REL PNTR TO SR#0 |
| 00107 | D601 | | SUI | 1 | MOVE PNTR BACK 1 SR POSITION (DECREMENT SR PTR) |
| 00109 | E61F | | ANI | SR*ADJ: | CORRECT FOR POSSIBLE OVERFLOW |
| 0010B | 77 | | MOV | M,A | SAVE NEW REL SR PNTR IN SR*PTR: |
| 0010C | 26F8 | | MVI | H,SR*BASE: | |
| 0010E | 6F | | MOV | L,A | H&L= ABS ADDR OF SR#0 |
| 0010F | 3A05FE | | LDA | SR*VALU: | A= NEW SR VALUE |
| 00112 | 77 | | MOV | M,A | UPDATE CONTENTS OF SR#0 |
| 00113 | 211FFE | | LXI | H,EV*1*TIM | H&L= ADDR OF TIME TO 1ST EVENT |
| 00116 | 4E | | MOV | C,M | C= REL DIFF TO 1ST EVENT |
| 00117 | 2100FB | | LXI | H,EV*BASE: | H&L= ADDR OF 1ST EVENT |
| 0011A | 2250F8 | | SHLD | EV*PTR: | SAVE IN EV*PTR: |
| 0011D | 3A10F4 | | IF: | FLG,NORM*DN:,F | IS NORMAL SHUTDOWN REQUESTED |
| 00120 | 07 | | | | |
| 00121 | DA4601 | | | | |
| 00124 | 3A49F7 | | ANDIF: | FLG,CYCL*DN:,F | NO, IS CYCLE-DOWN REQUESTED |
| 00127 | 07 | | | | |
| 00128 | DA4601 | | | | |
| 00128 | 3A16F4 | | ANDIF: | FLG,SD1*DLY,F | NO, IS PROC DEAD CYCLING |
| 0012E | 07 | | | | |
| 0012F | DA4601 | | | | |
| 00132 | 2107FE | | LXI | C,CYCUPCT: | NO, H&L= ADDR OF CYCLE-UP CNTR |
| 00135 | 7E | | IF: | XBYT,M,NE,5 | IS PROC IN CYCLE-UP MODE |
| 00136 | FE05 | | | | |
| 00138 | CA4601 | | | | |
| 0013B | FE04 | | IF: | XBYT,A,EQ,4 | YES, IS IT RDY TO MAKE 1ST IMG |
| 0013D | C24501 | | | | |
| 00140 | 3E80 | | SFLG | IMGMADE: | YES, SIGNAL 1ST IMAGE MADE |
| 00142 | 320FF4 | | | | |
| | | | ENDIF | | |
| 00145 | 34 | | INR | M | INCRM CYCLE-UP CNTR (UNTIL= 5) |
| | | | ENDIF | | |
| | | | ENDIF | | |
| 00146 | E1 | | POP | H | RESTORE H&L |
| 00147 | C35401 | | ELSE: | | NEW SR VALUE NOT AVAILABLE |
| 0014A | 3E80 | | SFLG | IMED*DN: | REQUEST AN IMED SHUTDOWN |
| 0014C | 324AF7 | | | | |
| 0014F | 3E80 | | SFLG | E*PR*FLT | SIGNAL EARLY PITCH RESET FAULT |
| | | | ENDIF | | |
| | | | ENDIF | | |
| 00154 | 3EFE | | MVI | A,RSETFF: | LOAD FLIP-FLOP RESET INSTR |
| 00156 | 3200E6 | | STA | RSINTFF: | RESET PITCH RESET FLIP-FLOP |
| 00159 | F1 | | POP | PSW | RESTORE A-REG & CONDITION BITS |
| 0015A | C9 | | RET | | RETURN TO INTERRUPTED ROUTINE |

TABLE IX

MACHINE CLOCK INTERRUPT HANDLER

| | | | | | |
|---|---|---|---|---|---|
| 00 | 01 | | SET | 1 | ALLOW THE USE OF THE C-REG |
| 06 | 2B | | ORIGIN | X'38' | |
| 00038 | F5 | MCLK | PUSH | PSW | SAVE A-REG & CONDITION CODES |
| 00039 | 0D | | DCR | C | DECRM MACH CLOCK CNTR |
| 0003A | C26400 | | IF: | CC,Z,S | IT IS ,EQ,0 |
| 0003D | E5 | | PUSH | H | YES, PREPARE TO DO EVENT |
| 0003E | D5 | | PUSH | D | SAVE H&L AND D&E |
| 0003F | 2A50F8 | | LHLD | EV*PTR: | H&L= EVENT TABLE PNTR |
| 00042 | 4E | | MOV | C,M | C= REL DIFF (CLOCK COUNTS) |
| 00043 | C5 | | PUSH | B | SAVE B&C (C-REG NOT AFFECTED) |
| 00044 | 23 | | INX | H | H&L NOW PNT TO REL SR IN TABLE |
| 00045 | 3A01FE | | LDA | SR*PTR: | A= PNTR TO '0' SR POSITION |
| 00048 | 86 | | ADD | M | A= PNTR TO PROPER SR POSITION |
| 00049 | E61F | | ANI | SR*ADJ: | ADJUST A-REG FOR TABLE OVERFLOW |
| 0004B | 5F | | MOV | E,A | E= LO ADDR OF PROPER SR |
| 0004C | 47 | | MOV | B,A | B= LO ADDR OF PROPER SR |
| 0004D | 16F8 | | MVI | D,SR*BASE: | D= HI ADDR OF SHIFT REGS |
| 0004F | 1A | | LDAX | D | A= <PROPER SR> |
| 00050 | 23 | | INX | H | H&L NOW PNT TO LO EVENT ADDR |
| 00051 | 5E | | MOV | E,M | E= LO EVENT ADDR |
| 00052 | 23 | | INX | H | H&L NOW PNT TO HI EVENT ADDR |
| 00053 | 56 | | MOV | D,M | D= HI EVENT ADDR |
| 00054 | 23 | | INX | H | H&L NOW PNT TO REL DIFF FOR NEXT EVENT |
| 00055 | 2250F8 | | SHLD | EV*PTR: | SAVE H&L FOR NEXT EVENT TIME |
| 00058 | EB | | XCHG | | H&L= ADDR OF EVENT SUBR |
| 00059 | 115E00 | | LXI | D,RTN: | D&E= RETURN ADDR FOR EVENT SUBR |
| 0005C | D5 | | PUSH | D | SAVE ON STACK (EVENTS USE RET) |
| 0005D | E9 | | PCHL | | 'CALL' PROPER EVENT SUBR |
| 0005E | C1 | RTN: | POP | B | RESTORE B&C |
| 0005F | D1 | | POP | D | RESTORE D&E |
| 00060 | E1 | | POP | H | RESTORE H&L |
| 00061 | C36D00 | | ELSE: | | |
| 00064 | 79 | | IF: | XBYT,C,AND,1,NZ | IS IT TIME FOR A REFRESH |
| 00065 | E601 | | | | |
| 00067 | CA6D00 | | | | |
| 0006A | 3202E6 | | REFRESH | | YES, INITIATE AN OUTPUT REFRESH |
| | | | ENDIF | | |
| | | | ENDIF | | |
| 0006D | FB | | EI | | RE-ENABLE INTERRUPT SYSTEM |
| 0006E | 3EFD | | MVI | A,MCLKFF: | |
| 00070 | 3200E6 | | STA | RSINTFF: | RESET MCLK INTERRUPT FLIP-FLOP |
| 00073 | F1 | | POP | PSW | RESTORE A-REG & CONDITION BITS |
| 00074 | C9 | | RET | | RETURN TO INTERRUPTED ROUTINE |
| 00 | 09 | | SET | 9 | DISALLOW THE USE OF THE C-REG |

TABLE X

AUTOMATIC DOCUMENT HANDLER INTERRUPT HANDLER

| | | | | | |
|---|---|---|---|---|---|
| 00000001 | | C | SET | 1 | ALLOW PUSH B TO SAVE B ON STACK |
| 00075 | FB | ADHCLK: | FI | | ENABLE INTERRUPTS |
| 00076 | F5 | | PUSH | PSW | SAVE A-REG & CONDITION CODES |
| 00077 | E5 | | PUSH | H | SAVE H&L |
| 00078 | 212FFE | | IXI | H,AD*D*CNT | INR COUNTER TO COUNT CLK COUNTS |
| 0007B | 34 | | INR | M | BETWEEN EVENTS FOR DIAGNOSTICS |
| 0007C | 2116FE | | IXI | H,AD*CLK | DEC COUNTER WHICH CONTENTS |
| 0007F | 35 | | DCR | M | IS ADH CLK CNTS BETWEEN EVENTS |
| 00080 | C2B300 | | IF: | CC,Z,S | HAS IT GONE TO ZERO |
| 00083 | D5 | | PUSH | D | SAVE D&E |
| 00084 | C5 | | PUSH | B | SAVE B&C |
| 00085 | 3A17FE | | CASE: | VBYT,AD*STATE | GO TO THE CORRECT SEQ SUB- |
| 00088 | 11B000 | | | | |
| 0008B | FF10 | | | | |
| 0008D | CD0000 | | | | |
| 00090 | 0000 | | C,0 | AD0STATE | ROUTINE |
| 00092 | 0000 | | C,1 | AD1STATE | |
| 00094 | 0000 | | C,2 | AD2STATE | |
| 00096 | 0000 | | C,3 | AD3STATE | |
| 00098 | 0000 | | C,4 | AD4STATE | |
| 0009A | 0000 | | C,5 | AD5STATE | |
| 0009C | 0000 | | C,6 | AD6STATE | |
| 0009E | 0000 | | C,7 | AD7STATE | |
| 000A0 | 0000 | | C,8 | AD8STATE | |
| 000A2 | 0000 | | C,9 | AD9STATE | |
| 000A4 | 0000 | | C,10 | ADASTATE | |
| 000A6 | 0000 | | C,11 | ADBSTATE | |
| 000A8 | 0000 | | C,12 | AD0STATE | |
| 000AA | 0000 | | C,13 | AD0STATE | |
| 000AC | 0000 | | C,14 | AD0STATE | |

TABLE X-continued

AUTOMATIC DOCUMENT HANDLER INTERRUPT HANDLER

| | | | | | |
|---|---|---|---|---|---|
| 000AE | 0000 | | C,15 | ADESTATE | |
| | | | FINDCASE | | |
| 000B0 | E1 | | POP | H | PULL B&C OFF STACK |
| 000B1 | 44 | | MOV | B,H | RESTORE ONLY B-REG |
| 00082 | D1 | | POP | D | RESTORE D&E |
| | | | ENDIF | | |
| 000B3 | E1 | | POP | H | RESTORE H&L |
| 000B4 | 3FFB | | MVI | A,ADHFF: | RESET ADH INTERRUPT |
| 00086 | 3200E6 | | STA | RSINTFF: | FLIP-FLOP |
| 000B9 | F1 | | POP | PSW | RESTORE A & CONDITION CODES |
| 000BA | C9 | | RET | | RETURN TO WHERE IT CAME FROM |
| 0000009 | | C | SET | 9 | DISALLOW USE FOR C-REG |

TABLE XI

REAL TIME CLOCK INTERRUPT HANDLER

| | | | | | |
|---|---|---|---|---|---|
| 000A6 | FB | RTC: | EI | | RE-ENABLE INTERRUPTS |
| 000A7 | F5 | | PUSH | PSW | SAVE A-REG & CONDITION BITS |
| 000A8 | E5 | | PUSH | H | SAVE H&L |
| 000A9 | D5 | | PUSH | D | SAVE D&E |
| 000AA | 2120F8 | | LXI | H,TMRBASE: | H&L= ADDR OF 1ST 10 MSEC TIMER |
| 000AD | 160F | | MVI | D,TIMCNTL: | D= # OF 10 MSEC TIMERS |
| 000AF | 3A55F4 | | IF: | FLG,DOOR*OPN,T | IS THERE AN INTERLOCK OPEN |
| 000B2 | 07 | | | | |
| 000B3 | D2B800 | | | | |
| 000B6 | 160D | | MVI | D,TIMCNTL:-2 | YES, PUT 2 TIMERS INTO HOLD |
| | | | ENDIF | | |
| 000B8 | 5A | | MOV | E,D | D=E= # 10 MSEC TIMERS TO DECRM |
| 000B9 | AF | | XRA | A | A= 0 (SET '2' CONDITION CODE) |
| 000BA | 3C | | INR | A | A= 1 (TIMER TERMINAL COUNT) |
| 000BB | CAC800 | | WHILE: | CC,Z,C | WHILE '# TIMERS' .NE. 0... |
| 000BE | 35 | | DCR | M | DECRM PRESENT 10 MSEC TIMER |
| 000BF | C2C300 | | IF: | CC,Z,S | IS PRESENT TIMER .EQ. 0 |
| 000C2 | 77 | | MOV | M,A | YES, RESET TO 1 (TERMINAL CNT) |
| | | | ENDIF | | |
| 000C3 | 23 | | INX | H | H&L= NEXT TIMER ADDR |
| 000C4 | 1D | | DCR | E | DECRM LOOP CNTR (# OF TIMERS) |
| 000C5 | C3BB00 | | ENDWHILE | | |
| 000C8 | 2106FE | | LXI | H,DIVD10: | H&L= ADDR OF DIVD BY 10 CNTR |
| 000CB | 35 | | DCR | M | DECRM DIVD BY 10 CNTR |
| 000CC | C2E500 | | IF: | CC,Z,S | IS IT .EQ.0 |
| 000CF | 360A | | MVI | M,10 | YES, RESET IT TO 10 |
| 000D1 | 212FF8 | | LXI | H,TMRBASE:+TIMCNTL: | H&L= ADDR OF 1ST 100 MSEC TIMER |
| 000D4 | 7A | | MOV | A,D | A= # TIMERS USED IN 1ST LOOP |
| 000D5 | D60A | | SUI | TIMCNT1:−TIMCNT2: | A= # 100 MSEC TIMERS TO DECRM |
| 000D7 | 1C | | INR | E | E= 1 (TIMER TERMINAL COUNT) |
| 000D8 | CAE500 | | WHILE: | CC,Z,C | WHILE '# TIMERS' .NE. 0... |
| 000DB | 35 | | DCR | M | DECRM PRESENT 100 MSEC TIMER |
| 000DC | C2E000 | | IF: | CC,Z,S | IS PRESENT TIMER .EQ. 0 |
| 000DF | 73 | | MOV | M,E | YES, RESET TO 1 (TERMINAL CNT) |
| | | | ENDIF | | |
| 000E0 | 23 | | INX | H | H&L= NEXT TIMER ADDR |
| 000E1 | 3D | | DCR | A | DECRM '# OF TIMERS' CNTR |
| 000E2 | C3D800 | | ENDWHILE | | |
| | | | ENDIF | | |
| 000E5 | D1 | | POP | D | RESTORE D&E |
| 000E6 | E1 | | POP | H | RESTORE H&L |
| 000E7 | 3EF7 | | MVI | A,RTCFF: | LOAD FLIP-FLOP RESET INSTR |
| 000E9 | 3200E6 | | STA | RSINTFF: | RESET RTC INTERRUPT FLIP-FLOP |
| 000EC | F1 | | POP | PSW | RESTORE A-REG & CONDITION BITS |
| 000ED | C9 | | RET | | RETURN TO INTERRUPTED ROUTINE |

Referring particularly to the timing chart shown in FIG. 41, an exemplary copy run wherein three copies of each of two simplex or one-sided originals in duplex mode is made. Referring to FIG. 32, the appropriate button of copy selector 808 is set for the number of copies desired, i.e. 3 and handler button 822, sorter select button 825 and two sided (duplex) button 811 depressed. The originals, in this case, two simplex or one-sided originals are loaded into tray 233 of document handler 16 (FIG. 14) and the Print button 805 depressed. On depression of button 805, the host machine 10 enters the PRINT state and the Run Event Table for the exemplary copy run programmed is built by controller 18 and stored in RAM section 546. As described, the Run Event Table together with Background routines serve, via the multiple interrupt system and output refresh (through D.M.A.) to operate the various components of host machine 10 in integrated timed relationship to produce the copies programmed.

During the run, the first original is advanced onto platen 35 by document handler 16 where, as seen in FIG. 41, three exposures (1ST FLASH SIDE 1) are made producing three latent electrostatic images on belt 20 in succession. As described earlier, the images are developed at developing station 28 and transferred to individual copy sheets fed forward (1ST FEED SIDE 1) from main paper tray 100. The sheets bearing the images are carried from the transfer roll/belt nip by vacuum transport 155 to fuser 150 where the images are fixed. Following fusing, the copy sheets are routed by deflector 184 to return transport 182 and carried to auxiliary tray 102. The image bearing sheets entering tray 102 are aligned by edge patter 187 in preparation for refeeding thereof.

Following delivery of the last copy sheet to auxiliary tray 102, the document handler 16 is activated to remove the first original from platen 35 and bring the second original into registered position on platen 35. The second original is exposed three times (FLASH SIDE 2), the resulting images being developed on belt 20 at developing station 28 and transferred to the opposite or second side of the previously processed copy sheets which are now advanced (FEED SIDE 2) in timed relationship from auxiliary tray 102. Following transfer, the side two images are fused by fuser 150 and routed, by gate 184 toward stop 190, the latter being raised for this purpose. Abutment of the leading edge of the copy sheet with stop 190 causes the sheet trailing edge to be guided into discharge chute 186, effectively inverting the sheet, now bearing images on both sides. The inverted sheet is fed onto transport 181 and into sorter 14 where the sheets are placed in successive ones of the first three trays 212 of either the upper of lower arrays 210, 211 respectively depending on the disposition of deflector 220.

Other copy run programs, both simplex and duplex with and without sorter 14 and document handler 16 may be envisioned.

While the invention has been described with reference to the structure disclosed, it is not confined to the details set forth, but is intended to cover such modifications or changes as may come within the scope of the following claims.

What is claimed is:

1. In a reproduction machine having a plurality of components which cooperate with one another and a photosensitive member to electrostatically produce copies on support material, the improvement comprising:

a controller for operating said machine components said controller including a memory section and a processor for addressing said memory section to operate said machine components;

interface means for transferring control data between said machine components and said controller;

means for suspending operation of said processor;

means for accessing said memory section directly under control of the interface to obtain current control data for operating said machine components; and clock means for producing clock pulses which periodically actuate said suspension means, said clock pulses being derived in synchronism with machine operation.

2. The improvement of claim 1 wherein said memory section includes a buffer for temporarily holding control data pending transfer to said machine components, with said control data being simultaneously transferred to said machine components from said buffer while operation of said processor is temporarily suspended.

3. The improvement of claim 2 which further comprises:

a plurality of routines stored in the memory for actuating some of the machine components whose timing of actuation depends upon the particular copy run selected, said routines being listed in a sequential order necessary for properly timed actuation of their respective components;

a counter containing the number of clock pulses between successive component actuation;

means for changing the count of said counter at each occurrence of said clock pulse;

means responding to a pre-set count on said counter for accessing the next routine while re-setting said counter to a new count representing the interval to the succeeding component actuation; and said components being simultaneously refreshed with control data when said count on the counter does not correspond to said pre-set count.

4. A method of operating a reproduction machine having a plurality of selectively actuable machine components which operate with one another and a photosensitive member to electrostatically produce copies on support material, said machine having an operator console for selecting various types of copy runs, said machine having a programmable controller with memory for actuating said components, the memory normally under control of the controller, said controller in a first state actuating predetermined machine components regardless of the particular copy run selected and in a second state actuating predetermined machine components in a timing sequence depending upon the particular copy run selected, said method comprising:

forming a table in memory for actuation of machine components in the second state for proper completion of the selected copy run;

initially operating in the first state;

producing clock pulses in synchronism with the machine operation;

suspending operation in the first state in response to one of said clock pulses;

operating in the second state to actuate a machine component; including the step of providing control data from the memory to the machine components in the second state; and including the step of directly assessing the memory to provide control to the machine components independent of the control of the controller; and operating in the first state after completion of actuation of the component in the second state.

5. The method of claim 4 wherein the step of directly assessing the memory occurs no more than every other clock pulse produced in synchronism with the machine operation.

6. The method of claim 4 wherein the controller includes a storage element holding an indication of the number of clock pulses between actuation of successive machine components, including the step inhibiting directly accessing the memory if a predetermined number of clock pulses is indicated by the storage element.

7. The method of claim 4 including the step of simultaneously providing control data to a plurality of machine components.

* * * * *

UNITED STATES PATENT AND TRADEMARK OFFICE

CERTIFICATE OF CORRECTION

PATENT NO. : 4,478,509

DATED : October 23, 1984

INVENTOR(S) : John W. Daughton et al.

It is certified that error appears in the above-identified patent and that said Letters Patent is hereby corrected as shown below:

On the title page inventors should read

--(75) Inventors: John W. Daughton; Gary A. Gray; Stephen P. Wilczek and Edward L. Steiner --.

Signed and Sealed this

*Twenty-third* Day of *April 1985*

[SEAL]

*Attest:*

DONALD J. QUIGG

*Attesting Officer*

*Acting Commissioner of Patents and Trademarks*